US011305163B2

(12) United States Patent
Johnson et al.

(10) Patent No.: US 11,305,163 B2
(45) Date of Patent: Apr. 19, 2022

(54) GOLF CLUB HEADS

(71) Applicant: Taylor Made Golf Company, Inc., Carlsbad, CA (US)

(72) Inventors: Matthew David Johnson, San Diego, CA (US); David Bennett, Carlsbad, CA (US); Dana Ehyaei, Carlsbad, CA (US); Robert Story, Carlsbad, CA (US); Jake Feuerstein, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 16/660,561

(22) Filed: Oct. 22, 2019

(65) Prior Publication Data

US 2020/0139208 A1 May 7, 2020

Related U.S. Application Data

(60) Provisional application No. 62/755,319, filed on Nov. 2, 2018.

(51) Int. Cl.
*A63B 53/04* (2015.01)

(52) U.S. Cl.
CPC ..... *A63B 53/0466* (2013.01); *A63B 53/0412* (2020.08); *A63B 53/0433* (2020.08)

(58) Field of Classification Search
CPC ..... A63B 53/0412; A63B 53/0433
USPC ..... 473/324, 345, 328
See application file for complete search history.

(56) References Cited

U.S. PATENT DOCUMENTS 1,868,286 A * 7/1932 Grieve ..... A63B 60/00 473/328
3,761,095 A * 9/1973 Thompson ..... A63B 53/0466 473/327
3,815,921 A * 6/1974 Turner ..... A63B 60/00 473/328
3,979,123 A 9/1976 Belmont
4,319,752 A * 3/1982 Thompson ..... A63B 60/00 473/328
D307,783 S * 5/1990 Iinuma ..... D21/752
D310,254 S * 8/1990 Take ..... D21/752
D318,087 S * 7/1991 Helmstetter ..... D21/752
5,042,806 A * 8/1991 Helmstetter ..... A63B 60/00 473/311

(Continued)

FOREIGN PATENT DOCUMENTS

JP 2001170229 A * 6/2001 ..... B21K 17/00

*Primary Examiner* — William M Pierce
(74) *Attorney, Agent, or Firm* — Klarquist Sparkman, LLP

(57) ABSTRACT

Disclosed golf club heads include a body defining an interior cavity, a striking surface, a sole, a crown, and a hosel, which is configured to provide improved aerodynamic and inertia generating properties of the golf club head. Certain embodiments include an inertia generator positioned in the sole between an area proximate the club head's center of gravity and a position toeward of the center of gravity at the rear of the golf club head. Some embodiments include fixed or removable mass elements, weights or weight assemblies positioned in the sole, including, in some instances, within or adjacent to the inertia generator. In particular embodiments, one or more weight assemblies are movably retained within a weight channel defining a path along the sole.

21 Claims, 17 Drawing Sheets

(56) References Cited

U.S. PATENT DOCUMENTS 5,240,252 A * 8/1993 Schmidt ..... A63B 60/00 473/327
D339,395 S * 9/1993 Cameron ..... D21/752
D343,434 S * 1/1994 Helmstetter ..... D21/752
D344,117 S * 2/1994 Helmstetter ..... D21/752
5,301,945 A * 4/1994 Schmidt ..... A63B 60/00 473/311
5,380,009 A * 1/1995 Henry ..... A63B 53/0466 473/346
D356,843 S * 3/1995 Schmidt ..... D21/733
5,460,376 A * 10/1995 Schmidt ..... A63B 60/00 473/328
5,465,970 A * 11/1995 Adams ..... A63B 53/0466 473/327
5,470,068 A * 11/1995 Schmidt ..... A63B 53/04 473/311
5,482,280 A 1/1996 Yamawaki
5,518,243 A 5/1996 Redman
5,544,884 A * 8/1996 Hardman ..... A63B 53/0466 473/327
5,547,188 A * 8/1996 Dumontier ..... A63B 53/04 473/287
D402,339 S * 12/1998 Sheets ..... D21/733
D402,340 S * 12/1998 Sheets ..... D21/733
5,851,160 A * 12/1998 Rugge ..... A63B 53/04 473/349
5,997,415 A * 12/1999 Wood ..... A63B 53/0466 473/346
6,027,416 A * 2/2000 Schmidt ..... A63B 53/04 473/345
6,048,278 A * 4/2000 Meyer ..... A63B 53/0466 473/345
6,123,627 A * 9/2000 Antonious ..... A63B 53/04 473/327
6,165,080 A * 12/2000 Salisbury ..... A63B 53/0466 473/327
6,168,537 B1 1/2001 Ezawa
6,254,494 B1 7/2001 Hasebe et al.
6,325,728 B1 * 12/2001 Helmstetter ..... A63B 53/04 473/328
6,332,848 B1 * 12/2001 Long ..... A63B 53/0466 473/328
D479,867 S * 9/2003 Saliba ..... D21/752
6,863,624 B1 * 3/2005 Kessler ..... A63B 60/02 473/328
6,939,247 B1 9/2005 Schweigert et al.
7,041,003 B2 * 5/2006 Bissonnette ..... G01N 29/045 473/329
D534,229 S 12/2006 Barez et al.
7,175,541 B2 * 2/2007 Lo ..... A63B 53/0466 473/345
D541,364 S * 4/2007 Barez ..... D21/759
D550,318 S 9/2007 Oldknow
7,273,421 B2 * 9/2007 Knuth ..... A63B 53/0466 473/329
D553,703 S 10/2007 Hoffman et al.
D554,719 S 11/2007 Barez et al.
D554,720 S 11/2007 Barez et al.
D558,286 S 12/2007 Hoffman et al.
D561,856 S 2/2008 Barez et al.
D567,891 S 4/2008 Serrano et al.
D572,791 S 7/2008 Jertson et al.
D576,699 S 9/2008 Pergande et al.
D577,404 S 9/2008 Oldknow et al.
D588,217 S 3/2009 Jertson et al.
D588,659 S 3/2009 Jertson et al.
D598,510 S 8/2009 Barez et al.
D603,919 S 11/2009 Gray et al.
D604,376 S * 11/2009 Darley ..... D21/752
D614,711 S 4/2010 Harbert et al.
D618,748 S * 6/2010 Oldknow ..... D21/759
D619,668 S 7/2010 Nunez et al.
D627,842 S 11/2010 Gray et al.
D627,843 S 11/2010 Kuan et al.
7,993,216 B2 * 8/2011 Lee ..... A63B 60/00 473/334
8,012,038 B1 9/2011 Beach et al.
8,435,135 B2 * 5/2013 Stites ..... A63B 53/0466 473/334
8,608,591 B2 12/2013 Chao et al.
8,888,607 B2 * 11/2014 Harbert ..... A63B 53/02 473/307
9,168,434 B2 * 10/2015 Burnett ..... A63B 53/04
9,358,433 B2 * 6/2016 Flaherty ..... A63B 53/0466
D767,065 S 9/2016 Asazuma
D767,704 S 9/2016 Asatsuma
10,183,202 B1 1/2019 Harbert et al.
10,556,158 B1 2/2020 Harbert et al.
10,773,135 B1 * 9/2020 Hoffman ..... A63B 53/00
10,874,922 B2 * 12/2020 Harbert ..... A63B 60/46
10,881,918 B2 1/2021 Beach et al.
10,953,292 B2 3/2021 Beach et al.
11,117,027 B2 * 9/2021 Hoffman ..... A63B 60/02
2003/0148822 A1 * 8/2003 Knuth ..... A63B 53/0466 473/345
2005/0003903 A1 1/2005 Galloway
2005/0020382 A1 1/2005 Yamagishi et al.
2005/0192117 A1 * 9/2005 Knuth ..... A63B 60/00 473/342
2006/0178228 A1 * 8/2006 DiMarco ..... A63B 53/0466 473/334
2006/0258481 A1 11/2006 Oyama
2007/0219016 A1 9/2007 Deshmukh
2008/0132356 A1 6/2008 Chao et al.
2008/0171612 A1 7/2008 Serrano et al.
2010/0016095 A1 1/2010 Burnett et al.
2011/0294599 A1 * 12/2011 Albertsen ..... A63B 60/00 473/349
2012/0122601 A1 * 5/2012 Beach ..... A63B 53/0466 473/248
2012/0135821 A1 * 5/2012 Boyd ..... A63B 60/00 473/342
2012/0202615 A1 8/2012 Beach et al.
2012/0270675 A1 * 10/2012 Matsunaga ..... A63B 60/00 473/338
2013/0059678 A1 3/2013 Stites et al.
2013/0116062 A1 5/2013 Zimmerman et al.
2015/0038260 A1 * 2/2015 Hayashi ..... A63B 53/0466 473/342
2015/0094166 A1 * 4/2015 Taylor ..... A63B 53/0433 473/335
2015/0367189 A1 * 12/2015 Boggs ..... A63B 53/06 473/336
2016/0096082 A1 * 4/2016 Boggs ..... A63B 60/00 473/324
2016/0310809 A1 * 10/2016 Boggs ..... A63B 53/06
2017/0036078 A1 * 2/2017 Serrano ..... A63B 60/52
2017/0072277 A1 * 3/2017 Mata ..... A63B 53/06
2017/0128789 A1 * 5/2017 Wada ..... A63B 60/02
2018/0140916 A1 * 5/2018 Sillies ..... A63B 53/0466
2018/0169486 A1 6/2018 Wester et al.
2018/0345099 A1 * 12/2018 Harbert ..... A63B 53/04
2019/0076707 A1 3/2019 Beach et al.
2019/0201754 A1 * 7/2019 Hoffman ..... A63B 60/00
2020/0086188 A1 * 3/2020 Nakamura ..... A63B 53/0408
2020/0139208 A1 * 5/2020 Johnson ..... A63B 60/002
2020/0197769 A1 * 6/2020 Stokke ..... A63B 53/04
2020/0215397 A1 * 7/2020 Parsons ..... A63B 53/04
2020/0282271 A1 9/2020 Harbert et al.
2020/0324177 A1 10/2020 Harbert et al.
2021/0001186 A1 * 1/2021 Munson ..... A63B 60/52
2021/0077869 A1 3/2021 Beach et al.
2021/0086041 A1 * 3/2021 Sargent ..... A63B 53/06
2021/0170242 A1 6/2021 Beach et al.
2021/0170244 A1 6/2021 Willett et al.

* cited by examiner

GOLF CLUB HEADS

CROSS REFERENCE TO RELATED APPLICATION

This application claims the benefit of U.S. Provisional Application No. 62/755,319, filed Nov. 2, 2018, which is incorporated herein by reference in its entirety.

FIELD

The present application concerns golf club heads, and more particularly, golf club heads for wood-type clubs.

INCORPORATIONS BY REFERENCE

In addition to the incorporations discussed further herein, other patents and patent applications concerning golf clubs, such as U.S. Pat. Nos. 7,753,806; 7,887,434; 8,118,689; 8,663,029; 8,888,607; 8,900,069; 9,186,560; 9,211,447; 9,220,953; 9,220,956; 9,848,405; and 9,700,763 and U.S. patent application Ser. No. 15/859,071, are incorporated herein by reference in their entireties.

BACKGROUND

Much of the recent improvement activity in the field of golf has involved the use of new and increasingly more sophisticated materials in concert with advanced club-head engineering. For example, modern "wood-type" golf clubs (notably, "drivers," "fairway woods," and "utility or hybrid clubs"), with their sophisticated shafts and non-wooden club-heads, bear little resemblance to the "wood" drivers, low-loft long-irons, and higher numbered fairway woods used years ago. These modern wood-type clubs are generally called "metalwoods" since they tend to be made primarily of strong, lightweight metals, such as titanium.

An example metalwood golf club such as a driver or fairway wood typically includes a hollow shaft having a lower end to which the golf club head is attached. Most modern versions of these golf club heads are made, at least in part, of a lightweight but strong metal such as titanium alloy. In many cases, the golf club head comprises a body made primarily of such strong metals.

Some current approaches to reducing structural mass of a metalwood club-head are directed to making one or more portions of the golf club head of an alternative material. Whereas the bodies and face plates of most current metalwoods are made of titanium alloys, some golf club heads are made, at least in part, of components formed from either graphite/epoxy-composite (or other suitable composite material) and a metal alloy. Graphite composites have a much lower density compared to titanium alloys, which offers an opportunity to provide more discretionary mass in the club-head.

The ability to utilize such materials to increase the discretionary mass available for placement at various points in the club-head allows for optimization of a number of physical properties of the club-head which can greatly impact the performance obtained by the user. Forgiveness on a golf shot is generally maximized by configuring the golf club head such that the center of gravity ("CG") of the golf club head is optimally located and the moment of inertia ("MOI") of the golf club head is maximized. CG and MOI can also critically affect a golf club head's performance, such as launch angle and flight trajectory on impact with a golf ball, among other characteristics.

In addition to the use of various materials to optimize the strength-to-weight properties and acoustic properties of the golf club heads, advances have been made in the mass distribution properties provided by using thicker and thinner regions of materials, raising and lowering certain portions of the sole and crown, providing adjustable weight members and adjustable head-shaft connection assemblies, and many other golf club head engineering advances.

SUMMARY

This application discloses, among other innovations, wood-type golf club heads that provide, among other attributes, improved forgiveness, ball speed, adjustability and playability, while maintaining durability.

The following describes wood-type golf club heads that include a body having a bottom portion, a top portion, a front portion, a rear portion, a heel portion, and a toe portion, a sole located on the bottom portion of the golf club head, a crown located at the top portion of the golf club head; and a striking surface positioned at the front portion of the body and configured to receive an impact, the striking surface having a striking surface area measured in square millimeters ($mm^2$). In certain embodiments, the body has a volume of at least 390 cubic centimeters (cc). In particular embodiments, the body has a volume of at least 420 cubic centimeters (cc).

Certain of the golf club heads may have a head origin defined as a position on the face plane at a geometric center of the face, the head origin including an x-axis tangential to the face and generally parallel to the ground when the head is in an address position where a positive x-axis extends towards the heel portion, a y-axis extending perpendicular to the x-axis and generally parallel to the ground when the head is in the address position where a positive y-axis extends from the face and through the rearward portion of the body, and a z-axis extending perpendicular to the ground, to the x-axis and to the y-axis when the head is in the address position where a positive z-axis extends from the head origin and generally upward, wherein the golf club head has a center of gravity.

In certain instances the golf club head may comprise a center sole portion extending from a position proximate the golf club head center of gravity to the rear portion of the body, the center sole portion comprising: a planar surface extending rearwardly and toewardly along the bottom portion of the sole in a generally Y-direction; a toeward sole surface that slopes upwardly from the planar surface when viewed in the address position; a first edge extending in a generally Y-direction on a toe side of the planar surface and defining a transition between the planar surface and the toeward sole surface; a heelward sole surface that slopes upwardly from the planar surface when viewed in the address position; and a second edge extending in a generally Y-direction on a heel side of the planar surface and defining a transition between the planar surface and the heelward sole surface. In particular instances, a surface area to volume ratio calculated by converting the striking surface area into square centimeters ($cm^2$) and dividing by the volume of the golf club head body is no less than 0.06 and no greater than 0.086.

In some instances, the golf club head may comprise a center sole portion extending from a position proximate the golf club head center of gravity to the rear portion of the body, the center sole portion comprising: a planar surface extending rearwardly and toewardly along the bottom portion of the sole in a generally Y-direction; a toeward sole surface that slopes upwardly from the planar surface when viewed in the address position; a first edge extending in a generally Y-direction on a toe side of the planar surface and defining a transition between the planar surface and the toeward sole surface; a heelward sole surface that slopes upwardly from the planar surface when viewed in the address position; and a second edge extending in a generally Y-direction on a heel side of the planar surface and defining a transition between the planar surface and the heelward sole surface; a weight channel formed in the sole and defining a path along the sole; and a weight assembly positioned in the weight channel, the weight assembly configured to be adjusted along the path to any of a range of selectable positions in the weight channel to adjust mass properties of the golf club head. In particular instances, a surface area to volume ratio calculated by converting the striking surface area into square centimeters ($cm^2$) and dividing by the volume of the golf club head body is no less than 0.06 and no greater than 0.086.

In still other instances, the golf club head may comprise a center sole portion extending from a position proximate the golf club head center of gravity to the rear portion of the body, the center sole portion comprising: a planar surface extending rearwardly and toewardly along the bottom portion of the sole in a generally Y-direction; a toeward sole surface that slopes upwardly from the planar surface when viewed in the address position; a first edge extending in a generally Y-direction on a toe side of the planar surface and defining a transition between the planar surface and the toeward sole surface; a heelward sole surface that slopes upwardly from the planar surface when viewed in the address position; and a second edge extending in a generally Y-direction on a heel side of the planar surface and defining a transition between the planar surface and the heelward sole surface. In particular instances, a surface area to volume ratio calculated by converting the striking surface area into square centimeters ($cm^2$) and dividing by the volume of the golf club head body is no less than 0.075 and no greater than 0.084. In certain instances the golf club head has: a volume below 30 mm above ground plane that is at least 45 percent of the body volume, a rear volume that is at least 33 percent of the body volume, a toe volume that is at least 60 percent of the body volume, and a Zup that is no more than 26 mm.

The foregoing and other objects, features, and advantages of the invention will become more apparent from the following detailed description, which proceeds with reference to the accompanying figures.

DETAILED DESCRIPTION

Figure 1:
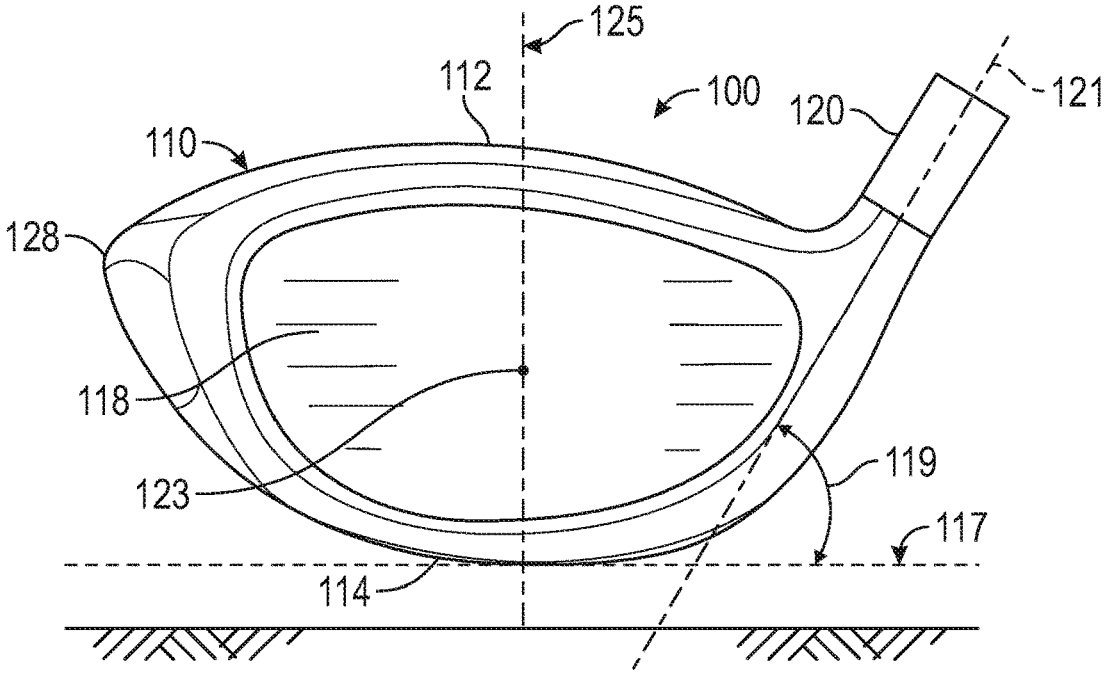
FIG. 1 is a front elevation view of an example embodiment of a golf club head.

I. General Considerations for Golf Club Heads

The following disclosure describes embodiments of golf club heads for wood-type clubs (e.g., drivers) that incorporate higher loft angles, lower centers of gravity, or both higher loft angles and lower centers of gravity relative to conventional wood-type clubs. The disclosed embodiments should not be construed as limiting in any way. Instead, the present disclosure is directed toward all novel and nonobvious features and aspects of the various disclosed embodiments, alone and in various combinations and subcombinations with one another. Furthermore, any features or aspects of the disclosed embodiments can be used in various combinations and subcombinations with one another. As used herein, the phrase "and/or" means "and," "or" and both "and" and "or." As used herein, the singular forms "a," "an" and "the" refer to one or more than one, unless the context clearly dictates otherwise. As used herein, the terms "including" and "having" (and their grammatical variants) mean "comprising." The disclosed embodiments are not limited to any specific aspect or feature or combination thereof, nor do the disclosed embodiments require that any one or more specific advantages be present or problems be solved.

Several of the golf club heads incorporate features that provide the golf club heads and/or golf clubs with increased moments of inertia and low centers of gravity, centers of gravity located in preferable locations, improved golf club head and face geometries, increased sole and lower face flexibility, higher coefficients or restitution ("COW") and characteristic times ("CT"), and/or decreased backspin rates relative to driver and other golf club heads that have come before.

The present disclosure makes reference to the accompanying drawings which form a part hereof. The drawings illustrate specific embodiments, but other embodiments may be formed and structural changes may be made without departing from the intended scope of this disclosure. Directions and references may be used to facilitate discussion of the drawings but are not intended to be limiting. For example, certain terms may be used such as "up," "down," "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations, unless otherwise indicated. For example, with respect to an object, an "upper" surface can become a "lower" surface simply by turning the object over. Nevertheless, it is still the same object. Accordingly, the following detailed description shall not be construed in a limiting sense and the scope of property rights sought shall be defined by the appended claims and their equivalents.

Additionally, this disclosure may use terms such as "raised," "lowered," "recessed," "dropped," etc., which are relative terms depending on perspective. For example, a ground contact surface on the sole of a golf club head could be considered "raised" relative to an indented portion of the sole of the golf club head when the head is upside down with the sole facing upward. On the other hand, the same ground contact surface could also be considered a "dropped sole" part of the sole, since it is located closer to the ground relative to the indented portion when the golf club head is in a normal address position (as further described herein) with the sole facing the ground.

Accordingly, the following detailed description shall not to be construed in a limiting sense.

Golf club head "forgiveness" generally describes the ability of a golf club head to deliver a desirable golf ball trajectory despite a miss-hit (e.g., a ball struck at a location on the face plate other than an ideal impact location, e.g., an impact location where coefficient of restitution is maximized). Large mass moments of inertia contribute to the overall forgiveness of a golf club head. In addition, a low center-of-gravity improves forgiveness for golf club heads used to strike a ball from the turf by giving a higher launch angle and a lower spin trajectory (which improves the distance of a fairway wood golf shot). Providing a rearward center-of-gravity reduces the likelihood of a slice or fade for many golfers. Accordingly, forgiveness of fairway wood golf club heads, can be improved using the techniques described above to achieve high moments of inertia and low center-of-gravity compared to conventional fairway wood golf club heads.

For example, a golf club head with a crown thickness less than about 0.65 mm throughout at least about 70% of the crown can provide significant discretionary mass. A 0.60 mm thick crown formed from steel can provide as much as about 8 grams of discretionary mass compared to a 0.80 mm thick crown. Alternatively, a 0.80 mm thick crown formed from a composite material having a density of about 1.5 g/cc can provide as much as about 26 grams of discretionary mass compared to a 0.80 mm thick crown formed from steel. The large discretionary mass can be distributed to improve the mass moments of inertia and desirably locate the golf club head center-of-gravity. Generally, discretionary mass should be located sole-ward rather than crown-ward to maintain a low center-of-gravity, forward rather than rearward to maintain a forwardly positioned center of gravity, and rearward rather than forward to maintain a rearwardly positioned center-of-gravity. In addition, discretionary mass should be located far from the center-of-gravity and near the perimeter of the golf club head to maintain high mass moments of inertia.

Another parameter that contributes to the forgiveness and successful playability and desirable performance of a golf club is the coefficient of restitution (COR) of the golf club head. Upon impact with a golf ball, the golf club head's face plate deflects and rebounds, thereby imparting energy to the struck golf ball. The golf club head's coefficient of restitution is the ratio of the velocity of separation to the velocity of approach. A thin face plate generally will deflect more than a thick face plate. Thus, a properly constructed club with a thin, flexible face plate can impart a higher initial velocity to a golf ball, which is generally desirable, than a club with a thick, rigid face plate. In order to maximize the moment of inertia (MOI) about the center of gravity (CG) and achieve a high COR, it typically is desirable to incorporate thin walls and a thin face plate into the design of the golf club head. Thin walls afford the designers additional leeway in distributing golf club head mass to achieve desired mass distribution, and a thinner face plate may provide for a relatively higher COR.

Thus, thin walls are important to a club's performance. However, overly thin walls can adversely affect the golf club head's durability. Problems also arise from stresses distributed across the golf club head upon impact with the golf ball, particularly at junctions of golf club head components, such as the junction of the face plate with other golf club head components (e.g., the sole, skirt, and crown). One prior solution has been to provide a reinforced periphery about the face plate, such as by welding, in order to withstand the repeated impacts. Another approach to combat stresses at impact is to use one or more ribs extending substantially from the crown to the sole vertically, and in some instances extending from the toe to the heel horizontally, across an inner surface of the face plate. These approaches tend to adversely affect club performance characteristics, e.g., diminishing the size of the sweet spot, and/or inhibiting design flexibility in both mass distribution and the face structure of the golf club head. Thus, these golf club heads fail to provide optimal MOI, CG, and/or COR parameters, and as a result, fail to provide much forgiveness for off-center hits for all but the most expert golfers.

Thus, the golf club heads of this disclosure are designed to allow for introduction of a face which can be adjusted in thickness as needed or desired to interact with the other disclosed aspects, such as a channel or slot positioned behind the face, as well as increased areas of mass and/or removable weights. The golf club heads of this disclosure may utilize, for example, the variable thickness face features described in U.S. Pat. Nos. 8,353,786, 6,997,820, 6,800,038, and 6,824,475, which are incorporated herein by reference in their entirety. Additionally, the mass of the face, as well as other of the above-described properties can be adjusted by using different face materials, structures, and features, such as those described in U.S. Pat. Nos. RE42,544; 8,096,897; 7,985,146; 7,874,936; 7,874,937; 8,628,434; and 7,267,620; and U.S. Patent Pub. Nos. 2008/0149267 and 2009/0163289, which are herein incorporated by reference in their entirety. Additionally, the structure of the front channel, club head face, and surrounding features of any of the embodiments herein can be varied to further impact COR and related aspects of the golf club head performance, as further described in U.S. Pat. No. 9,662,545 and U.S. Patent Pub. No. 2016/0023062, which are incorporated by reference herein in their entirety.

A. Club Head Normal Address Position

Club heads and many of their physical characteristics disclosed herein will be described using "normal address position" as the club head reference position, unless otherwise indicated. As used herein, "normal address position" means the club head position wherein a centerface target line vector normal to the club face (or "ball striking surface" or "striking surface") 118 substantially lies in a first vertical plane 125 (a vertical plane is perpendicular to the ground plane 117), a centerline axis 121 of the club shaft (or "club shaft axis"), substantially lies in a second substantially vertical plane 131 ("shaft plane"), and the first vertical plane and the second substantially vertical plane substantially perpendicularly intersect. The centerface target line vector is defined as a horizontal vector that points forward (along the y-axis) from the center 123. For purposes of this disclosure, the center 123 is also be referred to as the "geometric center" of the ball striking surface 118. See also U.S.G.A. "Procedure for Measuring the Flexibility of a Golf Clubhead," Revision 2.0 for the methodology to measure the geometric center of the striking face. At normal address position, the club shaft axis 121 defines a lie angle relative to the ground plane such that the scorelines on the face of the club are horizontal. If the club does not have scorelines, then the normal address position lie angle is typically 60-degrees.

Figure 2:
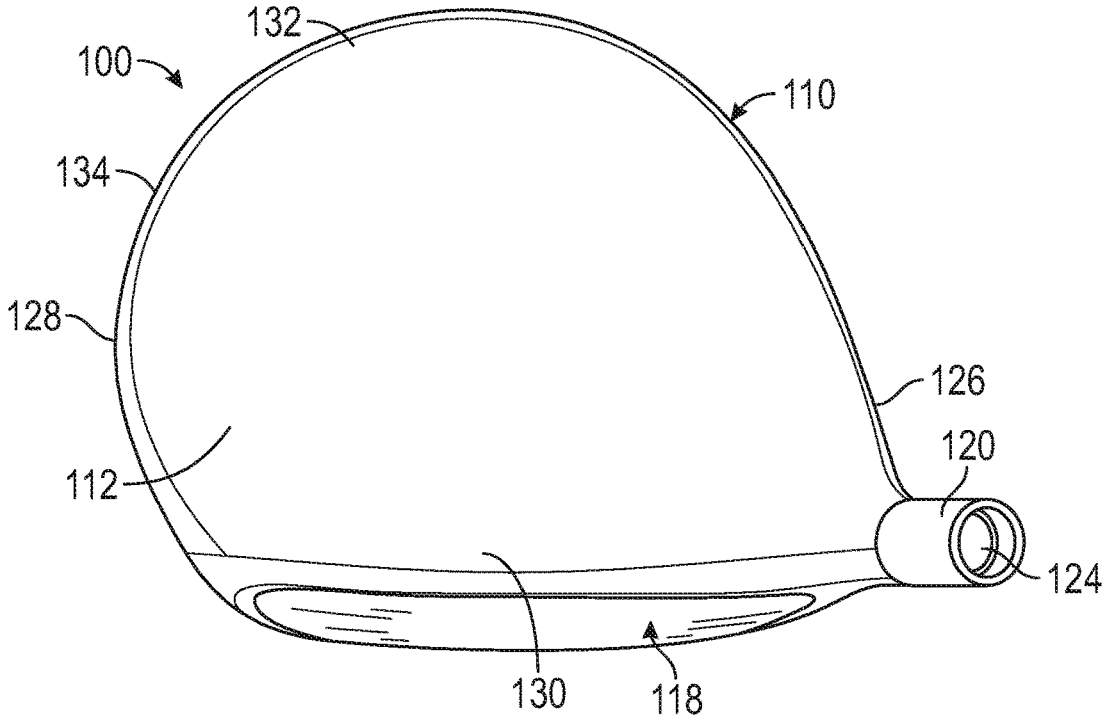
FIG. 2 is a top plan view of the golf club head of FIG. 1.
Figure 3:
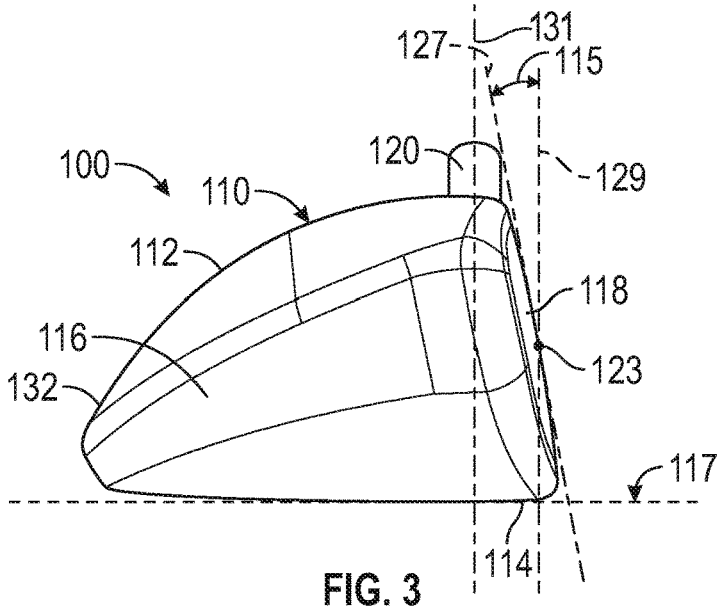
FIG. 3 is a side elevation view from a toe side of the golf club head of FIG. 1.

FIGS. 1-3 illustrate one embodiment of a driving-wood-type golf club head at normal address position, though it is understood that similar measurements may be made for other wood-type golf clubs, such as fairway woods, utility clubs (also known as hybrid clubs), rescue clubs, and the like. FIG. 1 illustrates a front elevation view of golf club head 100, FIG. 2 illustrates a top plan view of the golf club head 100, and FIG. 3 illustrates a side elevation view of the golf club head 100 from the toe side. By way of preliminary description, the club head 100 includes a hosel 120 and a striking surface 118. At normal address position, the club head 100 is positioned on a ground plane 117, a plane parallel to the ground that may be at or above the level of the ground.

B. Club Head Features

A driving-wood-type golf club head, such as the golf club head 100 shown in FIGS. 1-3, includes a hollow body 110 defining a crown portion 112, a sole portion 114, a skirt portion 116, and a ball striking surface 118. The ball striking surface 118 can be integrally formed with the body 110 or attached to the body. The body 110 further includes a hosel 120, which defines a hosel bore 124 adapted to receive a golf club shaft. The body 110 further includes a heel portion 126, a toe portion 128, a front portion 130, and a rear portion 132.

A wood-type golf club head, such as golf club head 100 and the other wood-type club heads disclosed herein have a volume, typically measured in cubic-centimeters (cc) equal to the volumetric displacement of the club head, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports or other indentations or cavities within the head, it is assumed that these are either not present or are "covered" by regular, imaginary surfaces, such that the club head volume is not affected by the presence or absence of such ports, indentations or cavities.

In some embodiments, as in the case of a driver (as in the illustrated embodiments), any of the disclosed golf club heads can have a volume between about 300 $cm^3$ and about 600 $cm^3$, between about 350 $cm^3$ and about 600 $cm^3$, and/or between about 350 $cm^3$ and about 500 $cm^3$, and can have a total mass between about 145 g and about 260 g, such as between about 195 g and about 205 g. In the case of a fairway wood (which may be analogous to the illustrated embodiments), the golf club head may have a volume between about 100 $cm^3$ and about 300 $cm^3$, such as between about 150 $cm^3$ and about 250 $cm^3$, or between about 130 $cm^3$ and about 190 $cm^3$, or between about 125 $cm^3$ and about 240 $cm^3$, and a total mass between about 125 g and about 260 g, or between about 200 g and about 250 g. In the case of a utility or hybrid club (which may also be analogous to the illustrated embodiments), the golf club head may have a volume between about 60 $cm^3$ and about 150 $cm^3$, or between about 85 $cm^3$ and about 120 $cm^3$, and a total mass between about 125 g and about 280 g, or between about 200 g and about 250 g.

As used herein, "crown" means an upper portion of the club head above a peripheral outline 134 of the club head as viewed from a top-down direction and rearward of the topmost portion of the ball striking surface 118. As used herein, "sole" means a lower portion of the club head 100 extending upwards from a lowest point of the club head when the club head is at the normal address position. In some implementations, the sole 114 extends approximately 50% to 60% of the distance from the lowest point of the club head to the crown 112. In other implementations, the sole 114 extends upwardly from the lowest point of the golf club head 110 a shorter distance. Further, the sole 114 can define a substantially flat portion extending substantially horizontally relative to the ground plane 117 when in normal address position or can have an arced or convex shape as shown in FIG. 1. As used herein, "skirt" means a side portion of the club head 100 between the crown 112 and the sole 114 that extends across a periphery 134 of the club head, excluding the striking surface 118, from the toe portion 128, around the rear portion 132, to the heel portion 126. As used herein, "striking surface" means a front or external surface of the golf club head configured to impact a golf ball. In some embodiments, the striking surface 118 can be a striking plate attached to the body 110 using known attachment techniques, such as welding. Further, the striking surface 118 can have a variable thickness. In certain embodiments, the striking surface 118 has a bulge and roll curvature (discussed more fully below).

The body 110, or any parts thereof, can be made from a metal alloy (e.g., an alloy of titanium, an alloy of steel, an alloy of aluminum, and/or an alloy of magnesium), a composite material (e.g., a graphite or carbon fiber composite) a ceramic material, or any combination thereof. The crown 112, sole 114, skirt 116, and ball striking club face 118 can be integrally formed using techniques such as molding, cold forming, casting, and/or forging. Alternatively, any one or more of the crown 112, sole 114, skirt 116, or ball striking club face 118 can be attached to the other components by known means (e.g., adhesive bonding, welding, and the like).

In some embodiments, the striking face 118 is made of a composite material, while in other embodiments, the striking face 118 is made from a metal alloy (e.g., an alloy of titanium, steel, aluminum, and/or magnesium), ceramic material, or a combination of composite, metal alloy, and/or ceramic materials.

When at normal address position, the club head 100 is disposed at a lie angle 119 relative to the club shaft axis (as shown in FIG. 1), and the club face has a loft angle 115 (as shown in FIG. 2). Referring to FIG. 1, the lie angle 119 refers to the angle between the club shaft axis 121 and the ground plane 117 at normal address position. Referring to FIG. 3, loft angle 115 refers to the angle between a tangent line 127 to the club face 118 and a vector 129 normal to the ground plane at normal address position.

C. Golf Club Head Coordinates And Measurements

Figure 4:
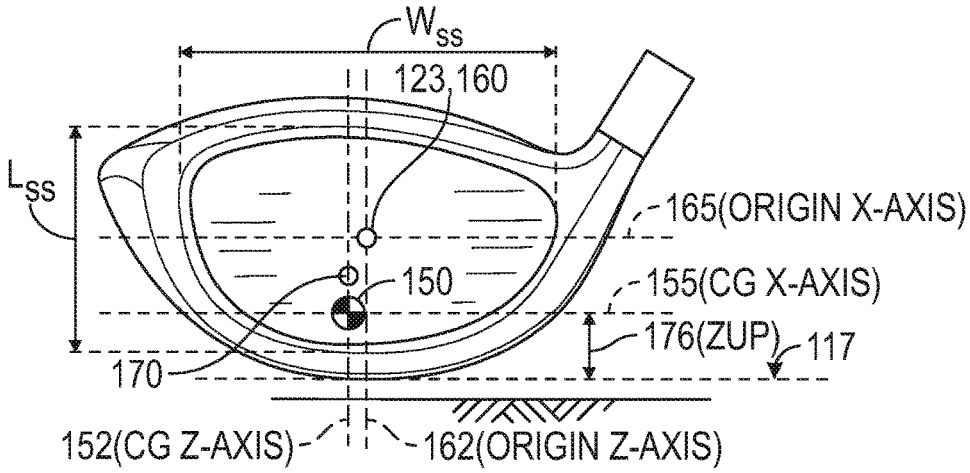
FIG. 4 is a front elevation view of the golf club of FIG. 1 illustrating club head origin and center of gravity origin coordinate systems.
Figure 5:
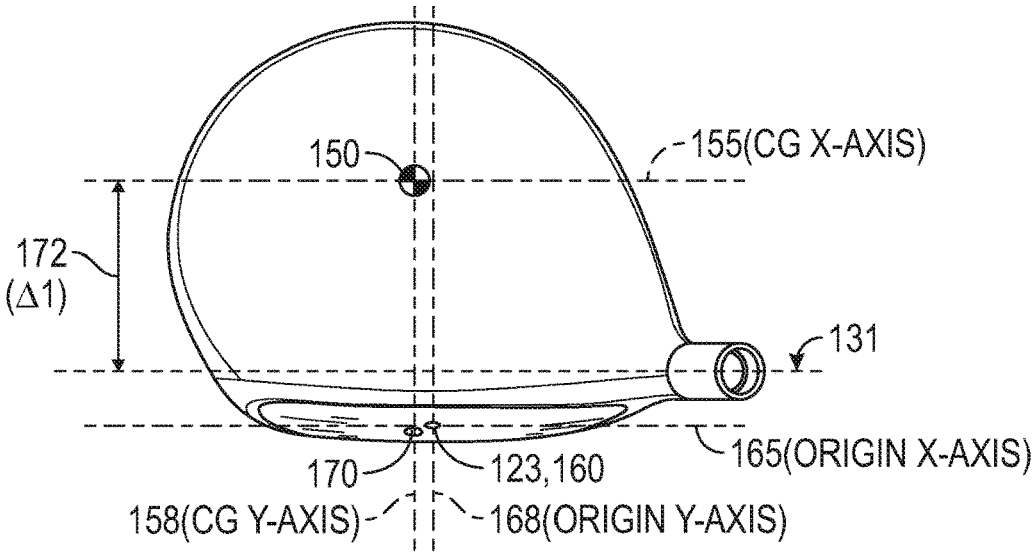
FIG. 5 is a top plan view of the golf club of FIG. 1 illustrating the club head origin and center of gravity origin coordinate systems.
Figure 6:
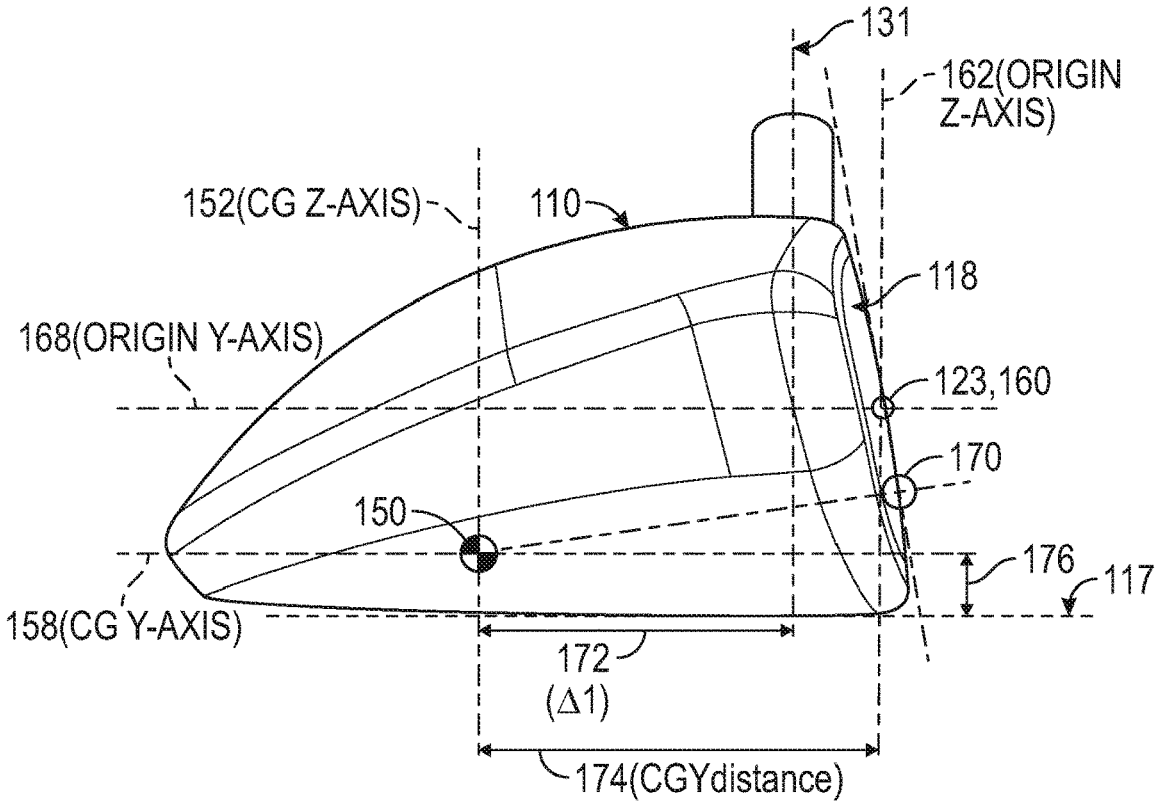
FIG. 6 is a side elevation view from a toe side of the golf club of FIG. 1 illustrating the club head origin and center of gravity origin coordinate systems.

FIGS. 4-6 illustrate coordinate systems that can be used in describing features of the disclosed golf club head embodiments. While these coordinate systems are illustrated with respect to the example golf club head 100, it is understood that similar coordinates and measurements may be defined with respect to each of the golf club heads disclosed herein.

FIG. 4 illustrates a front elevation view of the golf club head 100, FIG. 5 illustrates a top plan view of the golf club head 100, and FIG. 6 illustrates a side elevation view of the golf club head 100 from the toe side. As shown in FIGS. 4-6, a center 123 is disposed on the striking surface 118. For purposes of this disclosure, the center 123 is defined as the intersection of the midpoints of a length ($L_{ss}$) and a width ($W_{ss}$) of the striking surface 118. Both $L_{ss}$ and $W_{ss}$ are determined using the striking face curve ($S_{ss}$). The striking face curve is bounded on its periphery by all points where the face transitions from a substantially uniform bulge radius (face heel-to-toe radius of curvature) and a substantially uniform roll radius (face crown-to-sole radius of curvature) to the body. $L_{ss}$ is the distance from the periphery proximate to the sole portion of $S_{ss}$ (also referred to as the bottom radius of the club face) to the periphery proximate to the crown portion of $S_{ss}$ (also referred to as the top radius of the club face) measured in a vertical plane (perpendicular to ground) that extends through the center 123 of the face (e.g., this plane is substantially normal to the x-axis). Similarly, $W_{ss}$ is the distance from the periphery proximate to the heel portion of $S_{ss}$ to the periphery proximate to the toe portion of $S_{ss}$ measured in a horizontal plane (e.g., substantially parallel to ground) that extends through the center 123 of the face (e.g., this plane is substantially normal to the z-axis). In other words, the center 123 along the z-axis corresponds to a point that bisects into two equal parts a line drawn from a point just on the inside of the top radius of the striking surface (and centered along the x-axis of the striking surface) to a point just on the inside of the bottom radius of the face plate (and centered along the x-axis of the striking surface). Additionally, the portion of the striking surface 118 bounded by the striking face curve periphery defines a striking surface area, which may be measured to determine playability characteristics of the golf club head. This area bounded by the striking face curve periphery may also be referred to as the "striking surface area" or "face area."

Referring to FIGS. 4-6, a club head origin coordinate system can be defined such that the location of various features of a given club head (including a club head center-of-gravity (CG) 150) can be determined. A club head origin 160 is illustrated on the club head 100 positioned at the center 123 of the striking surface 118.

The head origin coordinate system defined with respect to the head origin 160 includes three axes: a z-axis 162 extending through the head origin 160 in a generally vertical direction relative to the ground plane 117 when the club head 100 is at the normal address position; an x-axis 165 extending through the head origin 160 in a toe-to-heel direction generally parallel to the striking surface 118 (e.g., generally tangential to the striking surface 118 at the center 123) and generally perpendicular to the z-axis 162; and a y-axis 168 extending through the head origin 160 in a front-to-back direction and generally perpendicular to the x-axis 165 and to the z-axis 162. The x-axis 165 and the y-axis 168 both extend in generally horizontal directions relative to the ground plane 117 when the club head 100 is at the normal address position. The x-axis 165 extends in a positive direction from the origin 160 towards the heel 126 of the club head 100. The y-axis 168 extends in a positive direction from the head origin 160 towards the rear portion 132 of the club head 100. The z-axis 162 extends in a positive direction from the origin 160 towards the crown 112.

D. Club Head Center of Gravity (CG)

Generally, the center of gravity (CG) of a golf club head is the average location of the weight of the golf club head or the point at which the entire weight of the golf club head may be considered as concentrated so that if supported at this point the head would remain in equilibrium in any position.

Referring to FIGS. 4-6, a CG 150 is shown as a point inside the body 110 of the club head 100. The location of the club head CG 150 can also be defined with reference to the club head origin coordinate system described above. For example, and using millimeters as the unit of measure, a CG 150 that is located 3.2 mm from the head origin 160 toward the toe of the club head along the x-axis, 36.7 mm from the head origin 160 toward the rear of the club head along the y-axis, and 4.1 mm from the head origin 160 toward the sole of the club head along the z-axis can be defined as having a $CG_x$ of −3.2 mm, a $CG_y$ of −36.7 mm, and a $CG_z$ of −4.1 mm. The distance of the CG 150 from the ground plane 117 as measured in the direction of the z-axis 162 is seen and labeled as 176 in FIGS. 4 and 6. This distance, which may also be referred to as $\Delta_{z\ or}$ "Zup", may be represented as the distance between the CG X-axis 155 or the CG y-axis 158 extending out from the CG 150 parallel to the ground plane 117.

Similarly, as illustrated in FIG. 5, the distance 172 from the shaft plane 131 to the CG 150 as measured in the direction of the y-axis 168 may be referred to as $\Delta_1$ (or "Delta 1"). A measurement 174 of the location of the CG from the center 123 along the y-axis 168—termed $CG_y$ distance, and illustrated in FIG. 6—is a sum of $\Delta_1$ and the distance between the origin z-axis 162 and the shaft plane 131. Knowing the $CG_y$ distance allows the use of a CG effectiveness product to describe the location of the CG in relation to the golf club head space. The CG effectiveness product is a measure of the effectiveness of locating the CG low and forward in the golf club head. The CG effectiveness product ($CG_{eff}$) is calculated with the following formula and can be measured in units of the square of distance, mm in the current embodiment ($mm^2$):

$$CG_{eff}=CG_y\times\Delta_z$$

With this formula, the smaller the $CG_{eff}$, the more effective the club head is at relocating mass low and forward. This measurement adequately describes the location of the CG within the golf club head without projecting the CG onto the face. As such, it allows for the comparison of golf club heads that may have different lofts, different face heights, and different locations of the CF.

The CG can also be used to define a coordinate system with the CG as the origin of the coordinate system. For example, and as illustrated in FIGS. 4-6, the CG origin coordinate system defined with respect to the CG origin 150 includes three axes: a CG z-axis 152 extending through the CG 150 in a generally vertical direction relative to the ground plane 117 when the club head 100 is at normal address position; a CG x-axis 155 extending through the CG origin 150 in a toe-to-heel direction generally parallel to the striking surface 118 (e.g., generally tangential to the striking surface 118 at the club face center 123), and generally perpendicular to the CG z-axis 152; and a CG y-axis 158 extending through the CG origin 150 in a front-to-back direction and generally perpendicular to the CG x-axis 155 and to the CG z-axis 152. The CG x-axis 155 and the CG y-axis 158 both extend in generally horizontal directions relative to the ground plane 117 when the club head 100 is at normal address position. The CG x-axis 155 extends in a positive direction from the CG origin 150 to the heel 126 of the club head 100. The CG y-axis 158 extends in a positive direction from the CG origin 150 towards the rear portion 132 of the golf club head 100. The CG z-axis 152 extends in a positive direction from the CG origin 150 towards the crown 112. Thus, the axes of the CG origin coordinate system are parallel to corresponding axes of the head origin coordinate system. In particular, the CG z-axis 152 is parallel to z-axis 162, CG x-axis 155 is parallel to x-axis 165, and CG y-axis 158 is parallel to y-axis 168.

As best shown in FIG. 6, FIGS. 4-6 also show a projected CG point 170 on the golf club head striking surface 118. The projected CG point 170 is the point on the striking surface 118 that intersects with a line that is normal to the tangent line 127 of the ball striking club face 118 and that passes through the CG 150. This projected CG point 170 can also be referred to as the "zero-torque" point because it indicates the point on the ball striking club face 118 that is centered with the CG 150. Thus, if a golf ball makes contact with the club face 118 at the projected CG point 170, the golf club head will not twist about any axis of rotation since no torque is produced by the impact of the golf ball.

Further as used herein, Delta 1 is a measure of how far rearward in the golf club head body the CG is located. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the golf club head face. Thus, for embodiments of the disclosed golf club heads in which the projected CG on the ball striking club face is lower than the geometric center, reducing Delta 1 can lower the projected CG and increase the distance between the geometric center and the projected CG. Note also that a lower projected CG can promote a higher launch and a reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

Similarly, Delta 2 is the distance between the CG and the hosel axis along the x axis (in the direction straight toward the back of the body of the golf club face from the geometric center of the striking face).

Adjusting the location of the discretionary mass in a golf club head as described herein can provide the desired Delta 1 value. For instance, Delta 1 can be manipulated by varying the mass in front of the CG (closer to the face) with respect to the mass behind the CG. That is, by increasing the mass behind the CG with respect to the mass in front of the CG, Delta 1 can be increased. In a similar manner, by increasing the mass in front of the CG with the respect to the mass behind the CG, Delta 1 can be decreased.

E. Club Head Moment of Inertia (MOI)

In terms of the MOI of the club-head (i.e., a resistance to twisting) it is typically measured about each of the three main axes of a club-head with the CG as the origin of the coordinate system. These three axes include a CG z-axis extending through the CG in a generally vertical direction relative to the ground when the golf club head is at normal address position; a CG x-axis extending through the CG origin in a toe-to-heel direction generally parallel to the striking surface (e.g., generally tangential to the striking surface at the club face center), and generally perpendicular to the CG z-axis; and a CG y-axis extending through the CG origin in a front-to-back direction and generally perpendicular to the CG x-axis and to the CG z-axis. The CG x-axis and the CG y-axis both extend in generally horizontal directions relative to the ground when the golf club head is at normal address position. The CG x-axis extends in a positive direction from the CG origin to the heel of the golf club head. The CG y-axis extends in a positive direction from the CG origin towards the rear portion of the golf club head. The CG z-axis extends in a positive direction from the CG origin towards the crown. Thus, the axes of the CG origin coordinate system are parallel to corresponding axes of the head origin coordinate system. In particular, the CG z-axis is parallel to the z-axis, the CG x-axis is parallel to the x-axis, and CG y-axis is parallel to the y-axis.

Specifically, a golf club head has a moment of inertia about the vertical CG z-axis ("Izz"), a moment of inertia about the heel/toe CG x-axis ("Ixx"), and a moment of inertia about the front/back CG y-axis ("Iyy"). Typically, however, the MOI about the CG z-axis (Izz) and the CG x-axis (Ixx) is most relevant to golf club head forgiveness.

A moment of inertia about the golf club head CG x-axis (Ixx) is calculated by the following Equation 1:

$$Ixx=\int(y^2+z^2)dm \quad (1)$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CGx-axis and the golf club head CG y-axis.

Similarly, a moment of inertia about the golf club head CG z-axis (Izz) is calculated by the following Equation 2:

$$Izz=\int(x^2+y^2)dm \quad (2)$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis.

A further description of the coordinate systems for determining CG positions and MOI can be found in U.S. Pat. No. 9,358,430, the entire contents of which are incorporated by reference herein.

F. Club Head Discretionary Mass

As described herein, desired golf club head mass moments of inertia, golf club head center-of-gravity locations, and other mass properties of a golf club head can be attained by distributing golf club head mass to particular locations. Discretionary mass generally refers to the mass of material that can be removed from various structures providing mass that can be distributed elsewhere for tuning one or more mass moments of inertia and/or locating the golf club head center-of-gravity.

Golf club head walls provide one source of discretionary mass. In other words, a reduction in wall thickness reduces the wall mass and provides mass that can be distributed elsewhere. Thin walls, particularly a thin crown, provide significant discretionary mass compared to conventional golf club heads. For example, a golf club head made from an alloy of steel can achieve about 4 grams of discretionary mass for each 0.1 mm reduction in average crown thickness. Similarly, a golf club head made from an alloy of titanium can achieve about 2.5 grams of discretionary mass for each 0.1 mm reduction in average crown thickness. Discretionary mass achieved using a thin crown, e.g., less than about 0.65 mm, can be used to tune one or more mass moments of inertia and/or center-of-gravity location.

To achieve a thin wall on a golf club head body, such as a thin crown, a golf club head body can be formed from an alloy of steel or an alloy of titanium.

Some examples of titanium alloys that can be used to form any of the striking faces and/or club heads described herein can comprise titanium, aluminum, molybdenum, chromium, vanadium, and/or iron. For example, in one representative embodiment the alloy may be an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" titanium alloy).

In another representative embodiment, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti.

In another representative embodiment, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti.

In another representative embodiment, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti.

In another representative embodiment, the alloy may comprise 8% Al by weight, 2.5% Mo by weight, 2% Cr by weight, 1% V by weight, and/or 0.5% Fe by weight, with the balance comprising Ti. Such titanium alloys can have the formula Ti-8Al-2.5Mo-2Cr-1V-0.5Fe. As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular embodiments, the Ti-8Al-2.5Mo-2Cr-1V-0.5Fe alloy can have a tensile strength of about 1320 MPa, a yield strength of about 1284 MPa, and an elongation of about 10%.

In some embodiments, striking faces and/or club head bodies can be cast from Ti-8Al-2.5Mo-2Cr-1V-0.5Fe. In some embodiments, striking surfaces and club head bodies can be integrally formed or cast together from Ti-8Al-2.5Mo-2Cr-1V-0.5Fe, depending upon the particular characteristics desired.

The mechanical parameters of Ti-8Al-2.5Mo-2Cr-1V-0.5Fe given above can provide surprisingly superior performance compared to other existing titanium alloys. For example, due to the relatively high tensile strength of Ti-8Al-2.5Mo-2Cr-1V-0.5Fe, cast striking faces comprising this alloy can exhibit less deflection per unit thickness compared to other alloys when striking a golf ball. This can be especially beneficial for metalwood-type clubs configured for striking a ball at high speed, as the higher tensile strength of Ti-8Al-2.5Mo-2Cr-1V-0.5Fe results in less deflection of the striking face, and reduces the tendency of the striking face to flatten with repeated use. This allows the striking face to retain its original bulge, roll, and "twist" dimensions over prolonged use, including by advanced and/or professional golfers who tend to strike the ball at particularly high club velocities.

For further details concerning titanium casting, please refer to U.S. Pat. No. 7,513,296, incorporated herein by reference.

Additionally, the thickness of a club hosel may be varied to provide for additional discretionary mass, as described in U.S. Pat. No. 9,731,176, the entire contents of which are hereby incorporated by reference.

Various approaches can be used for positioning discretionary mass within a golf club head. For example, golf club heads may have one or more integral mass pads cast into the head at predetermined locations that can be used to lower, to move forward, to move rearward, or otherwise to adjust the location of the golf club head's center-of-gravity, as further described herein. Also, epoxy can be added to the interior of the golf club head, such as through an epoxy port 115 (illustrated in FIGS. 1 and 8) in the golf club head to obtain a desired weight distribution. Alternatively, weights formed of high-density materials can be attached to the sole or other parts of a golf club head, as further described, for example, in co-pending U.S. patent application Ser. No. 15/859,071, the entire contents of which are hereby incorporated by reference. With such methods of distributing the discretionary mass, installation is critical because the golf club head endures significant loads during impact with a golf ball that can dislodge the weight. Accordingly, such weights are usually permanently attached to the golf club head and are limited to a fixed total mass, which of course, permanently fixes the golf club head's center-of-gravity and moments of inertia.

Alternatively, weights can be attached in a manner which allows adjustment of certain mass properties of the golf club head. For example, FIGS. 12A-16, 24-26, and 28-35 illustrate adding removable weights to the golf club head at selected locations, while FIGS. 28-32 illustrate positioning a weight member that may be moved within a weight channel, as further described below.

G. Z-Axis Gear Effect

Figure 7:
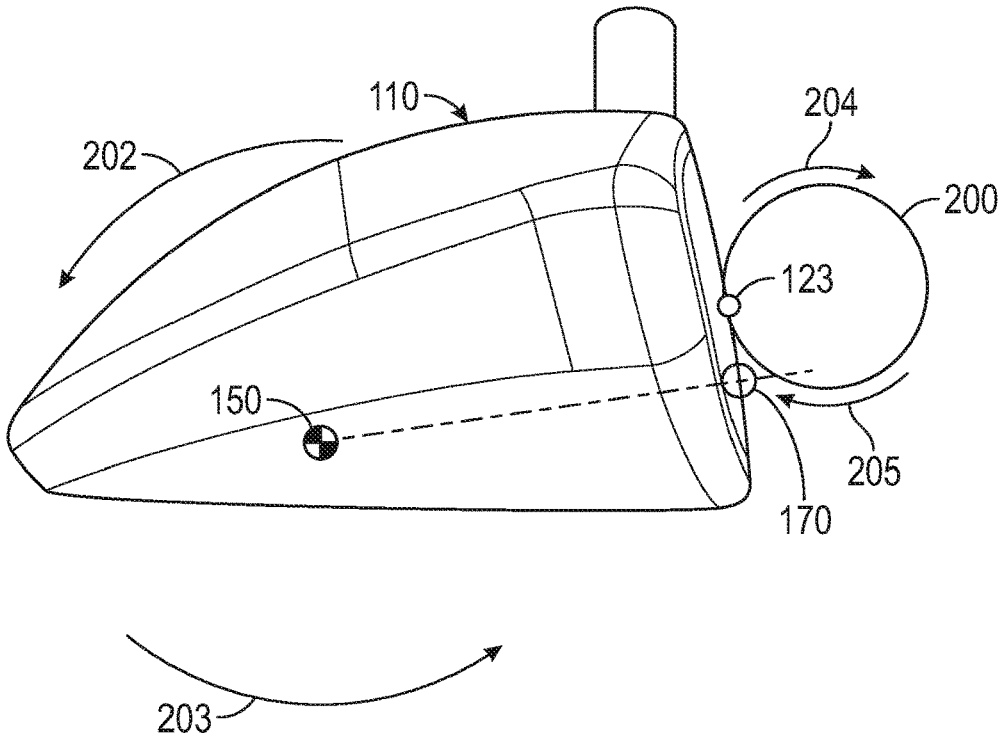
FIG. 7 is a side elevation view from a toe side of the golf club of FIG. 1 illustrating the projection of the center of gravity (CG) onto the golf club head face.

In certain embodiments disclosed herein, the projected CG point on the ball striking club face is located below the geometric center of the club face. In other words, the projected CG point on the ball striking club face is closer to the sole of the club face than the geometric center. As a result, and as illustrated in FIG. 7, when the golf club is swung such that the club head 100 impacts a golf ball 200 at the club head's center 123, the impact is "off center" from the projected CG point 170, creating torque that causes the body of the golf club head to rotate (or twist) about the CG x-axis (which is normal to the page in FIG. 7). This rotation of the golf club head about the x-axis is illustrated in FIG. 7 by arrows 202, 203. The rotation of the club face creates a "z-axis gear effect." More specifically, the rotation of the club head about the CG x-axis tends to induce a component of spin on the ball. In particular, the backward rotation (shown by arrows 202, 203) of the club head face that occurs as the golf ball is compressed against the club face during impact causes the ball to rotate in a direction opposite to the rotation of the club face, much like two gears interfacing with one another. Thus, the backward rotation of the club face during impact creates a component of forward rotation (shown by arrows 204, 205) in the golf ball. This effect is termed the "z-axis gear effect." Because the loft of a golf club head also creates a significant amount of backspin in a ball impacted by the golf club head, the forward rotation resulting from the z-axis gear effect is typically not enough to completely eliminate the backspin of the golf ball, but instead reduces the backspin from that which would normally be experienced by the golf ball. In general, the forward rotation (or topspin) component resulting from the z-axis gear effect is increased as the impact point of a golf ball moves upward from (or higher above) the projected CG point on the ball striking club face. Additionally, the effective loft of the golf club head that is experienced by the golf ball and that determines the launch conditions of the golf ball can be different than the static loft of the golf club head. The difference between the golf club head's effective loft at impact and its static loft angle at address is referred to as "dynamic loft" and can result from a number of factors. In general, however, the effective loft of a golf club head is increased from the static loft as the impact point of a golf ball moves upward from (or higher than) the projected CG point on the ball striking club face.

H. Use of Composite Materials to Free Up Discretionary Mass

The composite crown and/or sole inserts disclosed in various embodiments herein, can help overcome manufacturing challenges associated with conventional golf club heads having normal continuous crowns made of titanium or other metals, and can replace a relatively heavy component of the crown with a lighter material, freeing up discretionary mass which can be strategically allocated elsewhere within the golf club head. In certain embodiments, the crown may comprise a composite material, such as those described herein and in the incorporated disclosures, such as a composite material having a density of less than 2 grams per cubic centimeter. In still further embodiments, the material has a density of no more than 1.5 grams per cubic centimeter, or a density between 1 gram per cubic centimeter and 2 grams per cubic centimeter. Providing a lighter crown further provides the golf club head with additional discretionary mass, which can be used elsewhere within the golf club head to serve the purposes of the designer. For example, with the discretionary mass, additional ribs 192 can be strategically added to the hollow interior of the golf club head and thereby improve the acoustic properties of the head. Discretionary mass in the form of ribs, mass pads or other features also can be strategically located in the interior, or even on the exterior of the golf club head to shift the effective CG fore or aft, toeward or heelward or both (apart from any further CG adjustments made possible by adjustable weight features) or to improve desirable MOI characteristics, as further described herein.

Methods of making any of the golf club heads disclosed herein, or associated golf clubs, may include one or more of the following steps:

- forming a frame having a sole opening, forming a composite laminate sole insert, injection molding a thermoplastic composite head component over the sole insert to create a sole insert unit, and joining the sole insert unit to the frame, as described in more detail in US Patent Pub. No. 2018/0126228, the entire contents of which are incorporated by reference;
- providing a composite head component which is a weight track capable of supporting one or more slidable weights;
- forming the sole insert and/or crown insert from a thermoplastic composite material having a matrix compatible for bonding with the weight track;
- forming the sole insert and/or crown insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof, wherein the sole insert is formed from a composite material having a density of less than 2 grams per cubic centimeter. In still further embodiments, the material has a density of less than 1.5 grams per cubic centimeter, or a density between 1 gram per cubic centimeter and 2 grams per cubic centimeter and the sole insert has a thickness of from about 0.195 mm to about 0.9 mm, preferably from about 0.25 mm to about 0.75 mm, more preferably from about 0.3 mm to about 0.65 mm, even more preferably from about 0.36 mm to about 0.56 mm;

forming both the sole insert and/or crown insert and weight track from thermoplastic composite materials having a compatible matrix;

forming the sole insert and/or crown insert from a thermosetting material, coating the sole insert with a heat activated adhesive, and forming the weight track from a thermoplastic material capable of being injection molded over the sole insert after the coating step;

forming the frame from a material selected from the group consisting of titanium, one or more titanium alloys, aluminum, one or more aluminum alloys, steel, one or more steel alloys, and any combination thereof;

forming the frame with a crown opening, forming a crown insert from a composite laminate material, and joining the crown insert to the frame such that the crown insert overlies the crown opening;

selecting a composite head component from the group consisting of one or more ribs to reinforce the head, one or more ribs to tune acoustic properties of the head, one or more weight ports to receive a fixed weight in a sole portion of the club head, one or more weight tracks to receive a slidable weight, and combinations thereof;

forming the sole insert and crown insert from a continuous carbon fiber composite material;

forming the sole insert and crown insert by thermosetting using materials suitable for thermosetting, and coating the sole insert with a heat activated adhesive;

forming the frame from titanium, titanium alloy or a combination thereof and has a crown opening, and the sole insert and weight track are each formed from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof;

forming the frame with a crown opening, forming a crown insert from a thermoplastic composite material, and joining the crown insert to the frame such that it overlies the crown opening; and providing a crown to sole stiffening member, as described in more detail in U.S. Pat. No. 9,693,291, the entire contents of which is hereby incorporated by reference in its entirety.

The bodies of the golf club heads disclosed herein, and optionally other components of the club heads as well, serve as frames and may be made from a variety of different types of suitable materials. In some embodiments, for example, the body and/or other head components can be made of a metal material such as steel and steel alloys, a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The body may be formed by conventional casting, metal stamping or other known processes. The body also may be made of other metals as well as non-metals. The body can provide a framework or skeleton for the club head to strengthen the club head in areas of high stress caused by the golf ball's impact with the face, such as the transition region where the club head transitions from the face to the crown area, sole area and skirt area located between the sole and crown areas.

In some embodiments, the sole insert and/or crown insert of the club head may be made from a variety of composite materials and/or polymeric materials, such as from a thermoplastic material, preferably from a thermoplastic composite laminate material, and most preferably from a thermoplastic carbon composite laminate material. For example, the composite material may comprise an injection moldable material, thermoformable material, thermoset composite material or other composite material suitable for golf club head applications. One example material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

TEPEX® DYNALITE 207 is a high strength, lightweight material having multiple layers of continuous carbon fiber reinforcement in a PPS thermoplastic matrix or polymer to embed the fibers. The material may have a 54% fiber volume but other volumes (such as a volume of 42% to 57%) will suffice. The material weighs about 200 g/m$^2$.

Another similar example material which may be used for the crown insert and/or sole insert is TEPEX® DYNALITE 208. This material also has a carbon fiber volume range of 42% to 57%, including a 45% volume in one example, and a weight of 200 g/m$^2$. DYNALITE 208 differs from DYNALITE 207 in that it has a TPU (thermoplastic polyurethane) matrix or base rather than a polyphenylene sulfide (PPS) matrix.

By way of example, the TEPEX® DYNALITE 207 sheet(s) (or other selected material such as DYNALITE 208) are oriented in different directions, placed in a two-piece (male/female) matched die, heated past the melt temperature, and formed to shape when the die is closed. This process may be referred to as thermoforming and is especially well-suited for forming sole and crown inserts.

Once the crown insert and/or sole insert are formed (separately) by the thermoforming process just described, each is cooled and removed from the matched die. The sole and crown inserts are shown as having a uniform thickness, which lends itself well to the thermoforming process and ease of manufacture. However, the sole and crown inserts may have a variable thickness to strengthen select local areas of the insert by, for example, adding additional plies in select areas to enhance durability, acoustic or other properties in those areas.

A crown insert and/or sole insert can have a complex three-dimensional curvature corresponding generally to the crown and sole shapes of a fairway wood-type club head and specifically to the design specifications and dimensions of the particular head designed by the manufacturer. It will be appreciated that other types of club heads, such as drivers, utility clubs (also known as hybrid clubs), rescue clubs, and the like may be manufactured using one or more of the principles, methods and materials described herein.

In an alternative embodiment, the sole insert and/or crown insert can be made by a process other than thermoforming, such as injection molding or thermosetting. In a thermoset process, the sole insert and/or crown insert may be made from prepreg plies of woven or unidirectional composite fiber fabric (such as carbon fiber) that is preimpregnated with resin and hardener formulations that activate when heated. The prepreg plies are placed in a mold suitable for a thermosetting process, such as a compression mold, e.g., a metal matched compression mold, or a bladder mold, and stacked/oriented with the carbon or other fibers oriented in different directions. The plies are heated to activate the chemical reaction and form the sole (or crown) insert. Each insert is cooled and removed from its respective mold. Additional disclosure regarding methods of forming sole and/or crown inserts can be found in U.S. Pat. No. 9,579,549, the entire contents of which are incorporated by reference.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. Reissue Pat. No. RE41,577; U.S. Pat. Nos. 7,267,620; 7,140,974; 8,096,897; 7,628,712; 7,985,146; 7,874,936; 7,874,937; 8,628,434; and 7,874,938; and U.S. Patent Pub. Nos. 2008/0149267 and 2009/0163289, which are all incorporated herein by reference. The composite material may be manufactured according to the methods described at least in U.S. Patent Pub. No. 2008/0149267, the entire contents of which are herein incorporated by reference.

Alternatively, short or long fiber-reinforced formulations of the previously referenced polymers. Example formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 MPa) as measured by ASTM D 638; a Flexural Strength of 50000 psi (345 MPa) as measured by ASTM D 790; and a Flexural Modulus of $2.60\times10^6$ psi (17927 MPa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

An example is a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Another example is a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Also an option is a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

The foregoing materials are well-suited for composite, polymer and insert components of the embodiments disclosed herein, as distinguished from components which preferably are made of metal or metal alloys.

Additional details regarding providing composite soles and/or crowns and crown layups are provided in U.S. Patent Pub. No. 2016/0001146, the entire contents of which are hereby incorporated by reference.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell of the golf club head 100 may be made of a composite material, such as, for example, a carbon fiber reinforced epoxy, carbon fiber reinforced polymer, or a polymer. Additionally, U.S. Patent Pub. No. 2004/0116207 and U.S. Pat. No. 6,969,326, also incorporated by reference herein in their entirety, describe golf club heads with lightweight crowns. Furthermore, U.S. patent application Ser. No. 12/974,437 (now U.S. Pat. No. 8,608,591), also incorporated by reference herein in its entirety, describes golf club heads with lightweight crowns and soles.

In some embodiments, composite materials used to construct the crown and/or sole insert should exhibit high strength and rigidity over a broad temperature range as well as good wear and abrasion behavior and be resistant to stress cracking. Such properties include (1) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039); (2) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039); (3) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790); and (4) a Flexural Modulus at room temperature of from about 0.4 Msi to about 21 Msi, from about 0.5 Msi to about 20 Msi, more preferably of from about 10 Msi to about 19 Msi (as measured by ASTM D 790).

In certain embodiments, composite materials that are useful for making club-head components comprise a fiber portion and a resin portion. In general, the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However, for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. FAW is the weight of the fiber portion of a given quantity of prepreg, in units of $g/m^2$. Crown and/or sole panels may be formed of plies of composite material having a fiber areal weight of between 20 $g/m^2$ and 200 $g/m^2$ and a density between about 1 g/cc and 2 g/cc. However, FAW values below 100 $g/m^2$, and more desirably 75 $g/m^2$ or less, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An example resin content (R/C) is between 33% and 40%, preferably between 35% and 40%, more preferably between 36% and 38%.

Some of the embodiments of the golf club head 100 discussed throughout this application may include a separate crown, sole, and/or face that may be a composite, such as, for example, a carbon fiber reinforced epoxy, carbon fiber reinforced polymer, or a polymer crown, sole, and/or face. Alternatively, the crown, sole, and/or face may be made from a less dense material, such as, for example, Titanium or Aluminum. A portion of the crown may be cast from either steel (~7.8-8.05 $g/cm^3$) or titanium (~4.43 $g/cm^3$) while a majority of the crown may be made from a less dense material, such as for example, a material having a density of about 1.5 $g/cm^3$ or some other material having a density less than about 4.43 $g/cm^3$. In other words, the crown could be some other metal or a composite. Additionally or alternatively, the face may be welded in place rather than cast as part of the sole.

By making the crown, sole, and/or face out of a less dense material, it may allow for weight to be redistributed from the crown, sole, and/or face to other areas of the club head, such as, for example, low and forward and/or low and back. Both low and forward and low and back may be possible for club heads incorporating a front to back sliding weight track.

U.S. Pat. No. 8,163,119 discloses composite articles and methods for making composite articles, which disclosure is incorporated by reference herein in the entirety. U.S. Pat. Nos. 9,452,325 and 7,279,963 disclose various composite crown constructions that may be used for golf club heads, which disclosures are also incorporated by reference herein in their entireties. The techniques and layups described in U.S. Pat. Nos. 8,163,119; 9,452,325; and 7,279,963, incorporated herein by reference in their entirety, may be employed for constructing a composite crown panel, composite sole panel, composite toe panel located on the sole, and/or composite heel panel located on the sole.

U.S. Pat. No. 8,163,119 discloses the usual number of layers for a striking plate is substantial, e.g., fifty or more. However, improvements have been made in the art such that the layers may be decreased to between 30 and 50 layers. Additionally, for a panel located on the sole and/or crown the layers can be substantially decreased down to three, four, five, six, seven, or more layers.

It should be understood that the crown and sole may not have the same thickness or be made from the same materials. In certain embodiments, the sole may be made from either a titanium alloy or a steel alloy. Similarly, the main body of the golf club head may be made from either a titanium alloy or a steel alloy. The titanium will typically range from 0.4 mm to about 0.9 mm, preferably from 0.4 mm to about 0.8 mm, more preferably from 0.4 mm to about 0.7 mm, even more preferably from 0.45 mm to about 0.6 mm. In some instances, the crown and/or sole may have non-uniform thickness, such as, for example varying the thickness between about 0.45 mm and about 0.55 mm.

A lot of discretionary mass may be freed up by using composite material in the crown and/or sole especially when combined with thin walled titanium construction (0.4 mm to 0.9 mm) in other parts of the golf club head. The thin walled titanium construction increases the manufacturing difficulty and ultimately fewer parts are cast at a time. In the past, 100+ golf club heads could be cast at a single time, however due to the thinner wall construction fewer golf club heads are cast per cluster to achieve the desired combination of high yield and low material usage.

An important strategy for obtaining more discretionary mass is to reduce the wall thickness of the golf club head. For a typical titanium-alloy "metal-wood" club-head having a volume of 460 cc (i.e., a driver) and a crown area of 100 $cm^2$, the thickness of the crown is typically about 0.8 mm, and the mass of the crown is about 36 g. Thus, reducing the wall thickness by 0.2 mm (e.g., from 1 mm to 0.8 mm) can yield a discretionary mass "savings" of 9.0 g.

The following examples will help to illustrate the possible discretionary mass "savings" by making a composite crown rather than a titanium-alloy crown. For example, reducing the material thickness to about 0.73 mm yields an additional discretionary mass "savings" of about 25.0 g over a 0.8 mm titanium-alloy crown. For example, reducing the material thickness to about 0.73 mm yields an additional discretionary mass "savings" of about 25 g over a 0.8 mm titanium-alloy crown or 34 g over a 1.0 mm titanium-alloy crown. Additionally, a 0.6 mm composite crown yields an additional discretionary mass "savings" of about 27 g over a 0.8 mm titanium-alloy crown. Moreover, a 0.4 mm composite crown yields an additional discretionary mass "savings" of about 30 g over a 0.8 mm titanium-alloy crown. The crown can be made even thinner yet to achieve even greater weight savings, for example, about 0.32 mm thick, about 0.26 mm thick, about 0.195 mm thick. However, the crown thickness must be balanced with the overall durability of the crown during normal use and misuse. For example, an unprotected crown i.e. one without a head cover could potentially be damaged from colliding with other woods or irons in a golf bag.

For example, any of the embodiments disclosed herein may have a crown or sole insert formed of plies of composite material having a fiber areal weight of between 20 g/m$^2$ and 200 g/m$^2$, preferably between 50 g/m$^2$ and 100 g/m$^2$, the weight of the composite crown being at least 20% less than the weight of a similar sized piece formed of the metal of the body. The composite crown may be formed of at least four plies of uni-tape standard modulus graphite, the plies of uni-tape oriented at any combination of 0° (forward to rearward of the club head), +45°, −45° and 90° (heelward to toeward of the golf club head). Additionally or alternatively, the crown may include an outermost layer of a woven graphite cloth. Carbon crown panels or inserts or carbon sole panels as disclosed herein and in the incorporated applications may be utilized with any of the embodiments herein, and may have a thickness between 0.40 mm to 1.0 mm, preferably 0.40 mm to 0.80 mm, more preferably 0.40 mm to 0.65 mm, and a density between 1 gram per cubic centimeter and 2 grams per cubic centimeter, though other thicknesses and densities are also possible.

One potential embodiment of a carbon sole panel that may be utilized with any of the embodiments herein weighs between 1.0 grams and 5.0 grams, such as between 1.25 grams and 2.75 grams, such as between 3.0 grams and 4.5 grams. In other embodiments, the carbon sole panel may weigh less than 3.0 grams, such as less than 2.5 grams, such as less than 2.0 grams, such as less than 1.75 grams. The carbon sole panel may have a surface area of at least 1250 mm$^2$, 1500 mm$^2$, 1750 mm$^2$, or 2000 mm$^2$.

One potential embodiment of a carbon crown panel that may be utilized with any of the embodiments herein weighs between 3.0 grams and 8.0 grams, such as between 3.5 grams and 7.0 grams, such as between 3.5 grams and 7.0 grams. In other embodiments, the carbon crown panel may weigh less than 7.0 grams, such as less than 6.5 grams, such as less than 6.0 grams, such as less than 5.5 grams, such as less than 5.0 grams, such as less than 4.5 grams.

II. A First Example Golf Club Head

A driving-wood-type golf club head, such as the golf club head 300 shown in FIGS. 8-26 illustrate a driving-wood-type golf club head embodying an aerodynamic golf club head shape, along with a COR feature in combination with an inertia generator and both fixed and removable discretionary mass that is advantageously positioned to improve playability. Similar features are shown in the other embodiments described herein, along with other alternative or additional features, such as sliding weight tracks, removable weights positioned forward and/or rearward of the club head center of gravity and/or an adjustable lodensift/lie feature. It is understood that any of these or the other advantageous features described herein may be used alone or in combination to improve the desired playability characteristics of the example golf club heads described herein.

Golf club head 300 includes a hollow body 310 defining a crown portion 312, a sole portion 314, a skirt portion 316, and a striking surface 318. The striking surface 318 can be integrally formed with the body 310 or attached to the body. The body 310 further includes a hosel 320, which defines a hosel bore 324 adapted to receive a golf club shaft. The body 310 further includes a heel portion 326, a toe portion 328, a front portion 330, and a rear portion 332. Included are a number of features that may improve playability, including at least an inertia generator 360, front channel 390, as well as composite panels on the sole 344, 348 and on the crown 335, along with discretionary mass elements and other additional features, as will be further described herein The club head 300 also has a volume, typically measured in cubic-centimeters (cc), equal to the volumetric displacement of the club head, assuming any apertures are sealed by a substantially planar surface. According to some embodiments, the golf club head 300 may have a volume of between 400 and 470 cubic centimeters (cc), such as between 420 cc and 470 cc, or between 440 cc and 470 cc.

The body 310, or any parts thereof, can be made from a metal alloy (e.g., an alloy of titanium, an alloy of steel, an alloy of aluminum, and/or an alloy of magnesium), a composite material (e.g., a graphite or carbon fiber composite) a ceramic material, or any combination thereof. The crown 312, sole 314, skirt 316, and striking surface 318 can be integrally formed using techniques such as molding, cold forming, casting, and/or forging. Alternatively, any one or more of the crown 312, sole 314, skirt 316, or striking surface 318 can be attached to the other components by known means (e.g., adhesive bonding, welding, and the like).

In some embodiments, the striking face 318 is made of a composite material, while in other embodiments, the striking face 318 is made from a metal alloy (e.g., an alloy of titanium, steel, aluminum, and/or magnesium), ceramic material, or a combination of composite, metal alloy, and/or ceramic materials.

A. Example Composite Crown Feature

Figure 8:
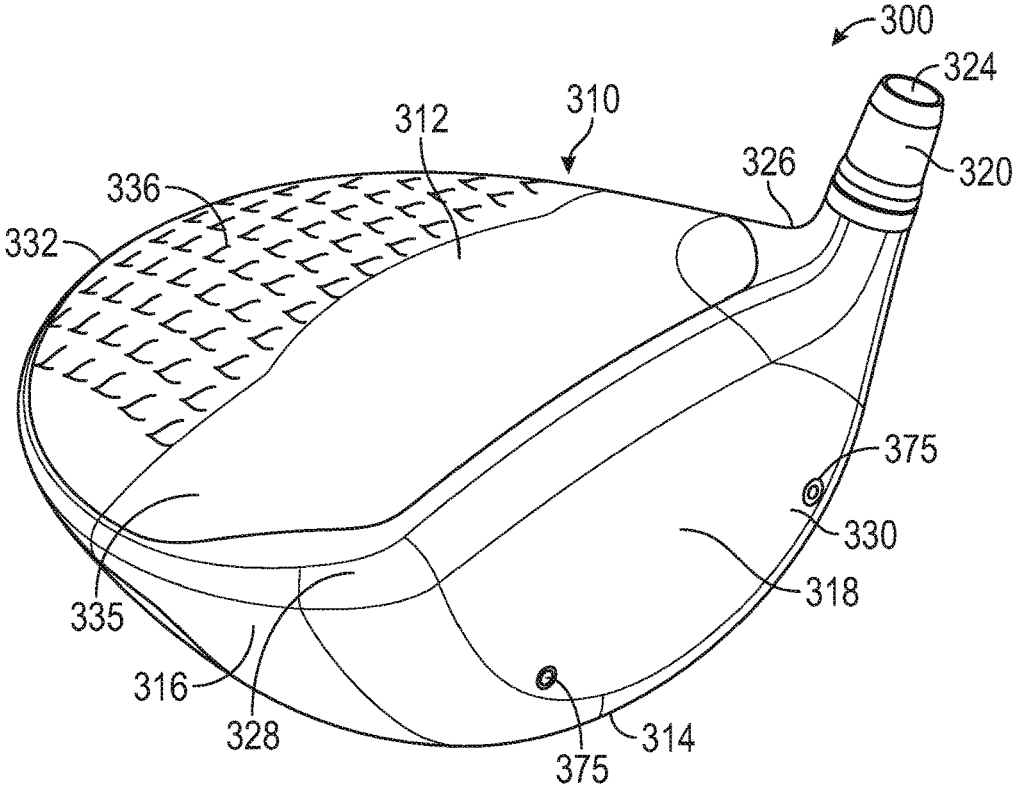
FIG. 8 is a perspective view of another example embodiment of a golf club head.
Figure 15:
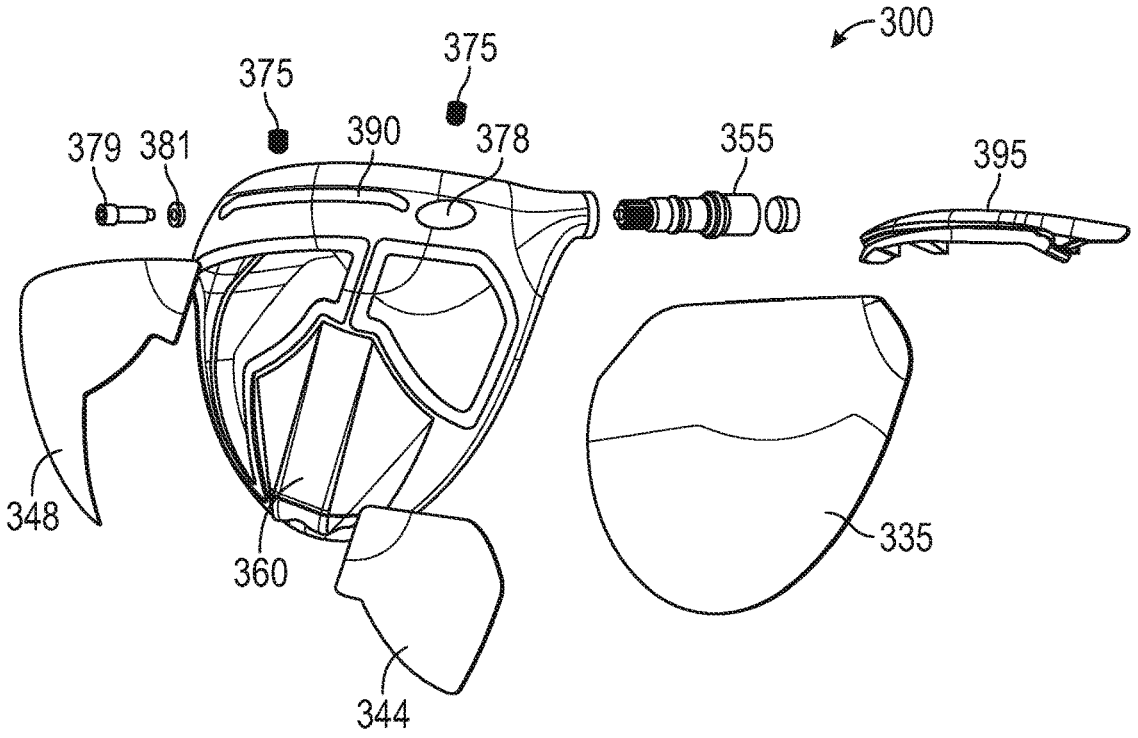
FIG. 15 is an exploded perspective view of the golf club head of FIG. 8.
Figure 16:
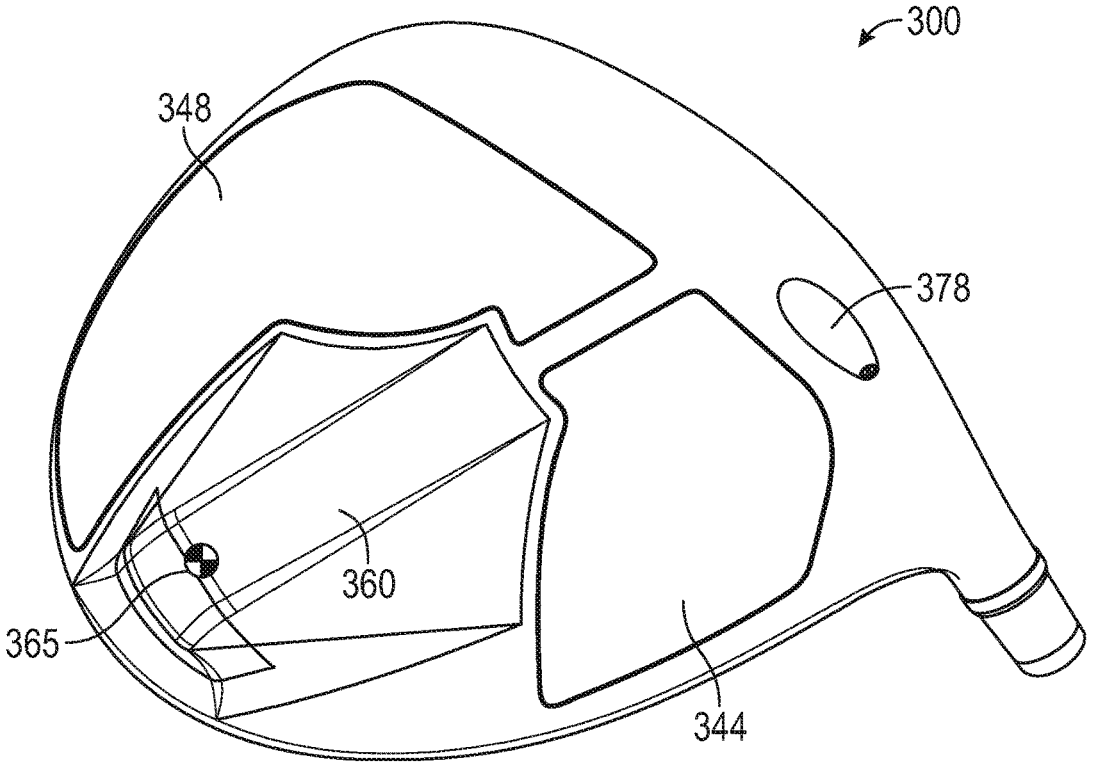
FIG. 16 is a bottom perspective view from a heel side of the golf club head of FIG. 8.

As illustrated in FIGS. 8 and 15, the golf club head 300 can optionally include a separate crown insert 335 that is secured to the body 310, such as by applying a layer of epoxy adhesive or other securement means, such as bolts, rivets, snap fit, other adhesives, or other joining methods or any combination thereof, to cover a large opening 340 (illustrated in FIG. 12A) at the top and rear of the body, forming part of the crown 312 of the golf club head. The crown insert 335 covers a substantial portion of the crown's surface area as, for example, at least 30%, at least 40%, at least 50%, at least 60%, at least 70% or at least 80% of the crown's surface area. The crown's outer boundary generally terminates where the crown surface undergoes a significant change in radius of curvature, e.g., near where the crown transitions to the golf club head's skirt 316, hosel 320, and front portion 330.

Figure 12A:
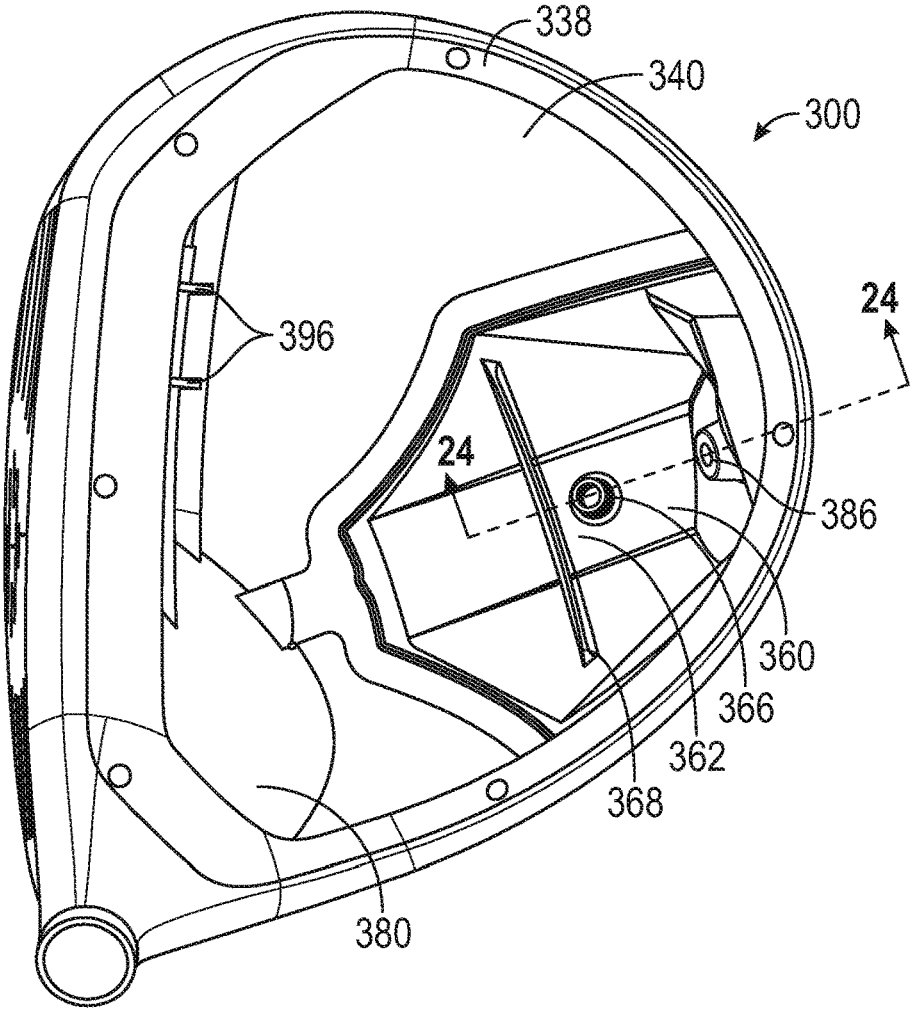
FIG. 12A is a top view of the golf club head of FIG. 8, with a crown insert removed.

As best illustrated in FIG. 12A, the crown can be formed to have a recessed peripheral ledge or seat 338 to receive the crown insert 335, such that the crown insert is either flush with the adjacent surfaces of the body to provide a smooth seamless outer surface or, alternatively, slightly recessed below the body surfaces. The front of the crown insert 335 can join with a front portion of the crown 312 on the body to form a continuous, arched crown extend forward to the face. The crown insert 335 can comprise any suitable material (e.g., lightweight composite and/or polymeric materials) and can be attached to the body in any suitable manner, as described in more detail elsewhere herein. In certain embodiments, the composite crown may have a surface area of 9200 $mm^2$ and 9800 $mm^2$, such as between 9400 $mm^2$ and 9700 $mm^2$, or between 9500 $mm^2$ and 9600 $mm^2$.

B. Example Vortex Generator Feature

In some embodiments, the surface of the crown 312 may comprise one or more surface features, such as a plurality of vortex generators 336, which as illustrated in FIG. 8 may each comprise a "wishbone" shape. These vortex generators 336 may be raised up from the surface of the crown 312, such as at a height of less than a mm, such as between 0 and 0.8 mm, or between 0.2 and 0.6 mm, or between 0.3 and 0.5 mm, with a narrow end of the raised portion angled toward the rear portion 332 of the golf club head so as to improve playability properties of the golf club head. While in the illustrated embodiment, these vortex generators 336 are shown as being positioned on a crown insert 335, they may be placed, e.g., elsewhere on a crown of a golf club head, or along a sole of the golf club head (see, e.g., FIG. 28, discussed in more detail below), or e.g., along a sole panel, along a toe surface, or at other locations on the surface of the golf club head, as desired.

C. Example Golf Club Head Measurements

Figure 9:
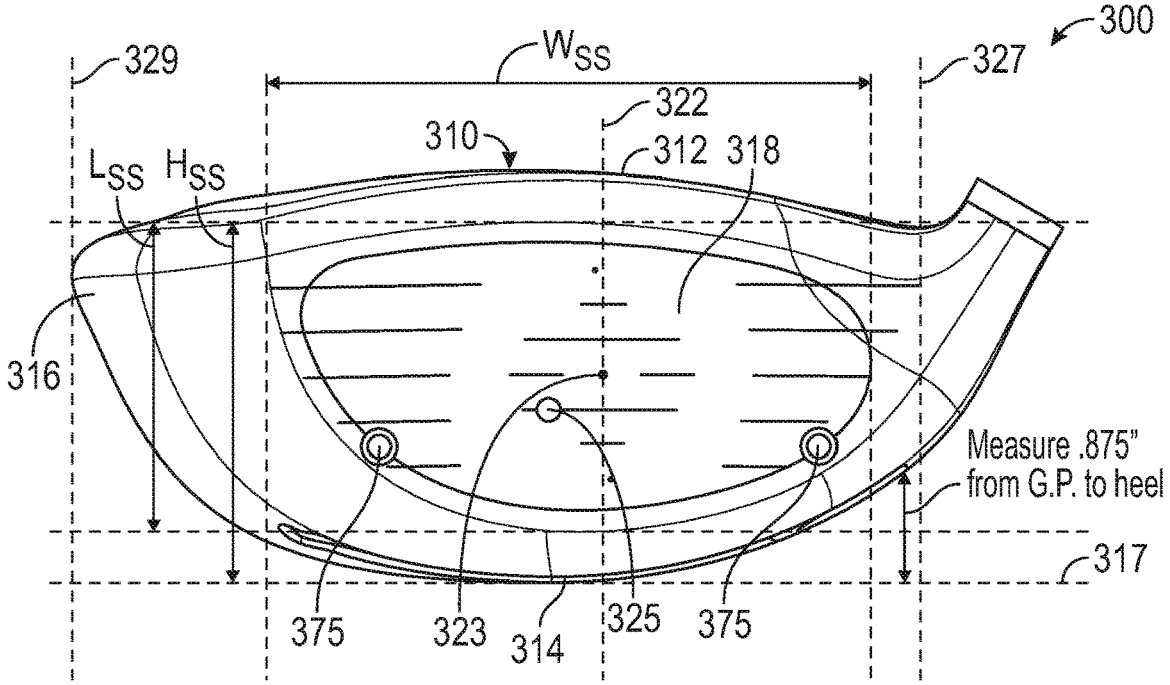
FIG. 9 is a front elevation view of the golf club head of FIG. 8.

As shown in FIG. 9, a center 323 is disposed on the striking surface 318. Also shown on the face is the projected CG point 325, which may be determined as described above.

The center 323 is defined as the intersection of the midpoints of a length ($L_{ss}$) and a width ($W_{ss}$) of the striking surface 318. Both $L_{ss}$ and $W_{ss}$ are determined using the striking face curve ($S_{ss}$), as described above. According to some embodiments, the striking surface may have a width $W_{ss}$ of between 80 mm and 100 mm, such as between 80 mm and 90 mm, or between 85 mm and 90 mm, and a length $L_{ss}$ of between 35 mm and 50 mm, such as between 40 mm and 50 mm, or between 40 mm and 45 mm.

Also illustrated is a striking surface height (or "face height") $H_{ss}$, which measures the height above the ground plane 317 of the striking face curve's periphery that is proximate to the crown portion of $S_{ss}$. According to some embodiments, the striking surface may have a height $H_{ss}$ of between 45 mm and 60 mm, such as between 50 mm and 60 mm, or between 50 mm and 55 mm.

As also described above, the portion of the striking surface 118 bounded by the striking face curve periphery defines a striking surface area (or "face area"), which may be measured to determine playability characteristics of the golf club head. According to some embodiments, the striking surface area may be at least 2900 $mm^2$, such as between 2900 $mm^2$ and 4000 $mm^2$ between 3200 $mm^2$ and 3950, or between 3250 $mm^2$ and 3500 $mm^2$.

Decreasing the face area relative to the overall volume of the golf club head may provide advantageous improvements to the playability of the club, such as its aerodynamics. In order to calculate a ratio between face area and volume, it may first be helpful to convert the face area in $mm^2$ to a measurement in centimeters. So, e.g., an area of 3950 $mm^2$ would be equivalent to an area of 39.5 $cm^2$. Using this measurement to compare face area to overall club head volume (measured in cubic centimeters (cc, or $cm^3$), according to some embodiments, a desirable ratio of face area to overall club head volume might be between no less than 0.06 and no more than 0.086, such as no more than 0.085, no more than 0.084, no more than 0.083, no more than 0.082, or no more than 0.081.

Also shown is a center plane 322 that extends rearward from the geometric center 323 of the golf club head perpendicular to both an origin y-axis (not pictured) and the ground plane 317. According to some embodiments, the golf club head 300 may have a volume toeward of the center plane 322 ("toe volume") of between 280 and 300 cc, such as at least 280 cc, at least 285 cc, or at least 290 cc. In some embodiments, the ratio of the toe volume of the golf club head to the total volume of the golf club head may be greater than 0.56, such as greater than 0.58, greater than 0.60, greater than 0.62, or greater than 0.63.

Extending perpendicular to the ground plane 317 in FIG. 9 are a heel plane 327 and a toe plane 329 that may be used to measure the length of the golf club head, which the USGA defines in "United States Golf Association and R&A Rules Limited PROCEDURE FOR MEASURING THE CLUB HEAD SIZE OF WOOD CLUBS," USGA-TPX3003, Revision 1.0.0, Nov. 21, 2003, as being measured from the heel of the golf club head to the toe of the golf club head. This length (heel-to-toe) is measured with the head positioned at a 60 degree lie angle, which may be measured as described above. If the outermost point of the heel is not clearly defined, it is deemed to be 0.875 inches above the horizontal plane on which the club is lying, which is illustrated as the point above ground plane 317 at which heel plane 327 intersects the body of golf club head 300. Toe plane 329, as illustrated, may extend through the toewardmost point of the golf club head. According to some embodiments, the club head length between the heel plane 327 and toe plane 329 may be between 110 mm and 140 mm, such as between 120 mm and 130 mm, such as between 120 mm and 125 mm.

Figure 10:
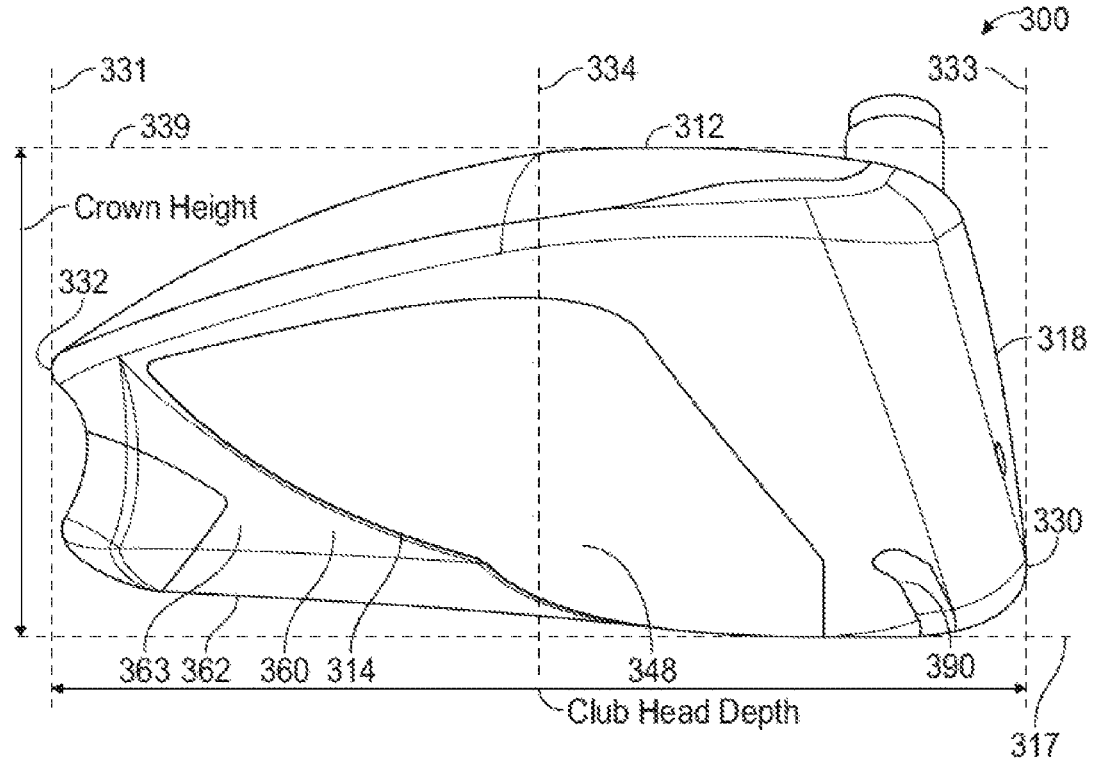
FIG. 10 is a side elevation view from a toe side of the golf club head of FIG. 8.

Illustrated in FIG. 10 are a front plane 331 that extends from a forwardmost point of the golf club head, and a rear plane 333 that extends from a rearwardmost point of the golf club head. Each of these planes extends from its respective point and is perpendicular to the ground plane 317. Together, the planes may be used to measure the front to back depth of the golf club head ("club head depth"), as illustrated in FIG. 10. According to some embodiments, the club head may have a front to back depth between the front plane 331 and rear plane 333 of between 100 and 130 mm, such as between 110 mm and 120 mm, such as between 110 mm and 115 mm. Additionally, according to some embodiments, a ratio of the club head depth to the club head length may be between 0.9 and 1.0, such as between 0.9 and 0.95, and in some embodiments, no greater than 0.94.

Also illustrated in FIG. 10 is a midpoint plane 334 extending perpendicular to the ground plane 317 halfway between the front plane 331 and the rear plane 333. According to some embodiments, the golf club head 300 may have a volume rearward of the midpoint plane 334 ("rear volume") of between 140 and 180 cc, such as between 150 cc and 175 cc, or between 160 cc and 170 cc. In some embodiments, the ratio of the rear volume of the golf club head to the total volume of the golf club head may be less than 0.5, such as less than 0.45, or less than 0.40.

Also illustrated in FIG. 10 is a crown apex plane 339 that extends outwardly from a highest point of the crown parallel to the ground plane 317. The distance from the ground plane 317 to the crown apex plane may be measured to determine the maximum height of the golf club head 300, which may be referred to as the "crown height" or "apex height." According to some embodiments, the crown height may be between 50 mm and 70 mm, such as between 50 mm and 60 mm, or between 55 mm and 60 mm. Golf club head 300 also has a skirt height 315, which may measure the lowest point above the ground plane at which the skirt meets the crown.

In some embodiments, the skirt height 315 may be between 25 mm and 40 mm, such as between 30 mm and 40 mm, or between 30 mm and 35 mm.

In some cases, golf club heads having a taller vertical profile may exhibit improved aerodynamic qualities, but this taller vertical profile may have offsetting negative impacts on the golf club head's center of gravity. In the club heads disclosed herein, the clubs center of gravity is lowered (along the z-axis, toward the ground plane) by placing additional discretionary mass lower in the golf club head. Thus the golf club heads of this disclosure provide advantages both in terms of aerodynamic qualities, which may, for example, allow for greater club head speed at impact, along with a lower center of gravity, which has a number of benefits described herein and in the incorporated patents and applications. Additional information about the center of gravity of the illustrated golf club heads is provided below.

Figure 11:
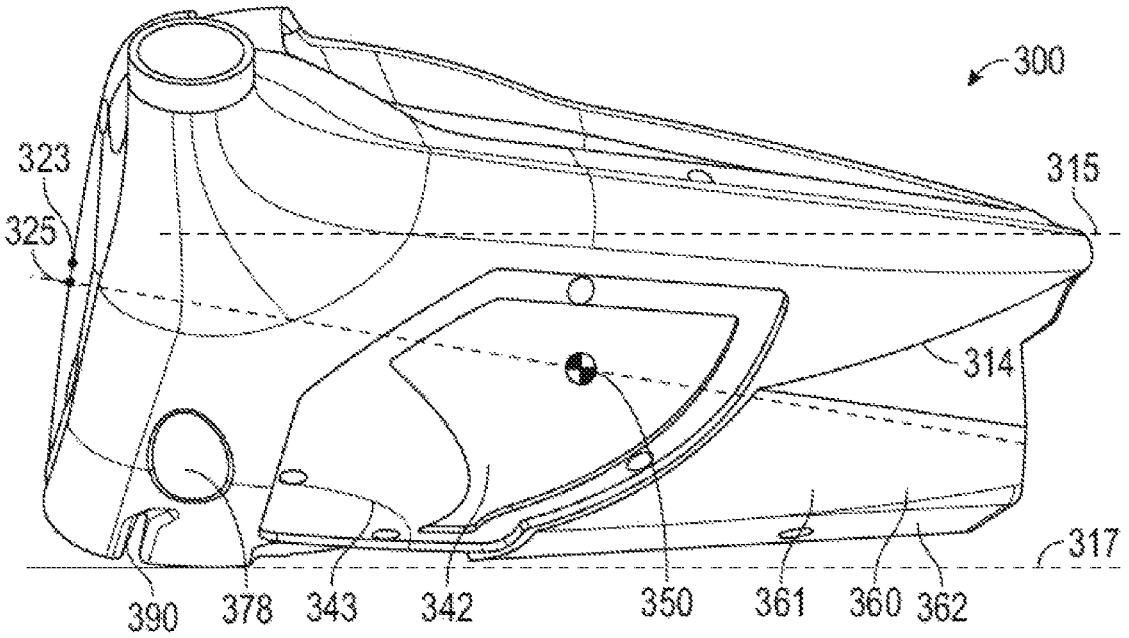
FIG. 11 is a side elevation view from a heel side of the golf club head of FIG. 8, with sole and crown inserts removed.

Illustrated in FIG. 11 is the center of gravity 350 of the golf club head 300. In some embodiments, the golf club head center of gravity 350 may be positioned as follows (with positions measured relative to the center 323 of the striking surface 318, as described above):

$CG_x$ of between −5 mm and 5 mm, such as between 0 mm and −5 mm, or between 0 and −2 mm;

$CG_y$ of between 30 mm and 50 mm, such as between 35 and 40 mm; and $CG_z$ of between 5 mm and −10 mm, such as between 0 mm and −5 mm.

As described above, Zup represents the distance of the center of gravity above a ground plane 317. According to some advantageous embodiments, club head 300 may have a Zup of less than 32 mm, such as less than 30 mm, less than 28 mm, less than 26 mm, or less than 25 mm.

Figure 17:
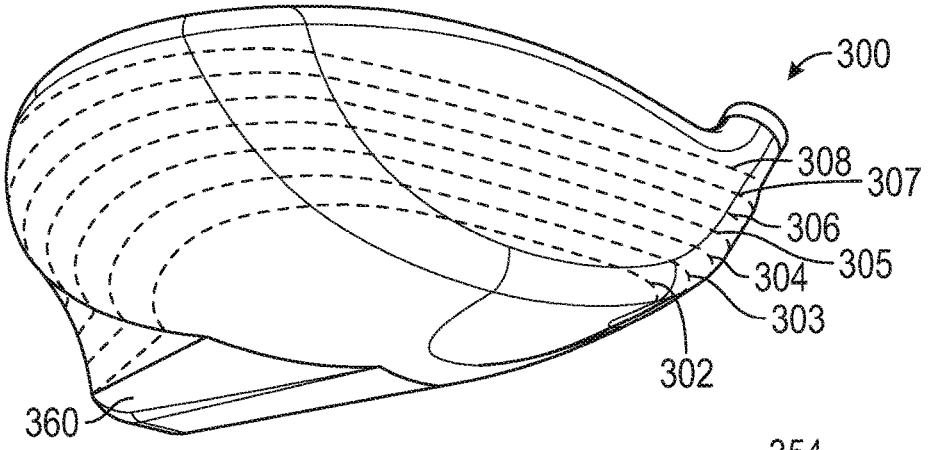
FIG. 17 is a perspective view from a toe side of the golf club head of FIG. 8, providing elevation markers on the golf club head at various heights relative to a ground plane.

Illustrated in FIG. 17 are dashed lines surrounding golf club head 300. Each of these dashed lines represents a fixed distance above a ground plane when golf club head 300 is in normal address position, so that a cross-section of the golf club head taken at one of the respective lines would be positioned at a consistent height above the ground plane. For example, 10 mm cross-section line 302 represents the cross-section of golf club head 300 at a position 10 mm above the ground plane. In turn:

- 15 mm cross-section line 303 represents the cross-section of golf club head 300 at a position 15 mm above the ground plane;
- 20 mm cross-section line 304 represents the cross-section of golf club head 300 at a position 20 mm above the ground plane;
- 25 mm cross-section line 305 represents the cross-section of golf club head 300 at a position 25 mm above the ground plane;
- 30 mm cross-section line 306 represents the cross-section of golf club head 300 at a position 30 mm above the ground plane;
- 35 mm cross-section line 307 represents the cross-section of golf club head 300 at a position 35 mm above the ground plane; and
- 40 mm cross-section line 308 represents the cross-section of golf club head 300 at a position 40 mm above the ground plane.

Figure 18:
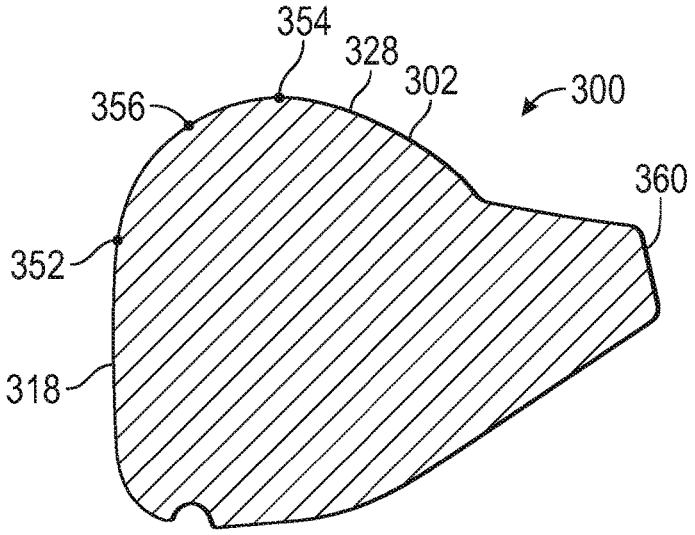
FIG. 18 is a cross-section showing an outer perimeter the golf club head of FIG. 8 at one of the elevation markers of FIG. 17.
Figure 19:
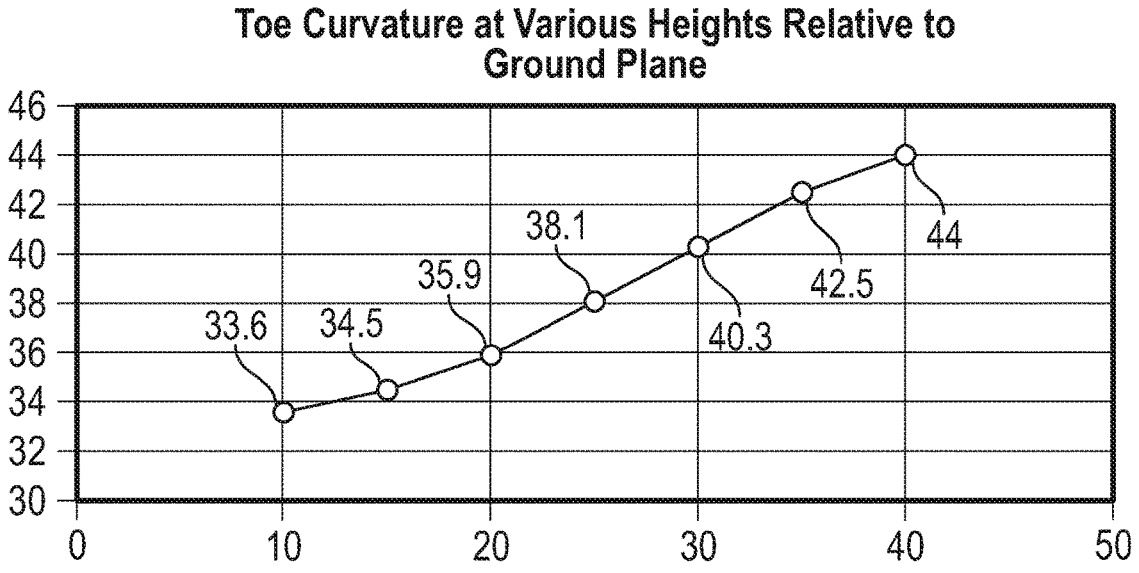
FIG. 19 is a table showing example toe curvatures at various heights relative to a ground plane indicated by the elevation markers of FIG. 17 for the golf club head of FIG. 8.

FIG. 18 illustrates a cross section of the outer perimeter of golf club head 300 taken at 10 mm cross-section line 302. Three points are identified around the perimeter of the golf club head. A first "face edge point" 352 is positioned at the toewardmost edge of the striking surface. A second "inflection point" 354 is positioned at the toewardmost point of the cross-section of the golf club head. A third "midpoint" 356 is positioned halfway between the face edge point 352 and the inflection point 354. Taking the segment of the perimeter of this cross-section that runs from the face edge point to the inflection point and through the midpoint may provide a measure of the curvature of the toe, with higher values potentially reflecting a more gradual curve. The length of this segment may be referred to as the "toe curvature." As illustrated in FIG. 19, in a particular embodiment, the toe curvature at the 10 mm cross-section line 302 is 33.6 mm. In turn:

- the toe curvature at the 15 mm cross-section line 303 is 34.5 mm
- the toe curvature at the 20 mm cross-section line 304 is 35.9 mm
- the toe curvature at the 25 mm cross-section line 305 is 38.1 mm
- the toe curvature at the 30 mm cross-section line 306 is 40.3 mm
- the toe curvature at the 35 mm cross-section line 307 is 42.5 mm
- the toe curvature at the 40 mm cross-section line 308 is 44.0 mm.

In some embodiments, the toe curvature of the golf club head at a distance of between 10 mm and 40 mm above the ground plane at normal address position may be in a range between 20 mm to 60 mm, such as between 35 mm and 50 mm, or between 30 mm and 45 mm. In particular embodiments, the minimum toe curvature of the golf club head may be no less than 20 mm. In still other particular embodiments, the maximum toe curvature of the golf club head may be no greater than 60 mm.

Additionally, a volume of the golf club head 300 between the ground plane 317 and the 30 mm cross section line 305 ("volume below 30 mm above ground plane") may be at least 190 cc, such as at least 195 cc, at least 200 cc, at least 205 cc, at least 210 cc, at least 215 cc, or at least 220 cc. In some embodiments, the ratio of the volume below 30 mm above ground plane of the golf club head to the total volume of the golf club head may be greater than 0.4, such as greater than 0.42, greater than 0.44, greater than 0.46, or greater than 0.48.

D. Example Composite Sole Features

As illustrated in FIGS. 10, 11, and 13-16, the golf club head 300 may include one or more separate sole inserts. Heel sole insert 344 and toe sole insert 348 may be secured to the body 310 by applying a layer of epoxy adhesive or other securement means, such as bolts, rivets, snap fit, other adhesives, or other joining methods or any combination thereof, to cover heel sole opening 342 and toe sole opening 346, respectively, in the sole rearward of the hosel (illustrated in FIG. 14). Combined, the sole inserts cover a substantial portion of the sole's surface area as, for example, at least 30%, at least 40%, at least 50%, at least 60%, at least 70% or at least 80% of the sole's surface area. The heel sole insert 344 is positioned on the heel side of the sole rearward of the channel and the hosel, and at least partially surrounds the inertia generator. The heel sole insert 344 in certain embodiments may have a surface area of at least 1500 $mm^2$, such as at least 1800 $mm^2$, or at least 2000 $mm^2$. The toe sole insert 348 is positioned on the toe side of the sole rearward of the channel and the hosel, and at least partially surrounds the inertia generator. The toe sole insert 348 in certain embodiments may have a surface area of at least 3000 $mm^2$, such as at least 3500 $mm^2$, or at least 4000 $mm^2$. Combined, in certain embodiments the two sole inserts may have a surface area of at least 4500 $mm^2$, such as at least 5000 $mm^2$, at least 6000 $mm^2$, or at least 6500 $mm^2$.

Figure 14:
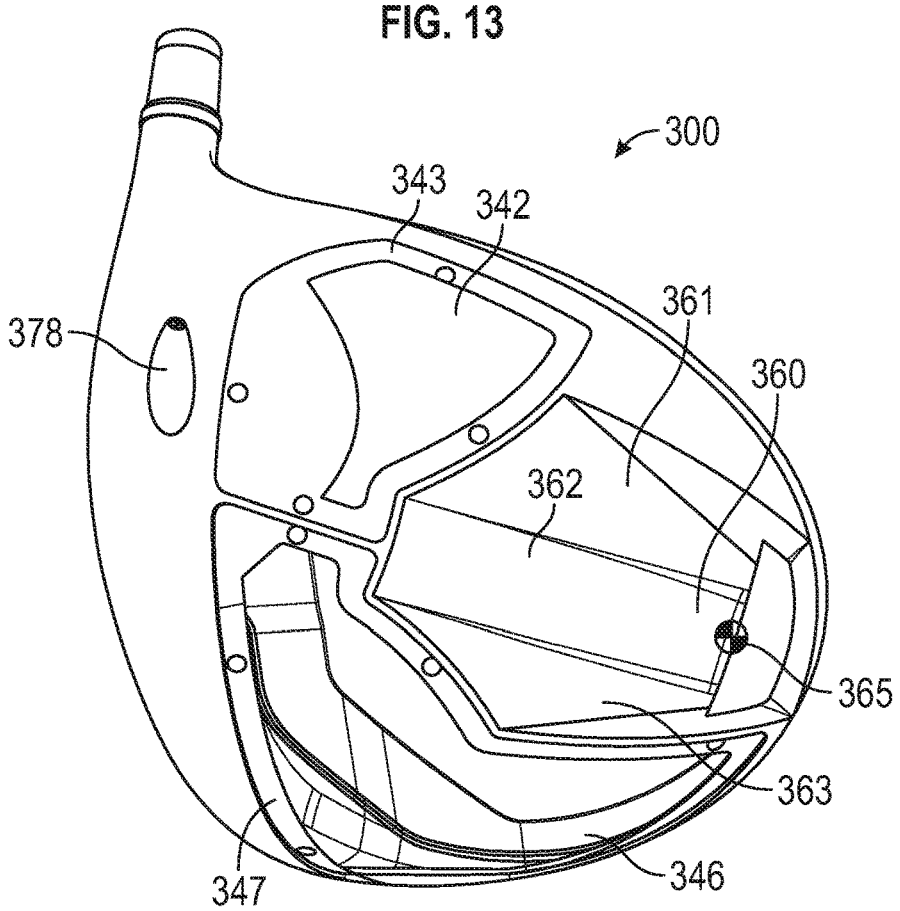
FIG. 14 is a bottom perspective view of the golf club head of FIG. 8, with two sole inserts removed.

As best illustrated in FIG. 14, the sole can be formed to have recessed peripheral ledges or seats that may be similar to the ledge described above for the crown insert, such that the sole inserts are either flush with the adjacent surfaces of the body to provide a smooth seamless outer surface or, alternatively, slightly recessed below the body surfaces. Heel sole opening 342 has a heel sole ledge 343 for supporting heel sole insert 344. Similarly, toe sole opening 346 has a toe sole ledge 347 for supporting toe sole insert 348. The sole inserts 344, 348 can comprise any suitable material (e.g., lightweight composite and/or polymeric materials) and can be attached to the body in any suitable manner, as described in more detail with regard to the attachment of the crown insert, as well as elsewhere herein and in the incorporated patents and applications.

E. Example Inertia Generator

As illustrated in FIGS. 10, 11, 12A, 13-17, golf club head 300 comprises an inertia generator 360, which may comprise an elongate center sole portion 362 that extends in a generally Y-direction—though as illustrated, and as further described below, is also angled toewardly—from a position proximate the golf club head center of gravity 350 to the rear portion of the body.

Figure 13:
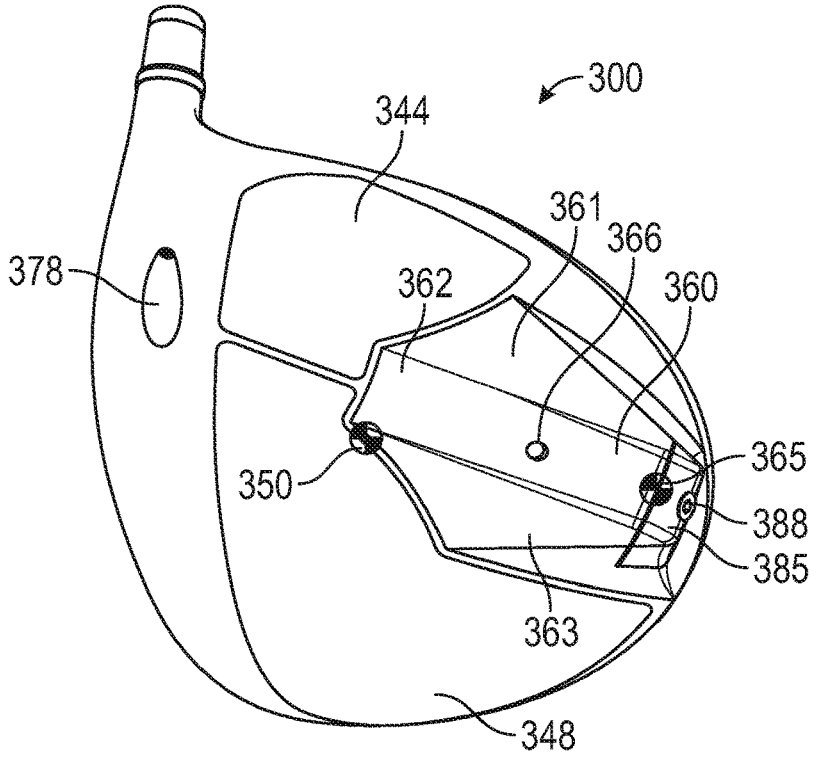
FIG. 13 is a bottom perspective view of the golf club head of FIG. 8.

As best illustrated in FIGS. 10 and 11, the center sole portion 362 comprises an elongate and substantially planar surface that is closer to the ground plane 317 than the surrounding portions of the sole 314 that are toeward and heelward of the inertia generator 360. In certain embodiments, the inertia generator 360 is angled so that a rear end of the inertia generator is toeward of a front end. An angle of the inertia generator relative to the y-axis may be in the range of 10 to 25 degrees, such as between 15 and 25 degrees, such as between 17 and 22 degrees. As illustrated in FIGS. 12A and 13, an aperture 366 may be provided within the center sole portion 362, which aperture may be used for introducing hot melt into the inner cavity of the golf club head. Also provided is an inertia generator support rib 368, which may run along the inside of the golf club head under inertia generator 360. Inertia generator support rib 368 may not only help provide structural support for the inertia generator, it may also help constrain any hot melt that is injected using aperture 366.

As best illustrated in FIGS. 10 and 13, the inertia generator further comprises a heelward sole surface 361 and a toeward sole surface 363 that slope upwardly from the center sole portion 362 to the sole 314 when viewed in the normal address position. The heelward sole surface 361 may have a generally triangular shape, with: a base that faces generally forward and heelward (and may be substantially parallel to the heel sole insert 344, a first edge adjacent the center sole portion 362 that extends rearwardly from the toeward end of the base generally parallel to the center sole portion, and a second edge that extends from the heelward end of the base at a position on the sole 314 to a position that is "raised up" from the sole at or proximate to the heelward side of the center sole portion 362 at the rear 332 of the golf club head. The toeward sole surface 363 may likewise have a generally triangular shape, with: a base that faces generally forward and toeward (and may be substantially parallel to the toe sole insert 348, a first edge adjacent the center sole portion 362 that extends rearwardly from the heelward end of the base generally parallel to the center sole portion, and a second edge that extends from the toeward end of the base at a position on the sole 314 to a position that is "raised up" from the sole at or proximate to the toeward side of the center sole portion 362 at the rear 332 of the golf club head.

The inertia generator is configured so that a center of gravity 365 may in certain embodiments be positioned toeward of the x axis and lower (or closer to the ground plane 317) than the z-axis. In other words, the inertia generator may help to move the club's overall center of gravity 350 toeward, while also lowering its center of gravity, reducing Zup, as described above.

Example values for the inertia generator's center of gravity 365 are set forth below. In certain embodiments, the inertia generator may have a center of gravity 365 relative to the center 323 of the striking surface 318 as measured on the:

x-axis ($CG_x$) of between −10 mm and −25 mm, such as between −15 mm and −20 mm;

y-axis ($CG_y$) of between 80 and 110 mm, such as between 90 and 100 mm; and z-axis ($CG_z$) of between 0 and −20 mm, such as between −10 mm and −20 mm.

Additionally, due to its shape and orientation, the inertia generator is configured to generally align with a typical swing path, permitting increased inertia generated during a golf swing. Example moments of inertia for golf club head 300 are set forth below.

F. Advantageous Moment of Inertia Properties

In some embodiments described herein, such as golf club head 300, one or more of the features described herein may contribute to a moment of inertia about a golf club head CG z-axis (Izz) that is greater than 300 $kg \cdot mm^2$, such as greater than 350 $kg \cdot mm^2$, greater than 400 $kg \cdot mm^2$, greater than 450 $kg \cdot mm^2$, or greater than 500 $kg \cdot mm^2$.

In some embodiments described herein, such as golf club head 300, a moment of inertia about a golf club head CG x-axis (Ixx) can be greater than 250 $kg \cdot mm^2$, such as greater than 300 $kg \cdot mm^2$, or greater than 350 $kg \cdot mm^2$.

G. Example Discretionary Mass

As described above, providing thin walls and/or the use of composite materials may permit the addition of discretionary mass in portions of the golf club head which may be selected to improve playability characteristics of the golf club head. For example, to generate increased inertia, it may be desirable to maximize the mass that is positioned within a given swing path to maximize inertia and/or to maximize mass lower to the ground plane in a golf club head to lower the center of gravity.

1. Front Mass Pad

As illustrated in FIG. 12A, golf club head may comprise a forward mass pad 380 positioned heelward and forward on the sole 314. This forward mass pad 380 may comprise steel, tungsten, or other suitable materials as further described herein, and may be integrally formed to the golf club head 300 using techniques such as molding, cold forming, casting, and/or forging. Alternatively, it may be attached to the other components by known means (e.g., adhesive bonding, welding, and the like). One potential embodiment of a forward mass pad 380 that may be utilized with any of the embodiments herein weighs between 10 grams and 50 grams, such as between 10 grams and 20 grams or between 20 grams and 40 grams.

Positioning forward mass pad 380 heelward may help offset the discretionary mass that is positioned toeward in the club, such as in the inertia generator. Additionally, "split mass" configurations such as those described herein potentially allow greater weight to be moved to the outside of the club head while minimizing the overall weight added to the club head.

Providing these spaced apart areas of mass (e.g., the mass pad 380 and inertia generator 360) may both help to maintain the center of gravity of the golf club head as close as possible to the geometric center, while also providing added weight along the perimeter of the golf club, which may have additional benefits for maximizing MOI, as further described herein.

2. Rear Removable Weight

Positioned on a rear side of the inertia generator 360 is inertia generator mass element 385, which may comprise a steel or tungsten weight member or other suitable material. Inertia generator mass element 385 may be removably affixed to the rear of the inertia generator 360 using a fastener port 386 that is positioned in the rear of the inertia generator 360 and configured to receive a fastener 388, which may be removably inserted through an aperture 387 in the inertia generator mass element 385 and into the fastener port 386. Fastener port 386 and aperture 387 may be threaded so that fastener 388 can be loosened or tightened either to allow movement of, or to secure in position, inertia generator mass element 385. The fastener may comprise a head with which a tool (not shown) may be used to tighten or loosen the fastener, and a body that may, e.g., be threaded to interact with corresponding threads on the fastener port 386 and aperture 387 to facilitate tightening or loosening the fastener 388.

The fastener port 386 can have any of a number of various configurations to receive and/or retain any of a number of fasteners, which may comprise simple threaded fasteners, such as described herein, or which may comprise removable weights or weight assemblies, such as described in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference herein.

Figure 24:
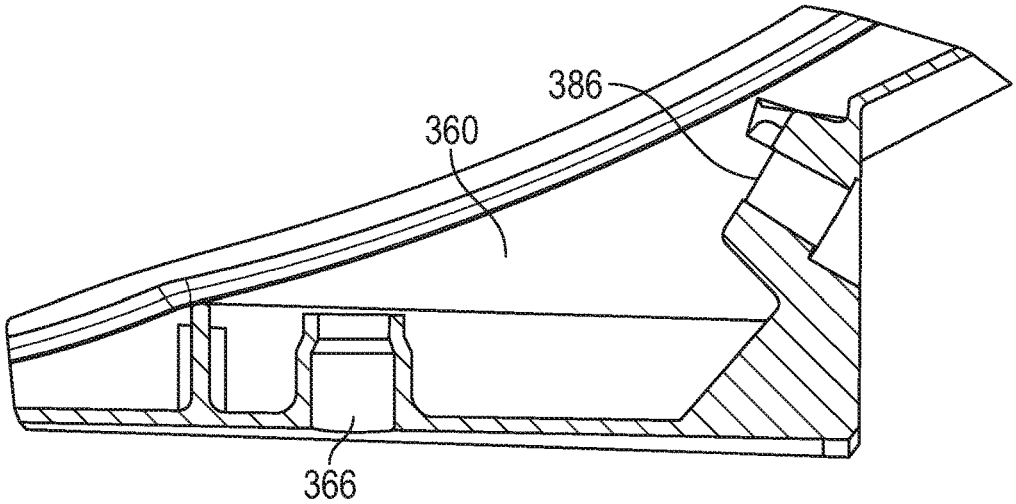
FIG. 24 is a cross-section view of an inertia generator in the golf club head of FIG. 8, taken along line 24-24 in FIG. 12A.
Figure 25:
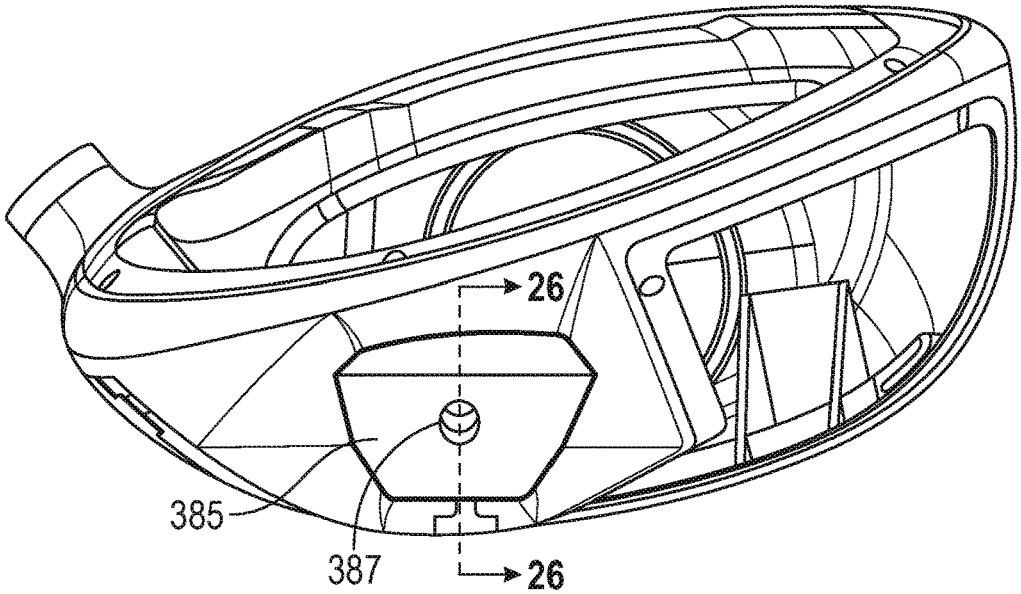
FIG. 25 is a rear view of the golf club head of FIG. 8, with crown and sole inserts removed.
Figure 26:
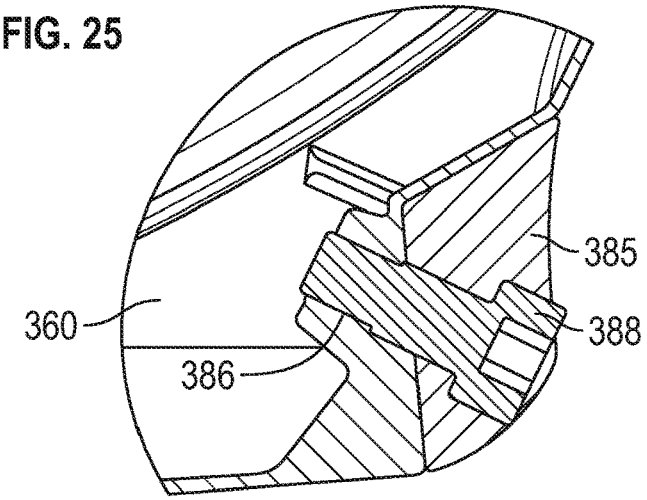
FIG. 26 is a cross-section view of a weight assembly on an inertia generator in the golf club head of FIG. 8, taken along line 26-26 in FIG. 25, showing a fastener inserted in the weight assembly.
Figure 27:
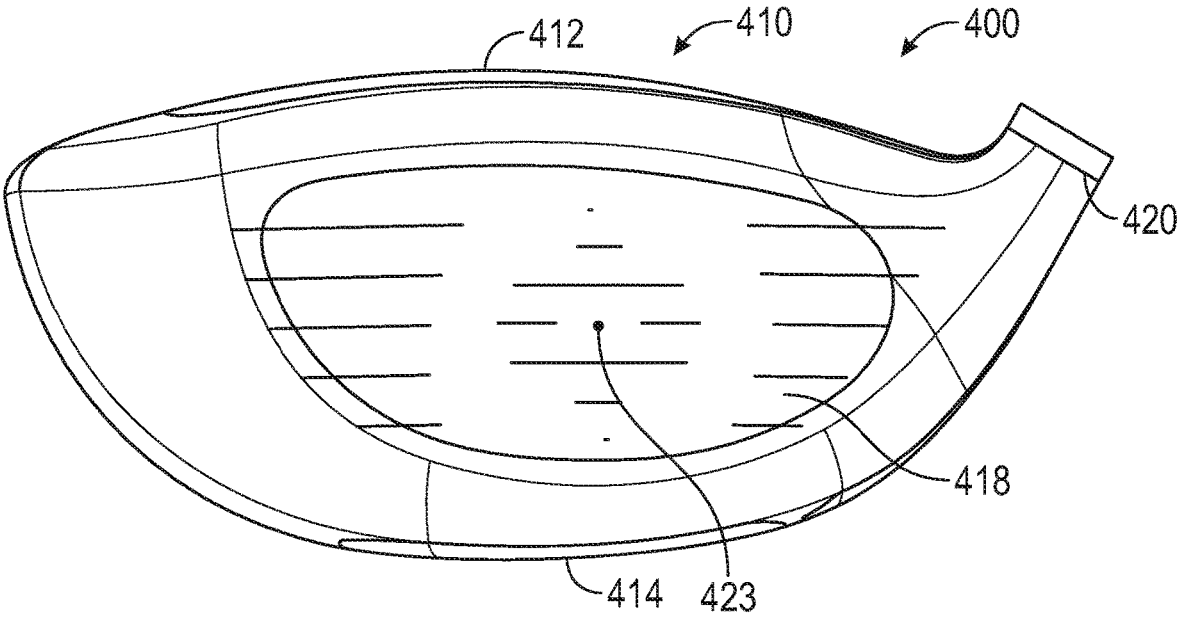
FIG. 27 is a front elevation view of another example embodiment of a golf club head.

As illustrated in FIGS. 24 and 26, fastener port 386 may be angled diagonally so that the fastener 388 is angled downward away from the crown 312 of the golf club head, and the fastener port is forward of a head of the fastener 388, which may provide a more secure attachment by "sandwiching" the portion of the inertia generator mass element 385 likely to have the greatest mass between the inertia generator 360 and the fastener 388. Alternatively, in other embodiments (not pictured) inertia generator mass element 385 may be either integrally formed or affixed to the inertia generator by bonding, gluing, brazing, or using one or more of the methods described herein and in the incorporated patents and applications.

One potential embodiment of an inertia generator mass element 385 that may be utilized with any of the embodiments herein weighs between 10 grams and 50 grams, such as between 10 grams and 30 grams or between 20 grams and 40 grams.

H. Front Channel

Figure 21:
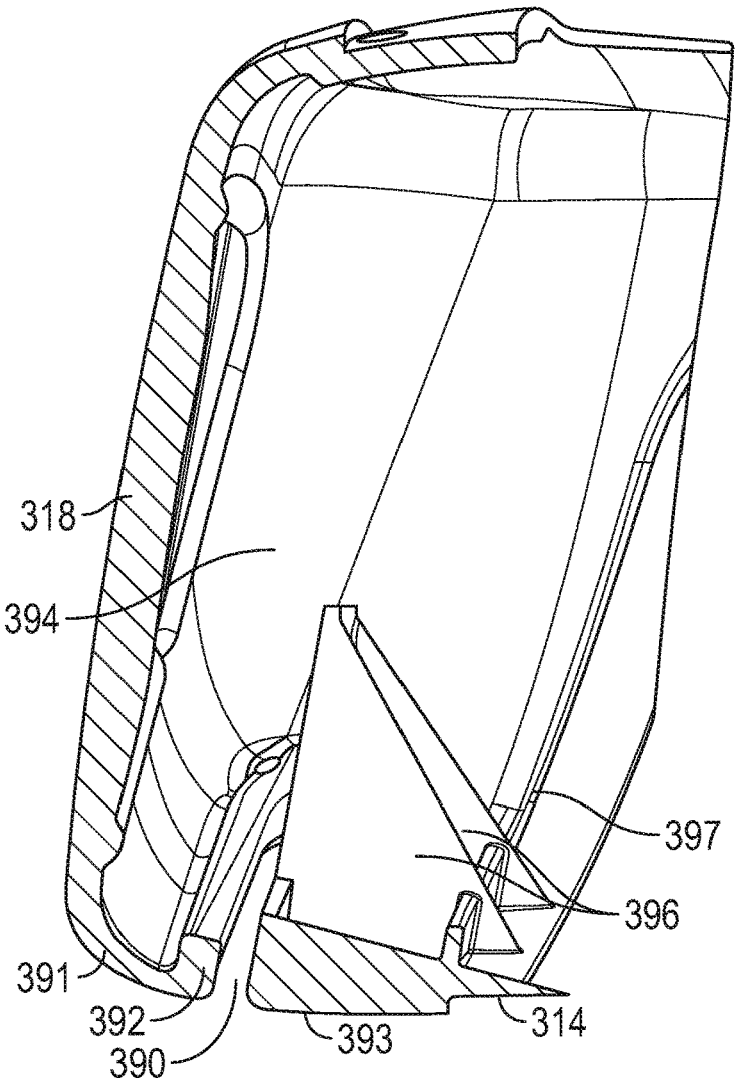
FIG. 21 is a heel side cross-sectional view of the front portion of the golf club head of FIG. 8.

Near the striking surface 318, a front channel 390 is formed in the sole 314. As illustrated in FIG. 21, the front channel 390 extends between a lip 392 formed below or behind a front ground contact surface 391 and an intermediate ground contact surface 393 into an interior cavity 394 of the golf club head 300. In some embodiments (not shown), the front channel 390 may comprise a slot that is raised up from the sole 314, but does not extend fully into the interior cavity 394. In some embodiments, the slot or channel may be provided with a slot or channel insert 395 to prevent dirt, grass, or other elements from entering the interior cavity 394 of the body 310 or from getting lodged in the slot or channel. The front channel 390 extends in a toe-heel direction across the sole, with a heelward end near the hosel 320 and an opposite toeward end. The front channel can improve coefficient of restitution across the striking face and can provide increased forgiveness on off-center ball strikes. For example, the presence of the front channel can expand zones of the highest COR across the face of the club, particularly at the bottom of the club face near the channel, so that a larger fraction of the face area has a COR above a desired value, especially at the lower regions of the face. More information regarding the construction and performance benefits of the front channel 390 and similar front channels can be found in U.S. Pat. Nos. 8,870,678; 9,707,457; and 9,700,763, and U.S. Patent Pub. No. 2016/0023063 A1, all of which are incorporated by reference herein in their entireties, and various of the other publications that are incorporated by reference herein.

Figure 12B:
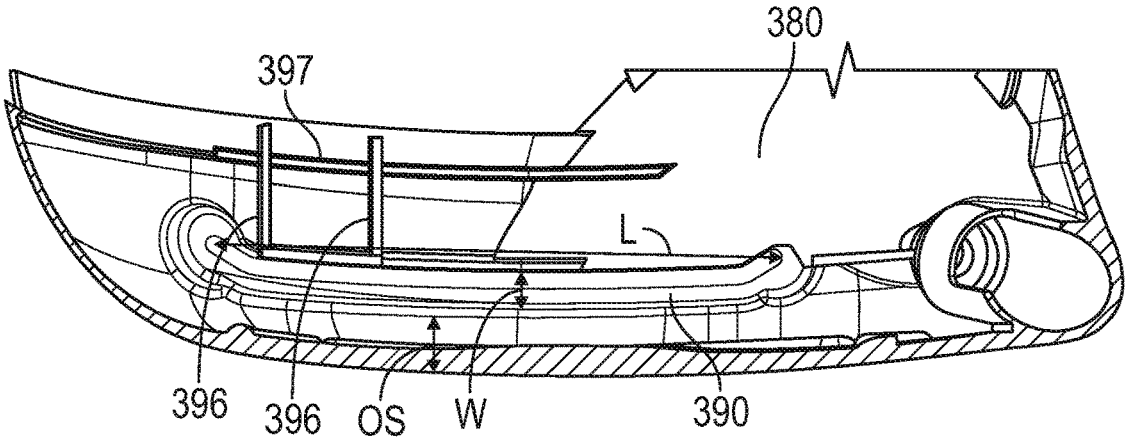
FIG. 12B is a top cross-sectional view of a front portion of the golf club head of FIG. 8.

As illustrated in FIG. 12B, one or more front channel support ribs 396 may be provided, which may run perpendicular to the front channel 390 to provide added support. Further support may be provided by an additional rib 397 that connects to front channel support ribs 396 to provide further stability to those ribs and the front channel, while also tying into the forward mass pad 380 to provide additional stability for the golf club head 300. As also illustrated, front channel 390 may have a certain length L (which may be measured as the distance between its toeward end and heelward end), width W (e.g., the measurement from a forward edge to a rearward edge of the front channel 390), and offset distance OS from the front end, or striking surface 318 (e.g., the distance between the face 318 and the forward edge of front channel 390. During development, it was discovered that the COR feature length L and the offset distance OS from the face play an important role in managing the stress which impacts durability, the sound or first mode frequency of the club head, and the COR value of the club head. All of these parameters play an important role in the overall club head performance and user perception.

During development, it was discovered that a ratio of COR feature length to the offset distance may be preferably greater than 4, and even more preferably greater than 5, and most preferably greater than 5.5. However, the ratio of COR feature length to offset distance also has an upper limit and is preferably less than 15, and even more preferably less than 14, and most preferably less than 13.5. For example, for a COR feature length of 30 mm the offset distance from the face would preferably be less than 7.5 mm, and even more preferably 6 mm or less from the face. Additional disclosure about the relationship between COR feature length and offset, and related effects are provided in co-pending U.S. patent application Ser. No. 15/859,071, the entire contents of which are hereby incorporated by reference.

The offset distance is highly dependent on the slot length. As slot length increases so do the stresses in the club head, as a result the offset distance must be increased to manage stress. Additionally, as slot length increases the first mode frequency is negatively impacted.

I. Recessed Port for Shaft Attachment

Figure 20:
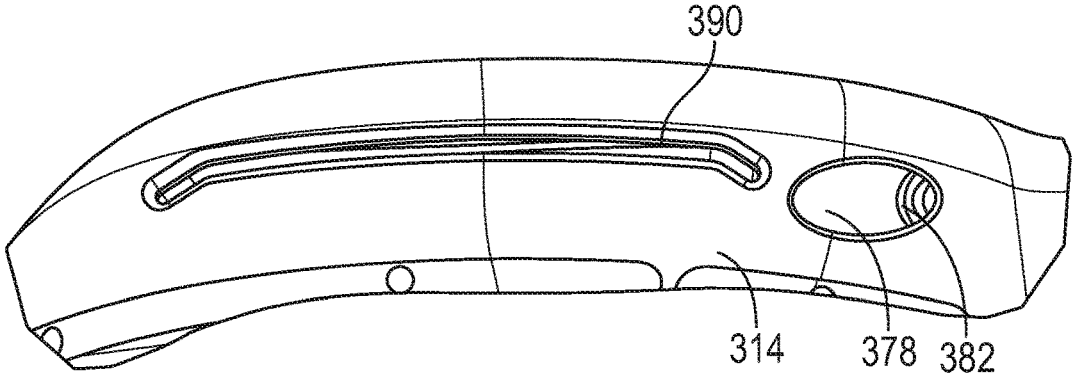
FIG. 20 is a bottom view of a portion of a sole of the golf club head of FIG. 8.

As illustrated in FIGS. 8 and 15, the golf club head's hosel 320 has a hosel bore 324 that may accommodate a shaft connection assembly 355 that allows the shaft to be easily disconnected from the golf club head, and that may provide the ability for the user to selectively adjust a and/or lie-angle of the golf club. The shaft connection assembly 355 may comprise a shaft sleeve that can be mounted on the lower end portion of a shaft (not pictured), as described in U.S. Pat. No. 8,303,431. A recessed port 378 is provided on the sole 314, and extends from the sole 314 toward the hosel 320, and in particular the hosel bore 324. The hosel bore 324 extends from the hosel 320 through the golf club head 310 and opens within the recessed port 378 at the sole 314 of the golf club head 300. As illustrated in FIG. 20, the hosel bore may contain threads 382 that are configured to interact with a fastener such as a screw, ad further described herein.

The golf club head is removably attached to the shaft by shaft connection assembly 355 (which is mounted to the lower end portion of a golf club shaft (not shown)) by inserting one end of the shaft connection assembly 355 into the hosel bore 324, and inserting a screw 379 (or other suitable fixation device) upwardly through the recessed port 378 in the sole 314 and, in the illustrated embodiment, tightening the screw 379 into a threaded opening of the shaft connection assembly 355, thereby securing the golf club head to the shaft sleeve 302. A screw capturing device, such as in the form of an O-ring or washer 381, can be placed on the shaft of the screw 379 to retain the screw in place within the golf club head when the screw is loosened to permit removal of the shaft from the golf club head.

In the embodiment shown in FIGS. 13-16, the mouth of the recessed port 378 in the sole 314 is generally oval-shaped, although the shape and size of the recessed port 378 may be different in alternative embodiments.

Further in certain embodiments, the golf club head may also incorporate features that provide the golf club heads and/or golf clubs with the ability not only to replaceably connect the shaft to the head but also to adjust the loft and/or the lie angle of the club by employing a removable head-shaft connection assembly. Such an adjustable lie/loft connection assembly is described in more detail in U.S. Pat. Nos. 8,025,587; 8,235,831; 8,337,319; 8,758,153; 8,398,503; 8,876,622; 8,496,541; and 9,033,821, the entire contents of which are incorporated in their entirety by reference herein.

In certain embodiments, the golf club head may be attached to the shaft via a removable head-shaft connection assembly as described in more detail in U.S. Pat. No. 8,303,431, the entire contents of which are incorporated by reference herein. As described in more detail therein, inserting a shaft sleeve at different angular positions relative to a hosel insert is effective to adjust the shaft loft and/or the lie angle. For example, the loft angle may be increased or decreased by various degrees, depending on the angular position, such as +/−1.5 degrees, +/−2.0 degrees, or +/−2.5 degrees. Other loft and/or lie angle adjustments are also possible.

J. CT Tuning Features

A golf club head Characteristic Time (CT) can be described as a numerical characterization of the flexibility of a golf club head striking face. The CT may also vary at points distant from the center of the striking face, but may not vary greater than approximately 20% of the CT as measured at the center of the striking face. The CT values for the golf club heads described in the present application were calculated based on the method outlined in the USGA "Procedure for Measuring the Flexibility of a Golf Clubhead," Revision 2.0, Mar. 25, 2005, which is incorporated by reference herein in its entirety. Specifically, the method described in the sections entitled "3. Summary of Method," "5. Testing Apparatus Set-up and Preparation," "6. Club Preparation and Mounting," and "7. Club Testing" are example sections that are relevant. Specifically, the characteristic time is the time for the velocity to rise from 5% of a maximum velocity to 95% of the maximum velocity under the test set forth by the USGA as described above.

Figure 22:
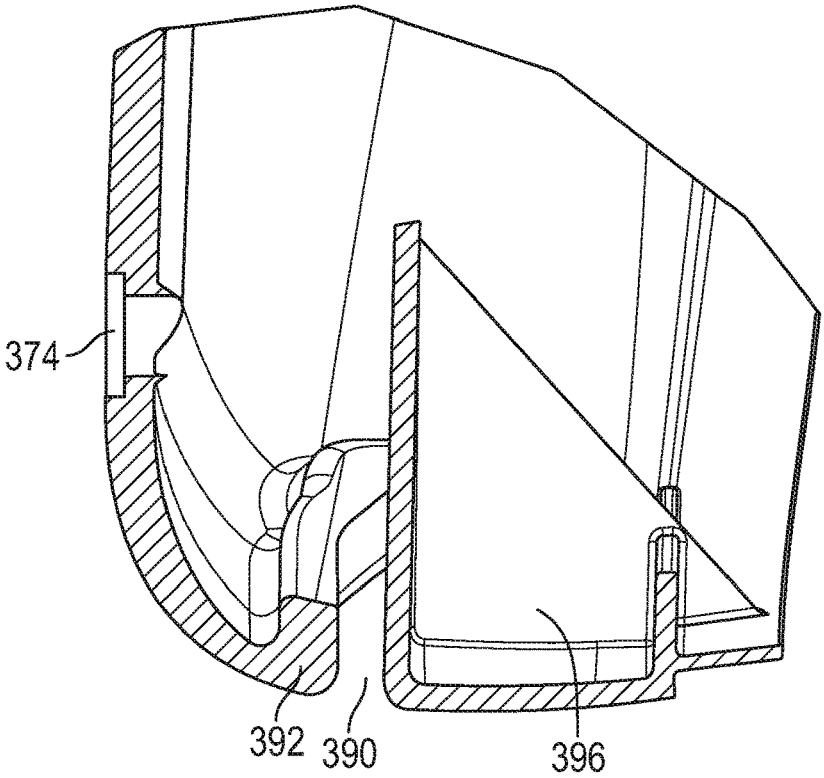
FIG. 22 is another heel side cross-sectional view of the front portion of the golf club head of FIG. 8.
Figure 23:
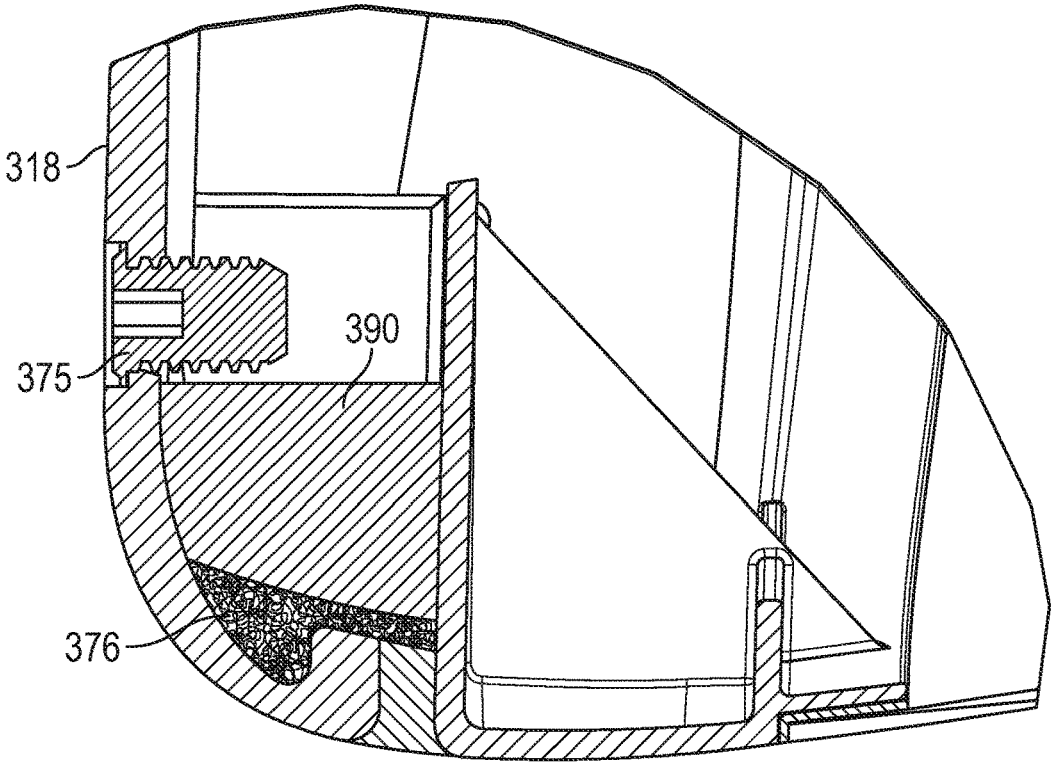
FIG. 23 is another heel side cross-sectional view of the front portion of the golf club head of FIG. 8, illustrating the addition of additional tuning features.

As best illustrated in FIGS. 15, 22, and 23, a plurality of characteristic time ("CT") tuning screws 375 may be inserted through apertures 374 in the striking surface. Dampening material such as tuning foam 376 may be inserted through one or both of these apertures into the inner cavity 394 of the golf club head 300 to adjust the characteristic time. For example, a dampening material may be added that, upon hardening, may lower the CT time. Additional details about providing tuning of the characteristic time are provided in U.S. patent application Ser. No. 15/857,407, filed Dec. 28, 2017, the entire contents are hereby incorporated by reference herein.

K. Twist Face

One or more of the golf club heads disclosed herein may also incorporate "twist face" technology, which may provide a striking surface that is "twisted," to assist, in particular, with "miss-hit" shots that are not impacted at the center of the face. Additional details about providing golf club heads employing "twist face" technology are provided in U.S. Pat. No. 9,814,944, the entire contents are hereby incorporated by reference herein.

III. A Second Example Golf Club Head

FIGS. 27-33 illustrate another example golf club head 400 that is similar to golf club head 300. Golf club head 400 may incorporate one or more of the features of golf club heads 300 and 500 described above and below, respectively, along with one or more additional discretionary mass elements, which may be added to or in place of one or more of the features of golf club heads 300 or 500, including as further described herein.

Golf club head 400 includes a hollow body 410 defining a crown portion 412, a skirt portion (not shown), a sole portion 414, and a striking surface 418. The striking surface 418 can be integrally formed with the body 410 or attached to the body. The body 410 further includes a hosel 420, which is adapted to receive a golf club shaft. The body 410 further includes a heel portion 426, a toe portion 428, a front portion 430, and a rear portion 432. Included are a number of features that may improve playability, including at least an inertia generator 460, front channel 490, as well as composite panels on the sole 444, 448 and on the crown 435, along with discretionary mass elements, such as a front weight channel 480 in which a front weight assembly 482 may be positioned, and a rear weight channel 470 positioned within the inertia generator 460 into which a rear weight assembly 472 may be inserted, as further described below, and other additional features, as will be further described herein A. Slidable Front Weight Assembly In the embodiments shown in FIGS. 27-33, club head 400 is provided with an elongated channel 480 on a sole 414 that extends generally from a heel end 486 oriented toward a heel portion of the golf club head 426 to a toe end 488 oriented toward a toe portion of the golf club head 428. A front ledge 481 and a rear ledge 483 are located within the channel 480 and extend from the channel's forward and rearward walls, respectively. A weight assembly 482 may be slidably retained within the weight channel, and may be retained be securing it on the front and rear ledges 481, 483 within the channel 480, such as by having a first portion of the weight assembly 482 positioned above (e.g., closer to a crown portion 412 of the golf club head) the front and rear ledges 481, 483 and a second portion of the weight assembly 482 below (e.g., closer to the sole portion 414 of the golf club head) the front and rear ledges 481, 483. The weight assembly is slidably repositionable such that it can be moved between a plurality of selected positions between the heel and toe ends of the channel, which may in turn adjust the center of gravity of the golf club head, particularly along the x-axis. In certain embodiments, at least three selectable positions are available, while in other embodiments, at least five positions, at least ten positions, or more positions are available. In some embodiments, as illustrated in FIG. 28, one or more indicators 485 may be included, e.g., on the sole 414 of the golf club head to indicate the relative position of the slidable weight assembly 482.

Figure 28:
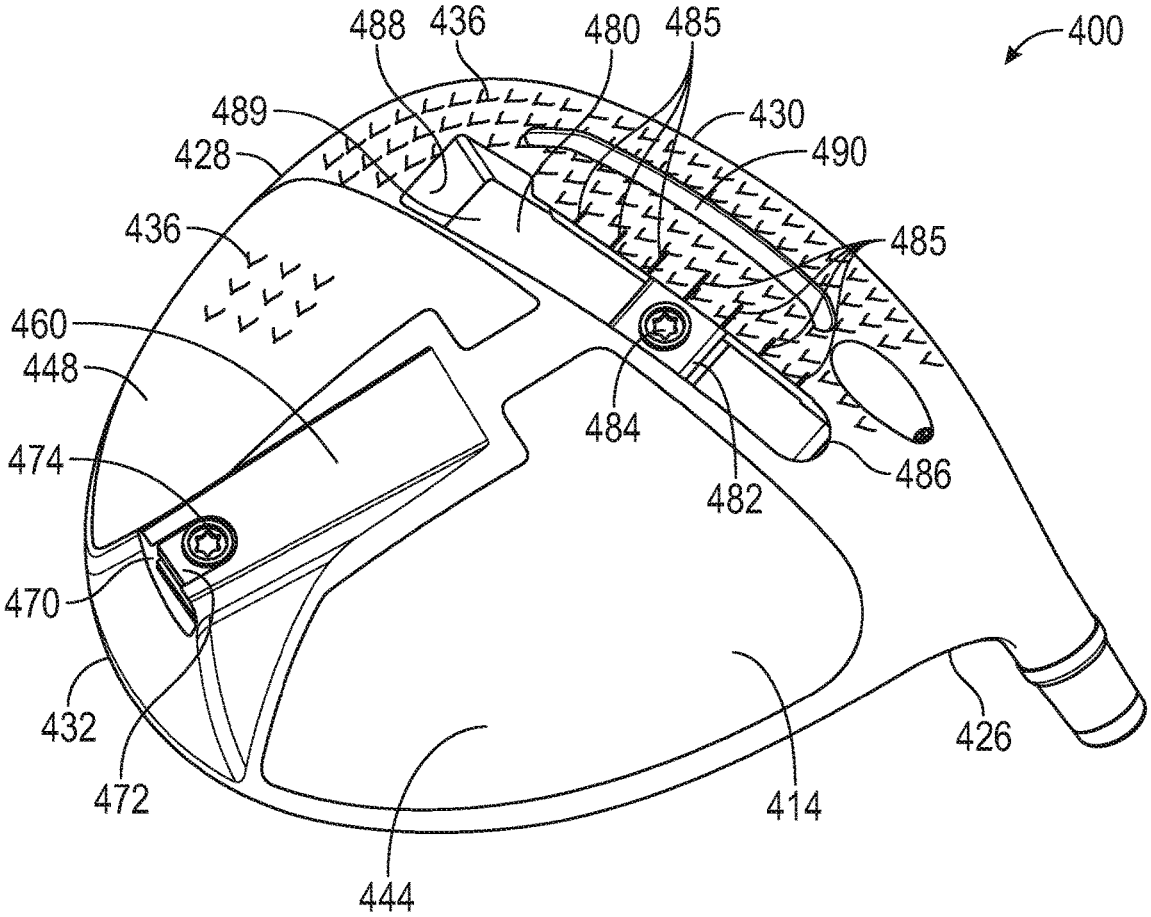
FIG. 28 is a is a bottom perspective view from a heel side of the golf club head of FIG. 27.

As illustrated in FIG. 28, the elongated channel may provide an enlarged cavity 489 for introducing the weight assembly 482 into the channel and/or for removing or replacing the weight assembly 482. The weight assembly may also be provided with a fastener 484 to connect a first portion and a second portion of the weight assembly. In some embodiments, tightening the fastener 484 may bring first and second portions of the weight assembly 482 together to "sandwich" the front and rear ledges 481, 483 to secure the weight assembly 482 in a desired position within the channel 480. In other embodiments, the fastener 484 may be utilized to secure the weight assembly 482 to the body 410 of the golf club head itself. In some embodiments, the fastener 484 may be integrally connected with the weight assembly 482, while in other embodiments, it may be a separate piece, and e.g., threadably connected to the weight assembly 482. Additional disclosure regarding additional suitable potential methods and apparatus for fastening the weight assembly 482 are provided elsewhere herein and in the incorporated patents and applications, In the embodiments shown in the figures, the channel 480 is substantially straight within the X-Y plane (see, e.g., FIG. 31), and generally tracks the curvature of the sole 414 within the X-Z and Y-Z planes (see, e.g., FIG. 31). The channel 480 is located in a forward region of the sole 414, i.e., toward the front portion 430 of the club head. For example, in some embodiments, the entire channel 480 is located in a forward 50% region of the sole 414, such as in a forward 40% region of the sole 414, such as in a forward 30% region of the sole 414. The referenced forward regions of the sole are defined in relation to an imaginary vertical plane that intersects an imaginary line extending between the center of the striking surface 418 and the rearward-most point on the rear portion 432 of the club head. The imaginary line is assigned a length, L. Accordingly, the forward 50% region of the sole is the region of the sole 414 located toward the front portion 430 of the club head relative to the imaginary vertical plane where the imaginary vertical plane is located at a distance of 0.5*L from the center 423 of the striking surface 418. The forward 40% region of the sole is the region of the sole 414 located toward the front portion 430 of the club head relative to the imaginary vertical plane where the imaginary vertical plane is located at a distance of 0.4*L from the center 423 of the striking surface 418. The forward 30% region of the sole is the region of the sole 414 located toward the front portion 430 of the club head relative to the imaginary vertical plane where the imaginary vertical plane is located at a distance of 0.3*L from the center 423 of the striking surface 418.

In the embodiments shown, the distance between a first vertical plane passing through the center of the striking surface 418 and a second vertical plane that bisects the channel 480 at the same x-coordinate as the center 423 of the striking surface 418 is between about 15 mm and about 50 mm, such as between about 20 mm and about 40 mm, such as between about 25 mm and about 30 mm. In the embodiments shown, the width of the channel (i.e., the horizontal distance between the front channel wall and rear channel wall adjacent to the locations of front ledge 481 and rear ledge 483) may be between about 8 mm and about 20 mm, such as between about 10 mm and about 18 mm, such as between about 12 mm and about 16 mm. In the embodiments shown, the depth of the channel may be between about 6 mm and about 20 mm, such as between about 6 mm and about 15 mm, such as between about 7 mm and about 14 mm. In the embodiments shown, the length of the channel (i.e., the horizontal distance between the heel end 486 of the channel and the toe end 488 of the channel) may be between about 30 mm and about 120 mm, such as between about 50 mm and about 100 mm, such as between about 60 mm and about 90 mm.

Figure 29:
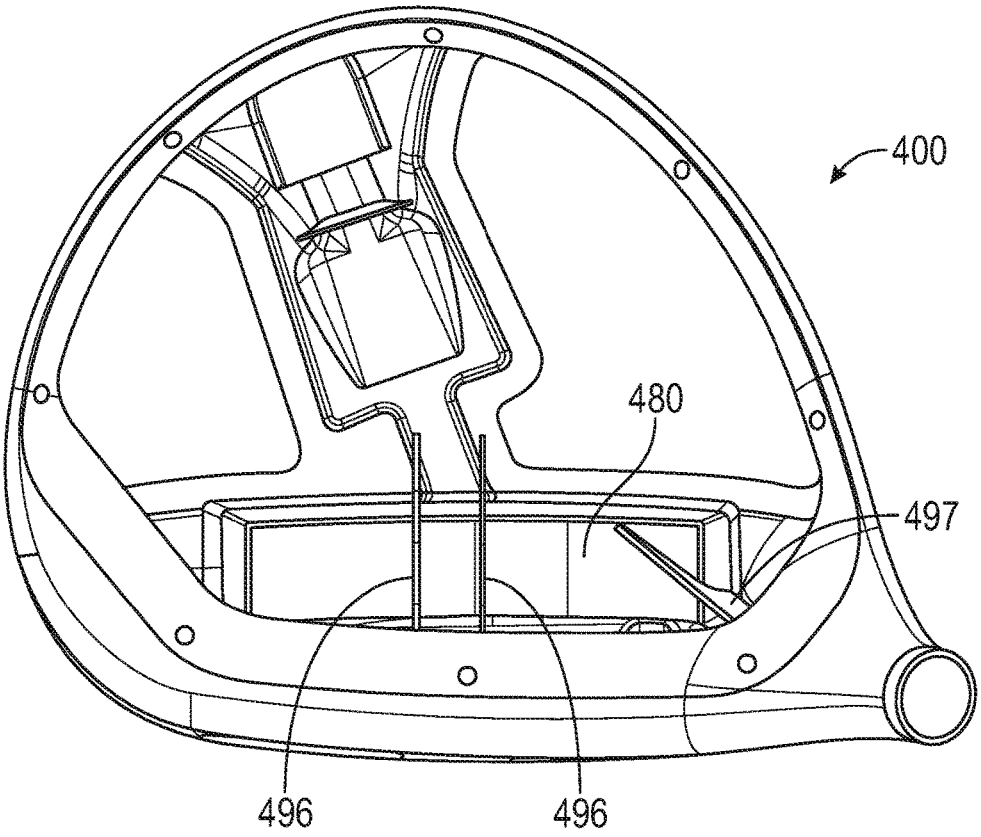
FIG. 29 is a top view of the golf club head of FIG. 27, with a crown insert removed.
Figure 30:
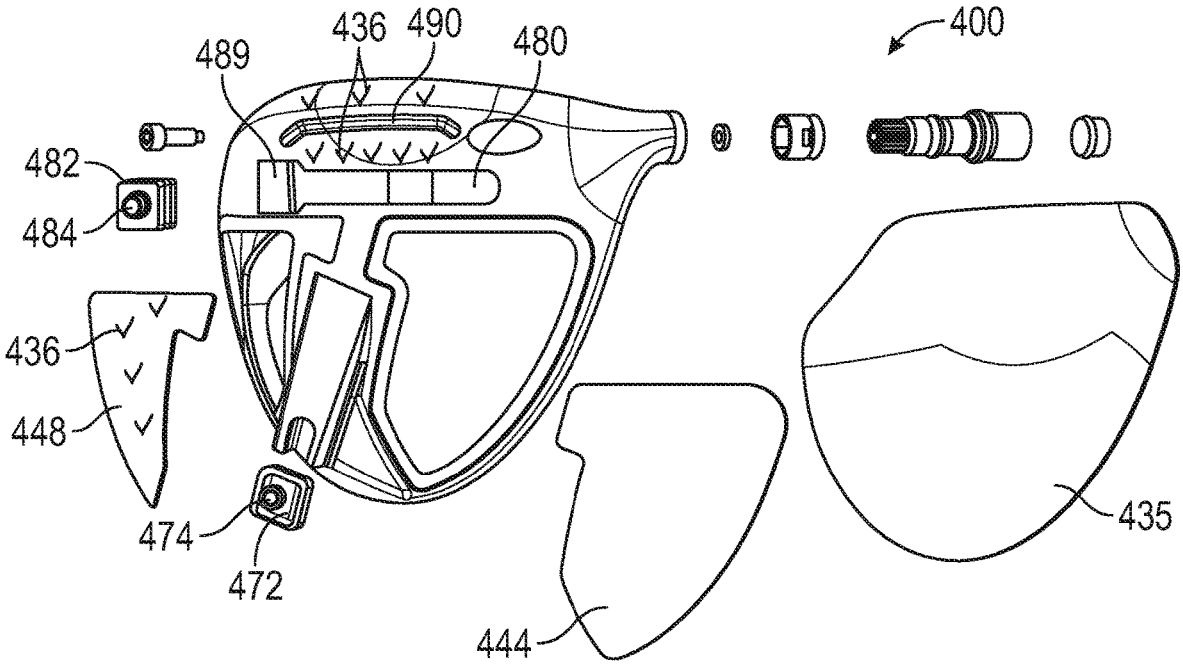
FIG. 30 an exploded perspective view of the golf club head of FIG. 27.
Figure 31:
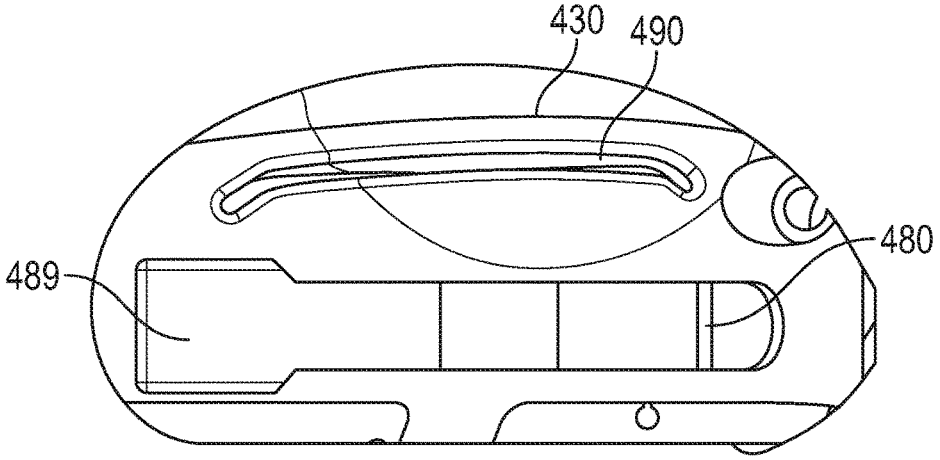
FIG. 31 is a bottom view of a portion of the sole of the golf club head of FIG. 27.
Figure 32:
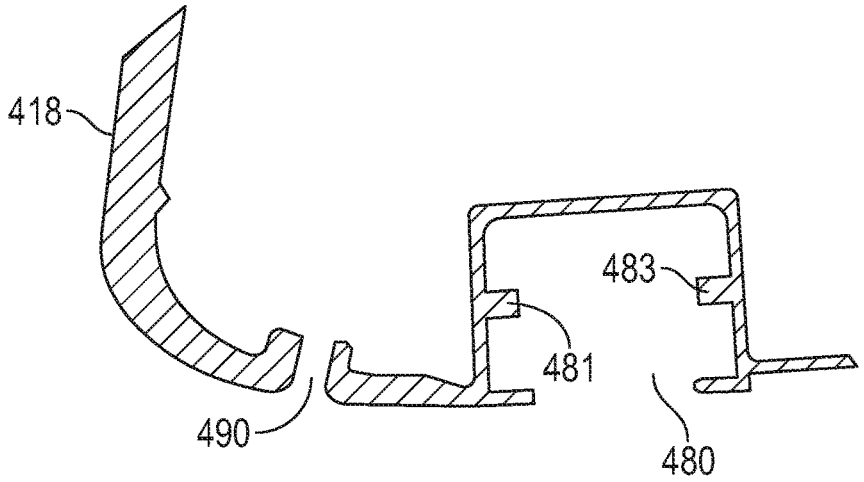
FIG. 32 is a cross-section view of a front portion of the golf club head of FIG. 27, illustrating a front channel and a front weight track.
Figure 33:
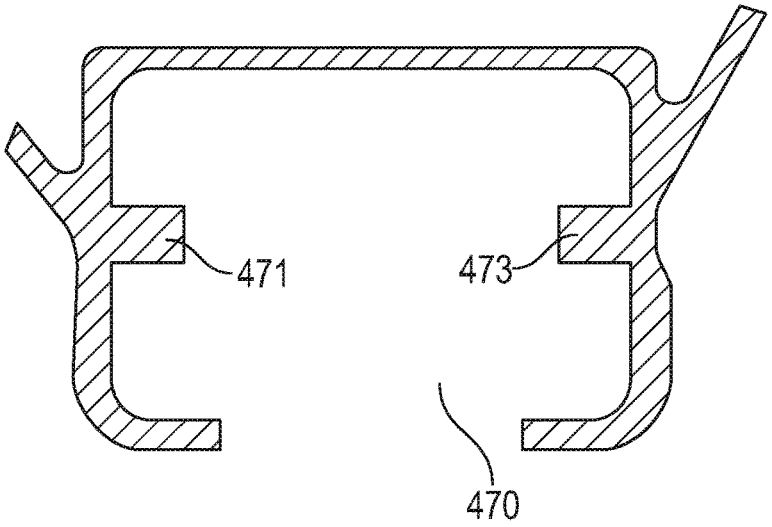
FIG. 33 is a cross-section view of the inertia generator of FIG. 28 in the golf club head of FIG. 27, illustrating an aperture into which a rear weight assembly may be inserted.

As illustrated in FIG. 29, one or more weight channel support ribs 496 may be provided, which may run perpendicular to the front weight channel 480 to provide added support. Further support may be provided by an additional rib 497 that is positioned adjacent the hosel of the golf club head to provide additional stability for the golf club head 300.

B. Rear Weight Assembly

In the embodiments shown in FIGS. 27-33, inertia generator 460 is provided with a rear weight channel 470 positioned adjacent the rear end 432 of the golf club head. A heel ledge 471 and a toe ledge 473 are located within the channel 480 and extend from the channel's heelward and toeward walls, respectively. A rear weight assembly 472 may be retained within the weight channel, and may be retained be securing it on the heel ledge 471 and toe ledge 473 within the channel 470, such as by having a first portion of the rear weight assembly 472 positioned above (e.g., closer to a crown portion 412 of the golf club head) the heel ledge 471 and toe ledge 473 and a second portion of the weight assembly 472 below (e.g., closer to the sole portion 414 of the golf club head) the heel ledge 471 and toe ledge 473. The rear weight assembly 472 may also be provided with a fastener 474 to connect a first portion and a second portion of the weight assembly. In some embodiments, tightening the fastener 474 may bring first and second portions of the weight assembly 472 together to "sandwich" the heel ledge 471 and toe ledge 473 to secure the rear weight assembly 472 within the channel 470. In other embodiments, the fastener 474 may be utilized to secure the rear weight assembly 472 to the body 410 of the golf club head itself. In some embodiments, the fastener 474 may be integrally connected with the weight assembly 472, while in other embodiments, it may be a separate piece, and e.g., threadably connected to the rear weight assembly 472. Additional disclosure regarding additional suitable potential methods and apparatus for fastening the rear weight assembly 472 are provided elsewhere herein and in the incorporated patents and applications.

Additionally, rear weight assembly 472 may be configured so that it can be removed and positioned within the front channel 480 to provide additional weight forward within the golf club head, as desired.

In the embodiments shown, the width of the channel (i.e., the horizontal distance between the heel channel wall and toe channel wall adjacent to the locations of the heel ledge 471 and toe ledge 473 may be between about 8 mm and about 20 mm, such as between about 10 mm and about 18 mm, such as between about 12 mm and about 16 mm. In the embodiments shown, the depth of the channel may be between about 6 mm and about 20 mm, such as between about 6 mm and about 15 mm, such as between about 7 mm and about 14 mm.

C. Design Parameters for Slidably Repositionable Weight (s)

Although the following discussion cites features related to golf club head 400, the many design parameters discussed below substantially apply to the other disclosed golf club heads sharing common features, as described herein. With that in mind, in some embodiments of the golf clubs described herein, the location, position or orientation of features of the golf club head, such as the golf club heads 300, 400, and 500, can be referenced in relation to fixed reference points, e.g., a golf club head origin, other feature locations or feature angular orientations. The location or position of a weight or weight assembly, such as mass pad 380, inertia generator mass element 385, front and rear weight assemblies 482, 472, front weight member 582, and inertia generator mass element 585, is typically defined with respect to the location or position of the weight's or weight assembly's center of gravity. When a weight or weight assembly is used as a reference point from which a distance, i.e., a vectorial distance (defined as the length of a straight line extending from a reference or feature point to another reference or feature point) to another weight or weight assembly location is determined, the reference point is typically the center of gravity of the weight or weight assembly.

The location of a weight or weight assembly on a golf club head can be approximated by its coordinates on the head origin coordinate system, as described above. As described above, in some of the embodiments of the golf club head 400 described herein, the front weight channel 480 extends generally from a heelward end 486 oriented toward the heel side of the golf club head to a toeward end 488 oriented toward the toe side of the golf club head, with both the heelward end 486 and toeward end 488 being at or near the same distance from the front portion of the club head. As a result, in these embodiments, the front weight assembly 482 that is slidably retained within the weight channel 480 is capable of a relatively large amount of adjustment in the direction of the x-axis, while having a relatively small amount of adjustment in the direction of the y-axis. In some alternative embodiments, the heelward end 486 and toeward end 488 may be located at varying distances from the front portion, such as having the heelward end 486 further rearward than the toeward end 488, or having the toeward end 488 further rearward than the heelward end 486. In these alternative embodiments, the front weight assembly 482 that is slidably retained within the weight channel 480 is capable of a relatively large amount of adjustment in the direction of the x-axis, while also having from a small amount to a larger amount of adjustment in the direction of the y-axis.

For example, in some embodiments of a golf club head 400 having a front weight assembly 482 that is adjustably positioned within a weight channel 480, the front weight assembly 482 can have an origin x-axis coordinate between about −40 mm and about 40 mm, depending upon the location of the weight assembly within the weight channel 480. In specific embodiments, the front weight assembly 482 can have an origin x-axis coordinate between about −35 mm and about 35 mm, or between about −30 mm and about 30 mm, or between about −25 mm and about 25 mm, or between about −20 mm and about 20 mm, or between about −15 mm and about 15 mm, or between about −13 mm and about 13 mm. Thus, in some embodiments, the front weight assembly 482 is provided with a maximum x-axis adjustment range (Max Δx) that is less than 80 mm, such as less than 70 mm, such as less than 60 mm, such as less than 50 mm, such as less than 40 mm, such as less than 30 mm, such as less than 26 mm.

On the other hand, in some embodiments of the golf club head 400 having a front weight assembly 482 that is adjustably positioned within a weight channel 480, the front weight assembly 482 can have an origin y-axis coordinate between about 5 mm and about 80 mm. More specifically, in certain embodiments, the front weight assembly 482 can have an origin y-axis coordinate between about 5 mm and about 50 mm, between about 5 mm and about 45 mm, or between about 5 mm and about 40 mm, or between about 10 mm and about 40 mm, or between about 5 mm and about 35 mm. Additionally or alternatively, in certain embodiments, the front weight assembly 482 can have an origin y-axis coordinate between about 35 mm and about 80 mm, between about 45 mm and about 75 mm, or between about 50 mm and about 70 mm. Thus, in some embodiments, the weight member 480 is provided with a maximum y-axis adjustment range (Max Δy) that is less than 45 mm, such as less than 30 mm, such as less than 20 mm, such as less than 10 mm, such as less than 5 mm, such as less than 3 mm. Additionally or alternatively, in some embodiments having a rearward channel, the weight member is provided with a maximum y-axis adjustment range (Max Δy) that is less than 110 mm, such as less than 80 mm, such as less than 60 mm, such as less than 40 mm, such as less than 30 mm, such as less than 15 mm.

In some embodiments, a golf club head can be configured to have a constraint relating to the relative distances that the weight assembly can be adjusted in the origin x-direction and origin y-direction. Such a constraint can be defined as the maximum y-axis adjustment range (Max Δy) divided by the maximum x-axis adjustment range (Max Δx). According to some embodiments, the value of the ratio of (Max Δy)/(Max Δx) is between 0 and about 0.8. In specific embodiments, the value of the ratio of (Max Δy)/(Max Δx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01.

As discussed above, in some driver-type golf club head embodiments, the mass of the weight member, e.g. front weight assembly 482 or rear weight assembly 472, is between about 1 g and about 50 g, such as between about 3 g and about 40 g, such as between about 5 g and about 25 g. In some alternative embodiments, the mass of the front weight assembly 482 or rear weight assembly 472 is between about 5 g and about 45 g, such as between about 9 g and about 35 g, such as between about 9 g and about 30 g, such as between about 9 g and about 25 g.

In some embodiments, a golf club head can be configured to have constraints relating to the product of the mass of the weight assembly and the relative distances that the weight assembly can be adjusted in the origin x-direction and/or origin y-direction. One such constraint can be defined as the mass of the weight assembly ($M_{WA}$) multiplied by the maximum x-axis adjustment range (Max Δx). According to some embodiments, the value of the product of $M_{WA}$×(Max Δx) is between about 250 g·mm and about 4950 g·mm. In specific embodiments, the value of the product of $M_{WA}$×(Max Δx) is between about 500 g·mm and about 4950 g·mm, or between about 1000 g·mm and about 4950 g·mm, or between about 1500 g·mm and about 4950 g·mm, or between about 2000 g·mm and about 4950 g·mm, or between about 2500 g·mm and about 4950 g·mm, or between about 3000 g·mm and about 4950 g·mm, or between about 3500 g·mm and about 4950 g·mm, or between about 4000 g·mm and about 4950 g·mm.

According to some embodiments, the value of the product of $M_{WA}$×(Max Δx) is between about 250 g·mm and about 2500 g·mm. In specific embodiments, the value of the product of $M_{WA}$×(Max Δx) is between about 350 g·mm and about 2400 g·mm, or between about 750 g·mm and about 2300 g·mm, or between about 1000 g·mm and about 2200 g·mm, or between about 1100 g·mm and about 2100 g·mm, or between about 1200 g·mm and about 2000 g·mm, or between about 1200 g·mm and about 1950 g·mm, or between about 1250 g·mm and about 1900 g·mm, or between about 1250 g·mm and about 1750 g·mm.

Another constraint relating to the product of the mass of the weight assembly and the relative distances that the weight assembly can be adjusted in the origin x-direction and/or origin y-direction can be defined as the mass of the weight assembly ($M_{WA}$) multiplied by the maximum y-axis adjustment range (Max Δy). According to some embodiments, the value of the product of $M_{WA}$×(Max Δy) is between about 0 g·mm and about 1800 g·mm. In specific embodiments, the value of the product of $M_{WA}$×(Max Δy) is between about 0 g·mm and about 1500 g·mm, or between about 0 g·mm and about 1000 g·mm, or between about 0 g·mm and about 500 g·mm, or between about 0 g·mm and about 250 g·mm, or between about 0 g·mm and about 150 g·mm, or between about 0 g·mm and about 100 g·mm, or between about 0 g·mm and about 50 g·mm, or between about 0 g·mm and about 25 g·mm.

As noted above, one advantage obtained with a golf club head having a repositionable weight, such as the golf club head 400 having the front weight assembly 482, is in providing the end user of the golf club with the capability to adjust the location of the CG of the club head over a range of locations relating to the position of the repositionable weight. In particular, the present inventors have found that there is a distance advantage to providing a center of gravity of the club head that is lower and more forward relative to comparable golf clubs that do not include a weight assembly such as the forward front weight assembly 482 described herein.

In some embodiments, the golf club head 400 has a CG with a head origin x-axis coordinate (CGx) between about −10 mm and about 10 mm, such as between about −4 mm and about 9 mm, such as between about −3 mm and about 8 mm, such as between about −2 mm to about 5 mm, such as between about −0.8 mm to about 8 mm, such as between about 0 mm to about 8 mm. In some embodiments, the golf club head 400 has a CG with a head origin y-axis coordinate (CGy) greater than about 15 mm and less than about 50 mm, such as between about 22 mm and about 43 mm, such as between about 24 mm and about 40 mm, such as between about 26 mm and about 35 mm. In some embodiments, the golf club head 100 has a CG with a head origin z-axis coordinate (CGz) greater than about −8 mm and less than about 3 mm, such as between about −6 mm and about 0 mm. In some embodiments, the golf club head 100 has a CG with a head origin z-axis coordinate (CGz) that is less than 0 mm, such as less than −2 mm, such as less than −4 mm, such as less than −5 mm, such as less than −6 mm.

As described herein, by repositioning the forward front weight assembly 482 within the weight channel 480 of the golf club head 400, the location of the CG of the club head is adjusted. For example, in some embodiments of a golf club head 400 having a forward front weight assembly 482 that is adjustably positioned within a weight channel 480, the club head is provided with a maximum CGx adjustment range (Max ΔCGx) attributable to the repositioning of the front weight assembly 482 that is greater than 1 mm, such as greater than 2 mm, such as greater than 3 mm, such as greater than 4 mm, such as greater than 5 mm, such as greater than 6 mm, such as greater than 8 mm, such as greater than 10 mm, such as greater than 11 mm.

Moreover, in some embodiments of the golf club head 400 having a forward front weight assembly 482 that is adjustably positioned within a weight channel 480, the club head is provided with a CGy adjustment range (Max ΔCGy) that is less than 6 mm, such as less than 3 mm, such as less than 1 mm, such as less than 0.5 mm, such as less than 0.25 mm, such as less than 0.1 mm.

In some embodiments, a golf club head can be configured to have a constraint relating to the relative amounts that the CG is able to be adjusted in the origin x-direction and origin y-direction. Such a constraint can be defined as the maximum CGy adjustment range (Max ΔCGy) divided by the maximum CGx adjustment range (Max ΔCGx). According to some embodiments, the value of the ratio of (Max ΔCGy)/(Max ΔCGx) is between 0 and about 0.8. In specific embodiments, the value of the ratio of (Max ΔCGy)/(Max ΔCGx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01. In some embodiments, a golf club head can be configured such that only one of the above constraints apply. In other embodiments, a golf club head can be configured such that more than one of the above constraints apply. In still other embodiments, a golf club head can be configured such that all of the above constraints apply.

The distance between weight channels/weight ports and weight size can contribute to the amount of CG change made possible in a golf club head, particularly in a golf club head used in conjunction with a removable sleeve assembly, as described above.

In some example embodiments of a golf club head having two, three, or more weights, a maximum weight mass multiplied by the distance between the maximum weight and the minimum weight is between about 100 g·mm and about 3,750 g·mm or about 200 g·mm and 2,000 g·mm. More specifically, in certain embodiments, the maximum weight mass multiplied by the weight separation distance is between about 500 g·mm and about 1,500 g·mm, between about 1,200 g·mm and about 1,400 g·mm.

When a weight or weight port is used as a reference point from which a distance, i.e., a vectorial distance (defined as the length of a straight line extending from a reference or feature point to another reference or feature point) to another weight or weights port is determined, the reference point is typically the volumetric centroid of the weight port. When a movable weight club head and sleeve assembly are combined, it is possible to achieve the highest level of club trajectory modification while simultaneously achieving the desired look of the club at address. For example, if a player prefers to have an open club face look at address, the player can put the club in the "R" or open face position. If that player then hits a fade (since the face is open) shot but prefers to hit a straight shot, or slight draw, it is possible to take the same club and move the heavy weight to the heel port to promote draw bias. Therefore, it is possible for a player to have the desired look at address (in this case open face) and the desired trajectory (in this case straight or slight draw).

In yet another advantage, by combining the movable weight concept with an adjustable sleeve position (effecting loft, lie and face angle) it is possible to amplify the desired trajectory bias that a player may be trying to achieve.

For example, if a player wants to achieve the most draw possible, the player can adjust the sleeve position to be in the closed face position or "L" position and also put the heavy weight in the heel port. The weight and the sleeve position work together to achieve the greater draw bias possible. On the other hand, to achieve the greatest fade bias, the sleeve position can be set for the open face or "R" position and the heavy weight is placed in the top port.

As described above, the combination of a large CG change (measured by the heaviest weight multiplied by the distance between the ports) and a large loft change (measured by the largest possible change in loft between two sleeve positions, Aloft) results in the highest level of trajectory adjustability. Thus, a product of the distance between at least two weight ports, the maximum weight, and the maximum loft change is important in describing the benefits achieved by the embodiments described herein.

In one embodiment, the product of the distance between at least two weight ports, the maximum weight, and the maximum loft change is between about 50 mm·g·deg and about 8,000 mm·g·deg, preferably between about 2000 mm·g·deg and about 6,000 mm·g·deg, more preferably between about 2500 mm·g·deg and about 4,500 mm·g·deg, or even more preferably between about 3000 mm·g·deg and about 4,100 mm·g·deg. In other words, in certain embodiments, the golf club head satisfies the following expressions in Equations 4-7. Notably, the maximum loft change may vary between 2-4 degrees, and a particular embodiment may have a maximum loft change of 4 degrees or +2 degrees.

$$50\ \text{mm·g·degrees} < Dwp \cdot Mhw \cdot \Delta\text{loft} < 8{,}000\ \text{mm·g·degrees} \quad (4)$$

$$2000\ \text{mm·g·degrees} < Dwp \cdot Mhw \cdot \Delta\text{loft} < 6{,}000\ \text{mm·g·degrees} \quad (5)$$

$$2500\ \text{mm·g·degrees} < Dwp \cdot Mhw \cdot \Delta\text{loft} < 4{,}500\ \text{mm·g·degrees} \quad (6)$$

$$3000\ \text{mm·g·degrees} < Dwp \cdot Mhw \cdot \Delta\text{loft} < 4{,}100\ \text{mm·g·degrees} \quad (7)$$

In the above expressions, Dwp, is the distance between two weight port centroids (mm), Mhw, is the mass of the heaviest weight (g), and Δloft is the maximum loft change (degrees) between at least two sleeve positions. A golf club head within the ranges described above will ensure the highest level of trajectory adjustability.

Additional disclosure regarding providing both a movable weight and an adjustable shaft assembly to a golf club head can be found in U.S. Pat. No. 8,622,847, the entire contents of which are incorporated by reference.

According to some example embodiments of a golf club head described herein, head areal weight, i.e., material density multiplied by the material thickness, of the golf club head sole, crown and skirt, respectively, is less than about 0.45 g/cm2 over at least about 50% of the surface area of the respective sole, crown and skirt. In some specific embodiments, the areal weight is between about 0.05 g/cm$^2$ and about 0.15 g/cm$^2$, between about 0.10 g/cm$^2$ and about 0.20 g/cm$^2$ between about 0.15 g/cm$^2$ and about 0.25 g/cm$^2$, between about 0.25 g/cm$^2$ and about 0.35 g/cm$^2$ between about 0.35 g/cm$^2$ and about 0.45 g/cm$^2$, or between about 0.45 g/cm$^2$ and about 0.55 g/cm$^2$.

According to some example embodiments of a golf club head described herein, the head comprises a skirt with a thickness less than about 0.8 mm, and the head skirt areal weight is less than about 0.41 g/cm$^2$ over at least about 50% of the surface area of the skirt. In specific embodiments, the skirt areal weight is between about 0.15 g/cm$^2$ and about 0.24 g/cm$^2$, between about 0.24 g/cm$^2$ and about 0.33 g/cm$^2$ or between about 0.33 g/cm$^2$ and about 0.41 g/cm$^2$.

Some of the example golf club heads described herein can be configured to have a constraint defined as the moment of inertia about the golf club head CG x-axis (Ixx) multiplied by the total movable weight mass. According to some embodiments, the second constraint is between about 1.4 kg$^2$·mm$^2$ and about 40 kg$^2$·mm$^2$. In certain embodiments, the second constraint is between about 1.4 kg$^2$·mm$^2$ and about 2.0 kg$^2$·mm$^2$, between about 2.0 kg$^2$·mm$^2$ and about 10 kg$^2$·mm$^2$ or between about 10 kg$^2$·mm$^2$ and about 40 kg$^2$·mm$^2$.

Some of the example golf club heads described herein can be configured to have another constraint defined as the moment of inertia about the golf club head CG z-axis (Izz) multiplied by the total movable weight mass. According to some embodiments, the fourth constraint is between about 2.5 kg$^2$·mm$^2$ and about 72 kg$^2$·mm$^2$. In certain embodiments, the fourth constraint is between about 2.5 kg$^2$·mm$^2$ and about 3.6 kg$^2$·mm$^2$ between about 3.6 kg$^2$·mm$^2$ and about 18 kg$^2$·mm$^2$ or between about 18 kg$^2$·mm$^2$ and about 72 kg$^2$·mm$^2$.

In some embodiments described herein, a moment of inertia about a golf club head CG z-axis (Izz) can be greater than about 190 kg·mm$^2$. More specifically, the moment of inertia about head CG z-axis 203 can be between about 190 kg·mm$^2$ and about 300 kg·mm$^2$, between about 300 kg·mm$^2$ and about 350 kg·mm$^2$, between about 350 kg·mm$^2$ and about 400 kg·mm$^2$, between about 400 kg·mm$^2$ and about 450 kg·mm$^2$, between about 450 kg·mm$^2$ and about 500 kg·mm$^2$ or greater than about 500 kg·mm$^2$.

In some embodiments described herein, a moment of inertia about a golf club head CG x-axis (Ixx) can be greater than about 80 kg·mm$^2$. More specifically, the moment of inertia about the head CG x-axis 201 can be between about 80 kg·mm$^2$ and about 180 kg·mm$^2$, between about 180 kg·mm$^2$ and about 250 kg·mm$^2$ between about 250 kg·mm$^2$ and about 300 kg·mm$^2$, between about 300 kg·mm$^2$ and about 350 kg·mm$^2$, between about 350 kg·mm$^2$ and about 400 kg·mm$^2$, or greater than about 400 kg·mm$^2$.

Additional disclosure regarding areal weight and calculating values for moments of inertia providing both a movable weight and an adjustable shaft assembly to a golf club head can be found in U.S. Pat. No. 7,963,861, the entire contents of which are incorporated by reference.

D. Example Vortex Generator Feature

In some embodiments, the surface of the sole 414 may comprise one or more surface features, such as a plurality of vortex generators 436, which as illustrated in FIG. 28 may each comprise a "wishbone" shape. These vortex generators 436 may be raised up from the surface of the sole 414, such as at a height of less than 0.75 mm, such as between 0 and 0.75 mm, or between 0.2 and 0.6 mm, or between 0.3 and 0.5 mm, with a narrow end of the raised portion angled toward the rear portion 432 of the golf club head so as to improve playability properties of the golf club head, such as to reduce "whistling" during a golf swing.

While in the illustrated embodiment, these vortex generators 436 are shown as being positioned on a sole 414, they may be placed, e.g., on a crown of a golf club head, elsewhere on the sole, or e.g., along a sole panel, along a toe surface, or at other locations on the surface of the golf club head in this or any of the golf club head embodiments illustrated herein, as desired.

In some embodiments, these vortex generators may have a greater height toward a rear of the golf club head, with wishbone "legs" that get narrower and shallower in height as they spread toward the face. In other embodiments (not pictured), these generators may be designed with, e.g., a point of greater height closer to the face and shorter and narrower legs spreading backwards, or other designs as may be desired.

While a wishbone shape is indicated, other shapes may provide advantageous effects, as well. Some examples include rectangular and star shaped projections or indentations, triangles, polygons, including, but not limited to, concave polygons, constructible polygons, convex polygons, cyclic polygons, decagons, digons, dodecagons, enneagons, equiangular polygons, equilateral polygons, henagons, hendecagons, heptagons, hexagons, Lemoine hexagons, Tucker hexagons, icosagons, octagons, pentagons, regular polygons, stars, and star polygons; triangles, including, but not limited to, acute triangles, anticomplementary triangles, equilateral triangles, excentral triangles, tritangent triangles, isosceles triangles, medial triangles, auxiliary triangles, obtuse triangles, rational triangles, right triangles, scalene triangles, Reuleaux triangles; parallelograms, including, but not limited to, equilateral parallelograms: rhombuses, rhomboids, and Wittenbauer's parallelograms; Penrose tiles; rectangles; rhombus; squares; trapezium; quadrilaterals, including, but not limited to, cyclic quadrilaterals, tetrachords, chordal tetragons, and Brahmagupta's trapezium; equilic quadrilateral kites; rational quadrilaterals; strombus; tangential quadrilaterals; tangential tetragons; trapezoids; polydrafters; annulus; arbelos; circles; circular sectors; circular segments; crescents; tunes; ovals; Reuleaux polygons; rotors; spheres; semicircles; triquetras; Archimedean spirals; astroids; paracycles; cubocycloids; deltoids; ellipses; smoothed octagons; super ellipses; and tomahawks; polyhedra; prisms; pyramids; and sections thereof, just to name a few.

In the illustrated embodiment, vortex generators 436 are illustrated as being positioned in the vicinity of the front channel 480, as well as on toe sole panel 448. Vortex generators incorporated into a composite panel may be particularly beneficial, because they can be molded along with the composite panel, which may reduce costs and simplify manufacture. However, as illustrated, the vortex generators 436 may also form part of the body and therefore be co-cast with the rest of the body of the golf club head. In such embodiments, the vortex generators are preferably cast in sufficient number and/or at positions away from area where heavy polishing of the golf club head takes place, so as to avoid having them polished away during the manufacturing process. Additionally, the vortex generators may comprise a three-dimensional decal or sticker that is adhered to the body and/or to a composite panel at a variety of locations, e.g. crown, sole, toe surface.

IV. A Third Example Golf Club Head

Figure 34:
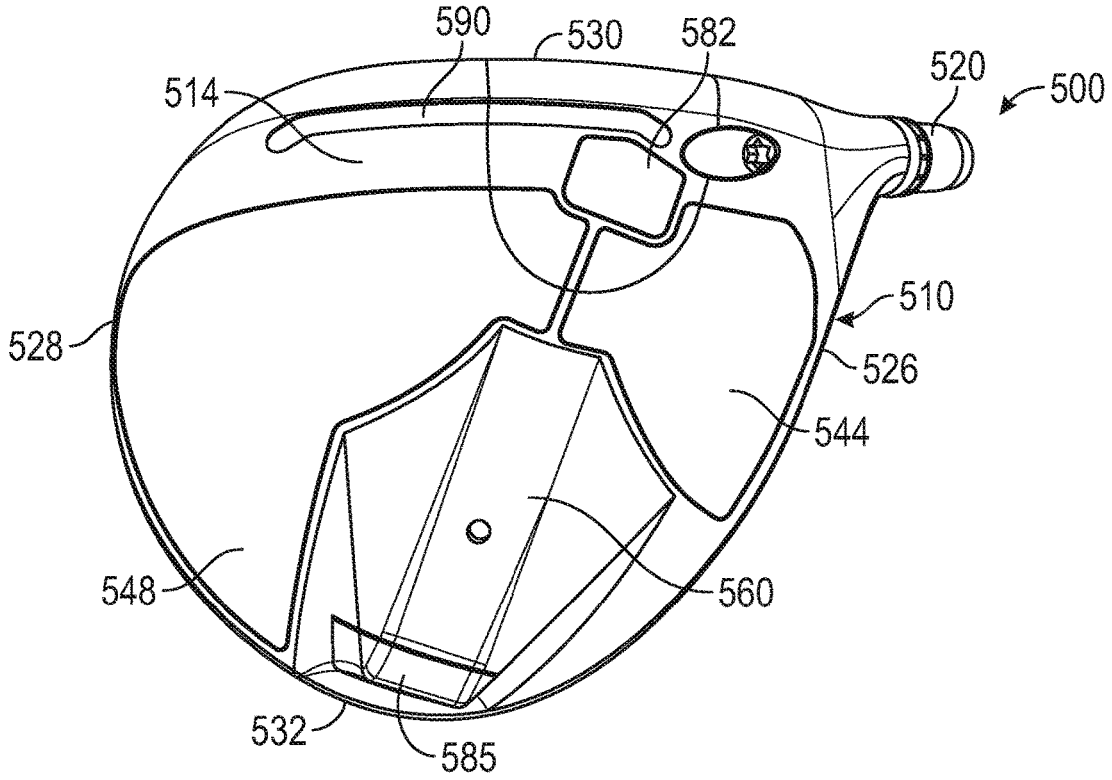
FIG. 34 is a perspective view of another example embodiment of a golf club head.
Figure 35:
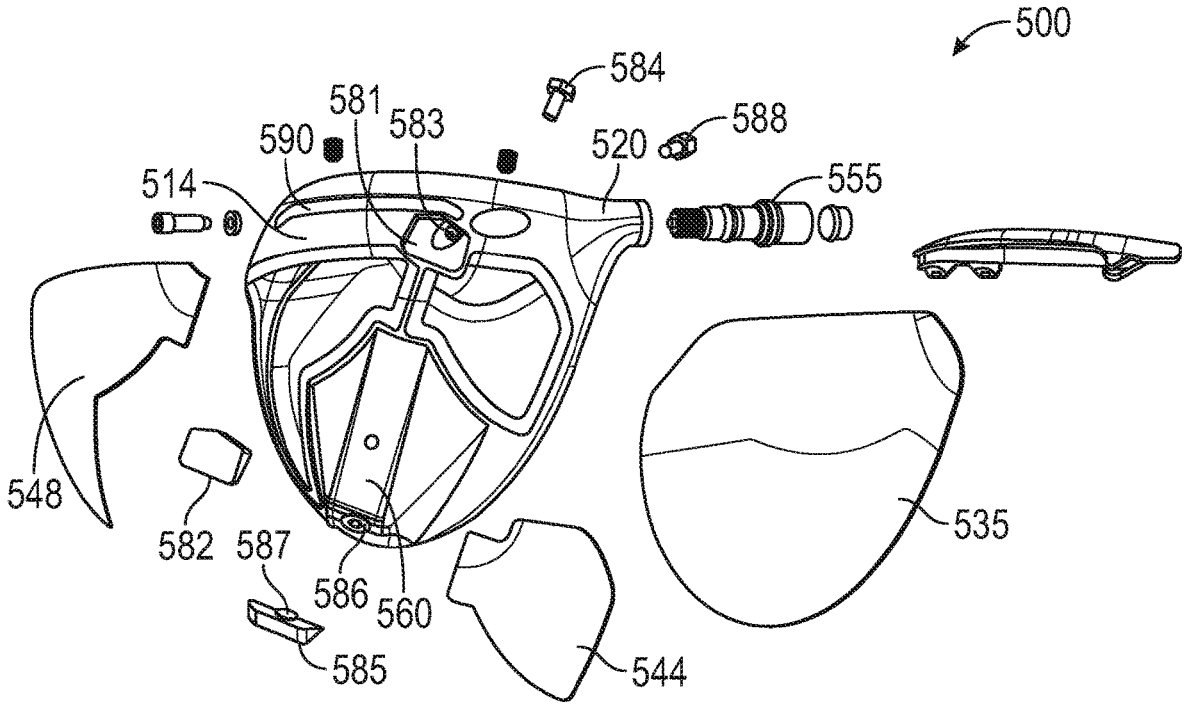
FIG. 35 an exploded perspective view of the golf club head of FIG. 34.

FIGS. 34-35 illustrate another example golf club head 500 that is similar to golf club head 300. Golf club head 500 may incorporate one or more of the features of golf club heads 300 or 400 described above, along with one or more additional discretionary mass elements, which may be added to or in place of one or more of the features of golf club heads 300 or 400, including as further described herein.

Golf club head 500 includes a hollow body 510 defining a crown portion (not shown), a skirt portion (not shown), a sole portion 514, and a striking surface (not shown). The body 510 further includes a hosel 520, which is adapted to receive a golf club shaft assembly 555. The body 510 further includes a heel portion 526, a toe portion 528, a front portion 530, and a rear portion 532. Included are a number of features that may improve playability, including at least an inertia generator 560, front channel 590, as well as composite panels on the sole 544, 548 and on the crown 535, along with discretionary mass elements, such as a removable front weight member 582, and an inertia generator mass element 585, and other additional features, as will be further described herein.

A. Rear Removable Weight

Positioned on a rear side of the inertia generator 560 is inertia generator mass element 585, which may comprise a steel or tungsten weight member or other suitable material. Inertia generator mass element 585 may be removably affixed to the rear of the inertia generator 560 using a fastener port 586 that is positioned in the rear of the inertia generator 560 and configured to receive a fastener 588, which may be removably inserted through an aperture 587 in the inertia generator mass element 585 and into the fastener port 586. Fastener port 586 and aperture 587 may be threaded so that fastener 588 can be loosened or tightened either to allow movement of, or to secure in position, inertia generator mass element 585. The fastener may comprise a head with which a tool (not shown) may be used to tighten or loosen the fastener, and a body that may, e.g., be threaded to interact with corresponding threads on the fastener port 586 and aperture 587 to facilitate tightening or loosening the fastener 588. The fastener port 586 can have any of a number of various configurations to receive and/or retain any of a number of fasteners, which may comprise simple threaded fasteners, such as described herein, or which may comprise removable weights or weight assemblies, such as described elsewhere herein and in the incorporated patents and applications.

Fastener port 586 may be angled diagonally in a manner similar to fastener port 386 so that the fastener 588 is angled downward away from the crown of the golf club head, and the fastener port is forward of a head of the fastener 588, which may provide a more secure attachment by "sandwiching" the portion of the inertia generator mass element 585 likely to have the greatest mass between the inertia generator 560 and the fastener 588.

Alternatively, in other embodiments (not pictured) inertia generator mass element 585 may be either integrally formed or affixed to the inertia generator using by bonding, gluing, brazing, or using one or more of the methods described herein and in the incorporated patents and applications.

One potential embodiment of an inertia generator mass element 585 that may be utilized with any of the embodiments herein weighs between 10 grams and 50 grams, such as between 10 grams and 30 grams or between 20 grams and 40 grams.

B. Front Removable Weight

Positioned behind the front channel 590 and in front of and at least partially surrounded by forward portions of a heel sole insert 544 and toe sole insert 548 is a removable front weight member 582, which may comprise a steel or tungsten weight member or other suitable material.

Front weight member 582 may be removably affixed to the golf club head 500 and at least partially contained within a sole cavity 581 containing a fastener port 583 that is positioned in the sole 514 of the golf club head. Sole cavity 581 may be configured to have inner dimensions that are substantially coextensive with the outer dimensions of the front weight member 582, so that a bottom surface (opposite a crown of the golf club head) of the front weight member 582 is substantially parallel with the remainder of the surface of the sole 514. Further, front weight member 582 is configured to receive a fastener 584, which may be removably inserted through an aperture (not shown) in the front weight member, or can be configured to be otherwise suitably retained within the front weight member so that the weight member is firmly attached to the golf club head 500. Fastener port 583 and/or front weight member 582 may be threaded so that fastener 584 can be loosened or tightened to release or secure, respectively, the front weight member 582. The fastener may comprise a head with which a tool (not shown) may be used to tighten or loosen the fastener, and a body that may, e.g., be threaded to interact with corresponding threads on the fastener port 583 to facilitate tightening or loosening the fastener 584. The fastener port 583 can have any of a number of various configurations to receive and/or retain any of a number of fasteners, which may comprise simple threaded fasteners, such as described herein, or which may comprise removable weights or weight assemblies, such as described elsewhere herein and in the incorporated patents and applications.

While it is shown as being generally pentagonal in shape, it is to be understood that other shapes may be used for a removable front weight member 582. Additionally, in other embodiments (not pictured) a front weight member may be either integrally formed or affixed to the body 510 of the golf club head using by bonding, gluing, brazing, or using one or more of the methods described herein and/or in the incorporated patents and applications.

One potential embodiment of a front removable weight 582 that may be utilized with any of the embodiments herein weighs between 5 grams and 30 grams, such as between 5 grams and 20 grams or between 10 grams and 15 grams.

V. A Fourth Example Golf Club Head

Figure 36:
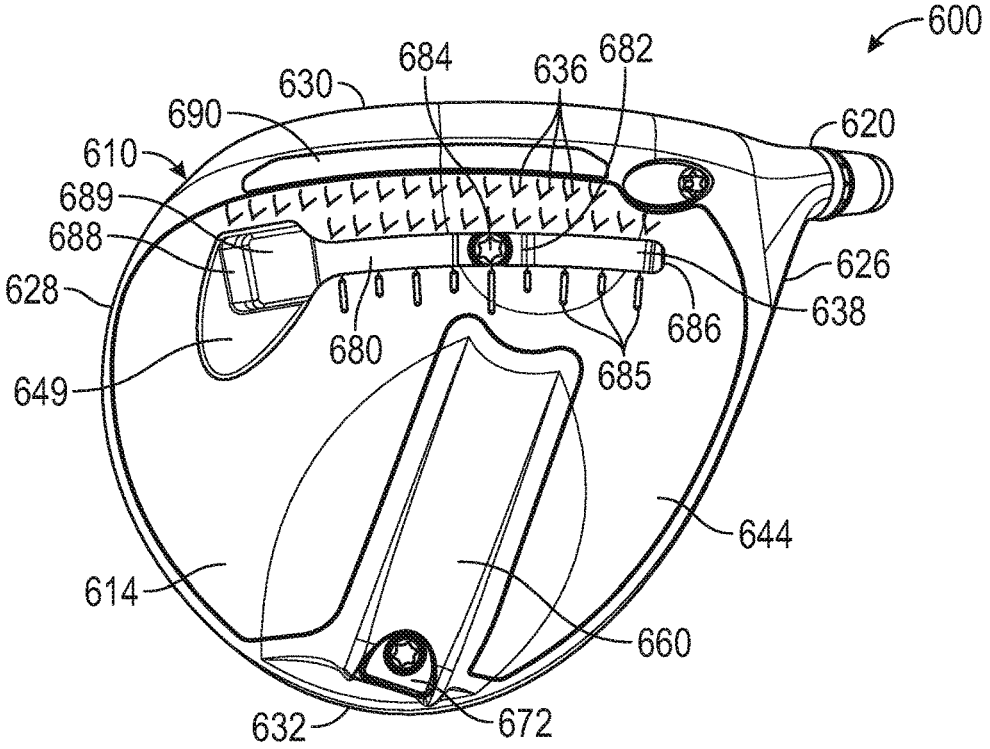
FIG. 36 is a perspective view of another example embodiment of a golf club head.
Figure 37:
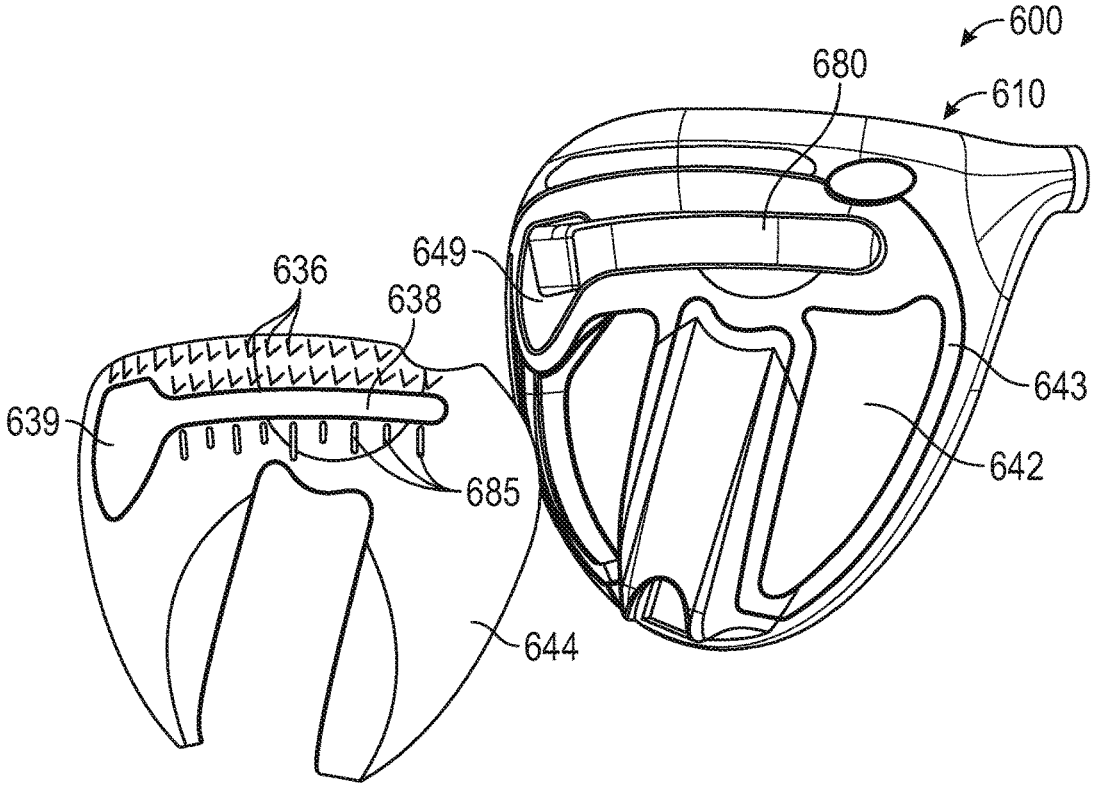
FIG. 37 an exploded perspective view of the golf club head of FIG. 36.

FIGS. 36-37 illustrate another example golf club head 600 that is similar to golf club head 400. Golf club head 400 may incorporate one or more of the features of golf club heads 300, 400, or 500 described above, along with one or more additional discretionary mass or other advantageous elements, which may be added to or in place of one or more of the features of golf club heads 300, 400, or 500, including as further described herein.

Golf club head 600 includes a hollow body 610 defining a crown portion (not shown), a skirt portion (not shown), a sole portion 614, and a striking surface (not shown). The body 610 further includes a hosel 620, which is adapted to receive a golf club shaft assembly (not shown). The body 610 further includes a heel portion 626, a toe portion 628, a front portion 630, and a rear portion 632. Included are a number of features that may improve playability, including at least an inertia generator 660, front channel 690, as well as composite panels on the sole 544 and on the crown (not shown), along with discretionary mass elements, such as a removable and repositionable front weight member 682, and an inertia generator mass element 672, and other additional features, as will be further described herein.

A. Example Slidable Front Weight Assembly

Club head 600 is provided with an elongated channel 680, as illustrated in FIGS. 36 and 37, which may be similar to elongated channel 480 described in the embodiment shown in FIGS. 27-33. Elongate channel 680 is positioned on the sole 614, and extends generally from a heel end 686 oriented toward a heel portion of the golf club head 626 to a toe end 688 oriented toward a toe portion of the golf club head 628. A front ledge and a rear ledge (not pictured) are located within the channel 680 and extend from the channel's forward and rearward walls, respectively. A weight assembly 682 may be slidably retained within the weight channel, and may be retained be securing it on the front and rear ledges within the channel 680, in a manner such as described above. The weight assembly is slidably repositionable such that it can be moved between a plurality of selected positions between the heel and toe ends of the channel, which may in turn adjust the center of gravity of the golf club head, particularly along the x-axis. In certain embodiments, at least three selectable positions are available, while in other embodiments, at least five positions, at least ten positions, or more positions are available. In some embodiments, one or more indicators 685 may be included, e.g., on the sole 614 of the golf club head to indicate the relative position of the slidable weight assembly 682. In particular embodiments, as illustrated, these indicators 685 may be included within the composite sole panel 644, so that they can be molded along with the panel. However, the indicators could also be part of the metal body of the golf club head and co-cast with the rest of the body, or applied to either the body or the composite panel as a decal or sticker that is adhered to provide indicators at the desired locations.

The elongated channel may provide an enlarged cavity 689 for introducing the weight assembly 682 into the channel and/or for removing or replacing the weight assembly 682. An additional enlarged recess 649 may be provided around the enlarged cavity, extending rearwardly to provide improved access to facilitate introducing the weight assembly 682, while also removing some additional discretionary mass from the club head. The weight assembly may also be provided with a fastener 684 to connect a first portion and a second portion of the weight assembly, in a manner similar to fastener 484 described above to secure the weight assembly 682 in a desired position within the elongate channel 680. In some embodiments, inertia generator mass element 672 may also be configured to be inserted into elongate channel 680 in a similar manner to weight assembly 682 to add additional discretionary mass forward of the golf club head. Additional disclosure regarding additional suitable potential methods and apparatus for fastening the weight assembly 682 and/or inertia generator mass element 672 are provided elsewhere herein and in the incorporated patents and applications.

B. Example Composite Sole Panel

As illustrated in FIGS. 36 and 37, the golf club head 600 may include a single composite sole insert 644, which may be secured to the body 610 by applying a layer of epoxy adhesive or other securement means, such as bolts, rivets, snap fit, other adhesives, or other joining methods or any combination thereof, to cover at least an opening 642 in the sole rearward of the front channel 690. The sole insert 644 covers a substantial portion of the sole's surface area as, for example, at least 30%, at least 40%, at least 50%, at least 60%, at least 70% or at least 80% of the sole's surface area. In the illustrated embodiment, the sole insert 644 at least partially surrounds the inertia generator 660 and also surrounds the elongate channel 680.

As illustrated in FIG. 36, the composite sole panel may at least partially overlap at least a portion of the sole panel, providing an aperture 638 through which a tool may be inserted to adjust the weight assembly 682. Allowing the composite panel to overlap the assembly may aid in further ensuring that the weight assembly 682 does not become dislodged, and may also provide for a location to position indicators related to the position of the weight assembly, as further described herein. An additional enlarged aperture portion 639 may be provided toward the toe side of aperture 638, which may be co-extensive with, or similarly configured to the enlarged recess 649, to provide improved access to facilitate introducing the weight assembly 682. The sole insert 644 in certain embodiments may have a surface area of at least 3000 $mm^2$, at least 4000 $mm^2$, at least 5000 $mm^2$, at least 6000 $mm^2$, or at least 6500 $mm^2$.

As best illustrated in FIG. 37, the sole can be formed to have a recessed peripheral ledge or seats that may be similar to the ledge described above for the crown insert, such that the sole insert 644 is either flush with the adjacent surfaces of the body to provide a smooth seamless outer surface or, alternatively, slightly recessed below the body surfaces. Sole opening 642 has a sole ledge 643 for supporting sole insert 644. The sole insert 644 can comprise any suitable material (e.g., lightweight composite and/or polymeric materials) and can be attached to the body in any suitable manner, as described in more detail with regard to the attachment of the crown insert, as well as elsewhere herein and in the incorporated patents and applications.

C. Example Vortex Generator Feature

In some embodiments, the surface of the sole 614 may comprise one or more surface features, such as a plurality of vortex generators 636, which may each comprise a "wishbone" shape, or one of the other shapes described herein. In the illustrated embodiment, vortex generators 636 are illustrated as being positioned on sole panel 644. Vortex generators incorporated into a composite panel may be particularly beneficial, because they can be molded along with the composite panel, which may reduce costs and simplify manufacture. However, as illustrated, the vortex generators 636 may also form part of the body and therefore be co-cast with the rest of the body of the golf club head. In such embodiments, the vortex generators are preferably cast in sufficient number and/or at positions away from area where heavy polishing of the golf club head takes place, so as to avoid having them polished away during the manufacturing process. Additionally, the vortex generators may comprise a three-dimensional decal or sticker that is adhered to the body and/or to a composite panel at a variety of locations, e.g. crown, sole, toe surface.

While in the illustrated embodiment, these vortex generators 636 are shown as being positioned on a forward edge of the composite sole panel 644, they may be placed, e.g., on a crown of a golf club head, elsewhere on the sole, or e.g., along a toe surface, or at other locations on the surface of the golf club head, as desired.

VI. Illustrated Embodiments Are Non-Limiting Examples

In view of the many possible embodiments to which the principles of the disclosed invention may be applied, it should be recognized that the illustrated embodiments are only examples of the invention and should not be taken as limiting the scope of the invention. Rather, the scope of the invention is defined by the following claims. We therefore claim as our invention all that comes within the scope and spirit of these claims.

We claim:

1. A golf club head comprising:

a body having a bottom portion, a top portion, a front portion, a rear portion, a heel portion, and a toe portion, wherein the body has a volume of at least 420 cubic centimeters (cc) and no more than 475 cc, wherein the volume is equal to the volumetric displacement of the club head body;

a sole located on the bottom portion of the golf club head frame and comprising a sole recess defined by a recessed sole ledge disposed along a perimeter of a sole opening;

a sole insert disposed in the sole recess and joined to the frame to cover the sole opening, the sole insert comprising a non-metal material;

a crown located at the top portion of the golf club head and comprising a crown recess defined by a recessed crown ledge disposed along a perimeter of the crown opening;

a crown insert disposed in the crown recess and joined to the frame to cover the crown opening, the crown insert comprising a non-metal material; and a striking surface positioned at the front portion of the body and configured to receive an impact, the striking surface having a striking surface area measured in square millimeters ($mm^2$);

wherein the golf club head has a head origin defined as a position on a face plane at a geometric center of the face, the head origin including an x-axis tangential to the face and generally parallel to the ground when the head is in a normal address position where a positive x-axis extends towards the heel portion, a y-axis extending perpendicular to the x-axis and generally parallel to the ground when the head is in the normal address position where a positive y-axis extends from the face and through the rearward portion of the body, and a z-axis extending perpendicular to the ground, to the x-axis and to the y-axis when the head is in the normal address position where a positive z-axis extends from the head origin and generally upward, wherein the golf club head has a center of gravity;

a center sole portion comprising:

a bottom center sole portion surface extending rearwardly along the bottom portion of the sole having a first end and a second end, wherein the second end extends rearwardly of a rearwardmost edge of the sole insert;

a toeward sole surface that slopes upwardly from the bottom center sole portion surface to a first bottom portion of the sole that is toeward of the bottom center sole portion surface, wherein at the second end the bottom center sole portion surface is raised relative to the first bottom portion of the sole, and the bottom center sole portion surface is positioned closer to a ground plane than the first bottom portion of the sole when viewed in the normal address position;

a first edge extending from the first end to the second end on a toe side of the bottom center sole portion surface and defining a transition between the bottom center sole portion surface and the toeward sole surface;

a heelward sole surface that slopes upwardly from the bottom center sole portion surface to a second bottom portion of the sole that is heelward of the bottom center sole portion surface, wherein at the second end the bottom center sole portion surface is raised relative to the second bottom portion of the sole, and the bottom center sole portion surface is positioned closer to a ground plane than the second bottom portion of the sole when viewed in the normal address position, and further wherein a rearward end of the heelward sole surface extends rearwardly of a rearwardmost edge of the sole insert; and a second edge extending from a forward end proximate to the first end to a rearward end proximate to the second end on a heel side of the bottom center sole portion surface and defining a transition between the bottom center sole portion surface and the heelward sole surface, wherein the rearward end is located toeward of the forward end such that the second edge extends rearwardly and is angled toewardly from the forward end to the rearward end, and further wherein the rearward end of the second edge extends rearwardly of a rearwardmost edge of the sole insert; and wherein a striking surface area to volume ratio calculated by converting the striking surface area into square centimeters ($cm^2$) and dividing by the volume of the golf club head body is no less than 0.06 and no greater than 0.086;

wherein the striking surface area is between 3200 $mm^2$ and 3950 $mm^2$;

wherein the golf club head has a Zup of no more than 28 mm.

2. The golf club head of claim 1, further comprising a weight port located on the center sole portion near the rear portion of the golf club head.

3. The golf club head of claim 1, wherein the golf club head has a moment of inertia about the center of gravity z-axis, $I_{zz}$, between about 450 $k \cdot gmm^2$ and about 650 $k \cdot gmm^2$.

4. The golf club head of claim 1 having a front to back club head depth of between 110 mm and 120 mm.

5. The golf club head of claim 1, wherein a ratio of a front to back club head depth to a club head length is no more than 0.94.

6. The golf club head of claim 1, wherein the center of gravity of the golf club head is positioned toeward of the head origin.

7. The golf club head of claim 1, wherein a rearwardmost point of the golf club head is located below the center of gravity of the golf club head.

8. The golf club head of claim 1, further comprising at least one composite crown panel having a surface area of at least 9000 $mm^2$.

9. The golf club head of claim 1, wherein the golf club head has a volume below 30 mm above ground plane of at least 190 cc.

10. The golf club head of claim 1, wherein the golf club head has a rear volume of at least 160 cc.

11. The golf club head of claim 1, wherein the golf club head has a toe volume that is at least 56 percent of the body volume.

12. The golf club head of claim 1, wherein the golf club head has a minimum toe curvature of at least 30 mm.

13. The golf club head of claim 1, wherein the golf club head has a maximum toe curvature of no more than 50 mm.

14. The golf club head of claim 1, further comprising a weight channel formed in the sole and defining a path along the sole; and a weight assembly positioned in the weight channel, the weight assembly configured to be adjusted along the path to any of a range of selectable positions in the weight channel to adjust mass properties of the golf club head.

15. The golf club head of claim 14, further comprising a plurality of vortex generators positioned forward of the weight channel.

16. The golf club head of claim 1, further comprising a plurality of vortex generators positioned on a forward portion of the sole of the golf club head.

17. The golf club head of claim 1, further comprising a plurality of vortex generators positioned on a composite panel in a toeward portion of the golf club head.

18. The golf club head of claim 1, further comprising a plurality of vortex generators positioned on a composite panel in a forward portion of the sole of the golf club head.

19. The golf club head of claim 1, further comprising a plurality of vortex generators positioned on a composite panel in the crown of the golf club head.

20. The golf club head of claim 1, wherein the golf club head has:

a volume below 30 mm above ground plane that is at least 45 percent of the body volume, a rear volume that is at least 33 percent of the body volume, a toe volume that is at least 60 percent of the body volume, and a Zup that is no more than 26 mm.

21. The golf club head of claim 1, wherein the first end of the center sole portion is positioned proximate a XZ plane passing through the golf club head center of gravity.

* * * * *